US007802724B1

(12) United States Patent
Nohr

(10) Patent No.: US 7,802,724 B1
(45) Date of Patent: Sep. 28, 2010

(54) IDENTIFICATIONS AND COMMUNICATIONS METHODS

(76) Inventor: Steven Paul Nohr, 20034 95th Pl. NE., Bothell, WA (US) 98011

( * ) Notice: Subject to any disclaimer, the term of this patent is extended or adjusted under 35 U.S.C. 154(b) by 2237 days.

(21) Appl. No.: 10/323,909

(22) Filed: Dec. 20, 2002

(51) Int. Cl.
*G07B 15/02* (2006.01)

(52) U.S. Cl. ..... 235/384; 340/573.1

(58) Field of Classification Search ..... 235/384, 235/492; 340/572.1, 573.1
See application file for complete search history.

(56) References Cited

U.S. PATENT DOCUMENTS

| | | | | |
|---|---|---|---|---|
| 5,793,639 | A | 8/1998 | Yamazaki | 364/478.14 |
| 5,914,671 | A | 6/1999 | Tuttle | 340/825.54 |
| 6,108,636 | A | 8/2000 | Yap et al. | 705/5 |
| 6,119,096 | A | 9/2000 | Mann et al. | 705/5 |
| 6,127,917 | A | 10/2000 | Tuttle | 340/10.1 |
| 6,222,452 | B1 | 4/2001 | Ahlstrom et al. | 340/572.1 |
| 6,229,445 | B1 | 5/2001 | Wack | 340/572.7 |
| 6,265,975 | B1 | 7/2001 | Zimmerman | 340/571 |
| 6,294,997 | B1 * | 9/2001 | Paratore et al. | 340/572.1 |
| 6,335,688 | B1 | 1/2002 | Sweatte | 340/573.1 |
| 6,338,041 | B1 | 1/2002 | Kawamata | 705/5 |
| 6,342,836 | B2 | 1/2002 | Zimmerman | 340/571 |
| 6,698,653 | B1 * | 3/2004 | Diamond et al. | 235/375 |
| 6,873,260 | B2 * | 3/2005 | Lancos et al. | 340/573.1 |
| 2002/0084904 | A1 * | 7/2002 | De La Huerga | 340/573.1 |

* cited by examiner

*Primary Examiner*—Daniel A Hess
(74) *Attorney, Agent, or Firm*—Seed IP Law Group PLLC

(57) ABSTRACT

The invention relates to improved methods and forms for automatically and non-unobtrusively to detect, without human interpretation, the identification of people(s), object(s), and other, with various methods utilized in connection to creating, storing, adding, connecting, modifying, sharing, inputting, recalling, authorizing, approving, tracking, generating, formatting, monitoring, accessing, locating, deleting, controlling, linking, collecting all types of data and information, and generating at least one type of identifiable communications information related to anyone or anything, and in and/or around any type of environment, such as an airport(s), airline(s), and/or other aviation location(s), theme park, amusement park, aquarium, cruise ships, tourist location, hospitals, buildings, government complex, malls, customs boards, sports events, parking, manufacturing, hotels, resorts, clubs, retail, elevators, utilities, museums, libraries, as well as other types of location(s), among other environments.

19 Claims, 11 Drawing Sheets

IDENTIFICATIONS AND COMMUNICATIONS METHODS

CROSS-REFERENCE TO RELATED APPLICATION

This application is entitled to the benefit of Provisional Patent Application Ser. No. 60/340,851 filed 2001 Dec. 19.

FEDERALLY SPONSORED RESEARCH

Not Applicable

SEQUENCE LISTING OR PROGRAM

Not Applicable

BACKGROUND

1. Field of Invention

The invention relates to improved methods and forms for automatically and non-unobtrusively to detect, without human interpretation, the identification of people(s), object(s), and other, with various methodologies utilized in relation to creating, storing, adding, connecting, modifying, sharing, inputting, recalling, authorizing, approving, tracking, generating, formatting, monitoring, activating, invalidating, accessing, locating, deleting, controlling, linking, collecting all types of data and information, and generating at least one type of identifiable communications information related to anyone or anything, and in and/or around any type of environment, such as an airport(s), airline(s), and/or other aviation location(s), theme park, amusement park, aquarium, cruise ships, tourist location, hospitals, buildings, government complex, malls, customs boards, sports events, parking, manufacturing, hotels, resorts, clubs, retail, elevators, utilities, jewelry stores, museums, libraries, as well as other types of location(s), among other environments.

2. Background of the Invention

As reflected in the ever increasing skyrocketing customer demands all over the world in seeking to acquire new forms that can automatically and non-unobtrusively detect, without human interpretation, and without regard to shape or method of concealment, a system providing at least one of these components, including security, tracking, linking, profiling, monitoring, time, audit, and attendance, reporting, improved crowd control, creating, storing, adding, connecting, modifying, sharing, inputting, recalling, responding, authorizing, approving, generating, formatting, activating, invalidating, accessing, locating, deleting, controlling, servicing ones customer(s) in a more efficient manner, improving value added services, real-time data collections, networking and sharing of data and information, collection and compiling of data, and improved efficiencies with such processes, there exists significant demand and opportunities with buyers all over the world for the creation and supply of such new forms, designs, systems, and products that significantly enhances and improves the ways, means, and methods in which these objectives are achieved.

3. Description of Prior Art

As related to applying the preferred methodology and embodiment to this patent, and comparing it with prior art, as highlighted in Form PTO-1449, to at least one particular industry and vertical market, such as the airline(s), airport(s), and aviation industry, it will become quickly evident in the importance in seeking such new forms of technologies, systems, designs, and integration methodologies from advanced research and development groups that significantly increases their ability to improve:

(a) perimeter access security and control, security of aircraft, and ground access areas, security of airport environments, strengthen access control points (including air traffic control operations areas, maintenance areas, crew lounges, baggage handling areas, concessions, and catering delivery areas) to ensure the security of passengers, airport and airlines personnel, (b) time, audit, and attendance, including identifying individuals (including passengers, airport and airlines personnel) based on unique personal characteristics, (c) eliminate 'bait and switch' tactics for passengers are only allowed to depart from a gate, and/or exit an airport facility with their own luggage, that passengers have all their carry-on baggage with them, and if not the system can give the exact location of the missing carry-on bag(s), (d) eliminate 'piggybacking' techniques by unauthorized parties riding on the backs of authorized parties through controlled access points in and around airport, and airplane environments, (e) locate in the airport any and all passengers, as well as their carry-on baggage, and checked-in baggage who have checked in but not boarded their flight by a specified time before departure, rather than current random PA announcements, (f) inform the system, security personnel, and the passenger if in the event that their carry-on baggage gets more than a determined number of feet from the passenger/owner, providing immediate audible notification precisely where such an event occurs, rather than random public announcements that are heard throughout the airport environment, (g) the exact location of any passengers, and carry-on baggage on multi-leg flights who leave the plane and have not re-boarded by a specified time before departure, (h) monitoring of all people and carry-on luggage not just at access points but more importantly throughout an entire airport, as well as anywhere within an airplane environment, (i) the location of all checked baggage that has not yet been loaded onto the airplane and/or cargo container, and/or their identification and location within the airplane hold of any already loaded bags that have been loaded and needs to be removed because a passenger has not boarded the flight, identify precisely which cargo container, and the exact location of the baggage within the cargo container, (j) proper monitoring of all checked-in baggage throughout their loading and unloading process, (k) enhanced to the baseline unit, secured access control, and networking multiple sites across the country integrated together, multiple site monitoring capabilities, (l) ETA (estimated time of arrival) information that can be provided to passengers how long until their baggage will come out of the baggage claim carousel, and which carousel, (m) confirmation capabilities by passengers to access from information terminals all types of information about them, their flight, their checked-in baggage, carry-on baggage, leaving a message at the destination airport for 'pick-up parties' to inform them when, and where they will be waiting, as well as sending email, text messaging, voice mail, and other types of communications to at least one party outside the airport environment, (n) securing passengers baggage from being taken out of the baggage claim carousel area by any unauthorized party, for reduction and elimination of theft, without the need of human inspectors checking and matching baggage numbers with passenger receipt numbers, (o) to automatically and non-unobtrusively detect, without human interpretation, and without regard to shape or method of concealment, the identity of any passenger, carry-on baggage, or checked-in baggage anywhere in, and/or around an airport, airplane, or aviation environment, receiving such information as highlighted in FIG. 2, FIG. 3, and FIG. 4, by any security, airport, airlines, or other personnel. This means entire data files on passengers can be retrieved in real-time by such parties and apparatuses by simply pointing such devices at any one of the passengers or persons belongings that has entered the system.

(p) terminating, or logging off any and all persons, objects, and other that exists an airport, airplane, and/or aviation environment, (q) tracking the location, and monitoring of all persons, objects, and other that enters such an environment, (r) a more advanced airline ticket type of device, as well as baggage device, which provides all types of information services, in required languages, message centers, and a host of other services accompanying complete passenger profile, that is conveniently accessible by a host of fixed and mobile airport, security, airlines, and other authorized personnel at any time, and not limited to controlled access points alone.

All of the Prior Art cases listed in the PTO-1449 sheets (1) and (2) at best only provides a small portion of the necessary functions, features, and demands that are required by an environment, such as an airport environment of today.

U.S. Pat. No. 6,342,836 B2 Zimmerman Jan. 29, 2002: patent and product only provides a limited capability for passengers to know if their luggage is loaded below the airplane that the passenger is departing on, and a limited capability of knowing only the precise time that the baggage comes out of the baggage claim carousel belt. Other than that, this patent cannot provide the host of access control, tracking, monitoring, services, and other features that airlines and airports require in this day and age. This patents PED transmitter and transponder controller product has little to no enhanced security features to protect such an environment from any terrorist event, nor is it able to automatically and non-unobtrusively detect, without human interpretation, and without regard to shape or method of concealment the location of any persons, carry-on baggage, or exact location of a checked-in baggage at any point in time, nor can it provide passenger, or airport, airline personnel information profiles by use of various forms of hardware devices, as provided in FIG. 2, FIG. 3, FIG. 4, FIG. 5, and FIG. 7 not only at access control points, but more importantly anywhere in and around an airport, airplane, or aviation environment. This patent is unable to provide or achieve all or most of the items listed above (a) to (r), nor is this system able to provide the host of functions and features listed on the key advantages of this filed patent hereto, or any type of information, or services to at least one user.

U.S. Pat. No. 6,338,041 B1 Kawamata Jan. 8, 2002: patent and product does have a means of issuing paper tickets accompanies by a tag, which can be utilized to collect and update information at primary access control points, and providing the necessary equipment to ticket counter staff, screening areas, and boarding gate areas, however does not provide a means to eliminate bait-and-switch, piggybacking, can't facilitate matching techniques, a host of services that can be provided to passengers, pick up party, and persons, can't identify and know when a passenger leaves their boarding pass and associated tag in the trash or walking away, can't quickly and unobtrusively query a passenger by a security personnel while mobile in such environment, can't identify or know when or if passenger and carry-on baggage is separated, and a host of additional functions and features as highlighted in the present invention.

U.S. Pat. No. 6,335,688 B1 Sweatte Jan. 1, 2002: patent and product basically provides an initial check-in process, whereby utilizing biometric scan, and taking a photo of a person, which is held on a central database, and issues a smartcard device to the person. A smartcard can only detect and track a person as and when they go through primary access control points, such as upon entering a satellite area at an inspection area, or at a departure gate. The prior art and system is in effect unable to facilitate numerable functions, and features as provided in the present inventions preferred embodiment, or variations to the preferred embodiment.

Most of these limitations and differentiations include:

1. The prior art does not track checked-in baggage,
2. The prior art does not track carry-on baggage,
3. The prior art does not eliminate 'bait and switch' tactics,
4. The prior art does not provide information services to travelers,
5. The prior art does not allow security personnel to randomly identify passengers/airport/airlines personnel while mobility moving around,
6. The prior art does not know if or how may checked baggage has been checked in by a passenger, carry-on baggage, or able to match baggage to persons, or persons to baggage,
7. The prior art does not know where passengers checked-in luggage is,
8. The prior art does not know if or where a passengers carry-on baggage is,
9. The prior art can't confirm whether a passenger boarding an airplane has left their carry-on baggage in the airport, is the owner of another passenger, or more,
10. The prior art can't prevent the passenger from just leaving their smartcard of swipe card in the trash, since it is not secured, attached, or adhered to the passenger in any way, nor having a means of informing other parties in such an event,
11. The prior art can't quickly identify which checked-in luggage that has been loaded into the underbelly of an airplane belongs to which passenger who did not board the airplane, (for quick removal, so the airplane can depart on schedule),
12. The prior art can't identify and track passengers and carry-on baggage activities throughout an airport, airplane, or aviation environment,
13. The prior art can't provide data and information to passengers (about their flight, activities, ETA, checked-in baggage, message boards, sending messages to parties outside the airport environment, to a party in the parking area, and much more,
14. The prior art doesn't provide a secure method to ensure passengers/airport/airlines personnel actually carry or bring their smartcard with them at all times,
15. The prior art doesn't have a means of activating and deactivating their smartcard,
16. The prior art doesn't know where or if the passenger leaves its smartcard laying around, only at the time the passenger attempts to board an airplane,
17. The prior art can't provide (ETA) information how long before the passengers luggage will arrive to the carousel area,
18. The prior art doesn't provide a means for audible and visual information informing the passenger when its luggage bags start coming out of the carousel, 19. The prior art doesn't provide a means for the passenger or traveler to notify a pick up party they have arrived, nor how long till they come out, or where to meet,
20. The prior art doesn't know where the passengers pick up arty is located,
21. The prior art can't invalidate a passenger who exists an airport environment, preventing them form re-entering,
22. The prior art can't track airport tenants, merchandise, or other coming in or going out of such controlled environment,
23. The prior art can't provide time, audit, and attendance on airport, airlines, and other personnel,
24. The prior art can't eliminate theft of smartcards or swipe cards which are very expensive to use. It is not realistic to force passengers to return PASScards if not they can't exit an airport. A system must utilize a very affordable and disposable device and system so that the passenger can just exist the airport and throw the device away at their own convenience, or be used with an advertisement on it to show and get a discount from say a Starbucks coffee shop anywhere in the arrival city.
25. The prior art can't automatically calculate and determine where passengers who have not yet boarded are located, including their carry-on baggage, and even contacting them in that specific location, nor no luggage tracking or handling system,
26. The prior art can't determine if the passenger has left their carry-on baggage inside of the airplane, and a host of other limitations as provided in the present invention.

There are equally to many holes and weaknesses with the prior art in providing a more efficient, less obtrusive, more cost effective, and complete system that not only provides complete tracking, monitoring, and auditing services to airports and airlines, but equally as important a host of services provided to users, such as passengers, workers, and alike in an easy and convenient system, even taking into account language preferences, and other types of services.

U.S. Pat. No. 6,265,975 B1 Zimmerman Jul. 24, 2001: patent and product see U.S. Pat. No. 6,342,836 B2 Zimmerman Jan. 29, 2002 above.

U.S. Pat. No. 6,229,445 B1 Wack May 8, 2001: patent and product does provide an identification tag having a unique RF signature, and a source for generating RF energy, and a detector for reading the signature when the identification tag is illuminated the RF energy generated by the source. The key distinction as related to the prior arts identification tag is in its utilization of no resonant or localized power resources, while the present inventions preferred methodology is to utilize a localized power resource, and/or writing the information to its tag, so that it does not have to rely upon an index number associated with a travel ticket in such identification tag. The prior art has no means of activating, affixing, or attaching such identification tag to a person, object or alike, so that it cannot be removed, or it in the event of remove, invalidation can occur, and immediately be known to external sources.

The prior art does not provide or take into account a great many feature and functions as provided in the present invention, related to its bracelet or sticker device, nor the great many services that can be provided to passengers, and users of all types. The prior art equally utilizes a central data storage center, and does not offer or provide terminals, or portable hardware devices with all its attributes. Here to, the prior art does not address or facilitate elimination of bait and switch, piggybacking techniques, or a myriad of non-localized information gathering features to the present invention.

U.S. Pat. No. 6,222,452 B1 Ahlstrom et al. Apr. 24, 2001: patent and product utilizes an identification tag and inventive identification, with antenna, an adhesive, and utilizes an RF signal containing a unique factory pre-programmed code and signature which is utilized to identify an object or person, whom can be read by a scanner, and is able to process such pre-programmed identification code or number to an integrated (CPU) central processing computer unit 'solely used as a reference means' of identifying a profile and accompanying file related to an object, or person, however there are several distinguishable differences and limitations with the described products and systems configuration and design. These limitations and differentiations include:

1. the present invention does not require to print out visual information on the external tracking object, in their case a inventive identification, for any party seeking such information can retrieve such types of information without visual printing techniques,
2. the present invention does not utilize paper-like substrate, nor does the present invention need to print out on any type of printing medium, such as a standard printer as stated in the prior arts descriptions for any reason,
3. the present invention does not utilize an antenna coil, but rather utilizes another means, such as printing, and/or screening the required antenna,
4. the present invention does not require biometric inputs, for it is to obtrusive, degrading, and unnecessary, for one can achieve one in the same objectives without such use,
5. the present invention does not have to generate 'energy in the field' in order to provide enough energy to transmit the unique identification code to a scanner in order to receive such data, or in other words, the present invention does not have to send 'RF energy to illuminate' and send back such code to compare the identification tag, (thus, the prior art relies entirely upon an RF energy source in order to convert such RF signals energy that would allow the prior art to send back an identifiable signal and related signature with its factory programmed code) eliminating localized power resources, however the present invention can cost effectively produce power resources for pennies to its device(s), and more importantly, the limited power resources are utilized as an asset in the creation of a definitive period of time 'element' such that the present invention can control the initial drain upon activating the present inventions devices by attaching or placing the device highlighted in FIG. 1 and FIG. 9 of the present invention which would then start or engage such power resources to begin to drain, and when the power resources run out, say in 12 hours, 24 hours, or 48 hours, the device becomes invalidated.

This invalidation process from the power resources thus eliminates the probability of a device, for any reason not being read, and invalidated upon exiting an predetermined environment, or by a person/passenger simply wrapping aluminum foil around the identification tag of the prior art, or even the present invention, therefore, a secondary, and/or multiple redundant method of invalidation is required in order to truly achieve a secure environment. The prior art has no secondary or back up design built into its identification tag and inventive identification,
6. since the prior art does not utilize a localized power resource, it has a limited effective range realistically of a few 'inches to a maximum of one meter' (as highlighted in the prior arts text, in FIG. 6 paragraph 4 to the detailed description of a preferred embodiment), from a remote scanner, which is not a realistic range, or cost effective means for placement of a series of readers, and remote scanners, but rather the present invention with a localized, and very inexpensive power resource, can consistently maintain a read range around 25 ft to 30 ft., ensuring a cost effective distribution of the present inventions cost effective readers, antenna, and content delivery device that can easily be placed on the ceiling, (including high-ceilings and entrances of most airports throughout the world), and walls in a qualified area, providing 100% coverage and tracking capabilities, 7. the prior art cannot identify and/or eliminate 'bait and switch' tactics,
8. the prior art cannot identify and/or eliminate 'piggy-backing' tactics,
9. the prior art cannot identify and/or provide 'matching techniques',
10. the prior art cannot immediately provide to an authorized querying party, related data and information on a subject, such as a person or object, but rather can only come from a (CPU) system,
11. the prior art cannot randomly scan person(s), and/or objects with mobile hardware device(s) by mobile parties, such as security personnel, nor can the prior art immediately receive all types of data and information as highlighted in FIG. 4 of the present invention, without retrieval from a primary (CPU) source,
12. the prior art cannot scan a person and/or object and receive a date profile, including if necessary a current photo, immediately knowing where all other associated objects are located, how many there are, what they look like, where they are going, when they are going, if any belongings are missing, and alike,
13. the prior art does not know when a passenger and its carry-on baggage is separated, where this occurred, and a means of informing the passenger, as well as where the closest security personnel is, and sending such type(s) of data information to the fixed and/or mobile security, airport, airlines personnel's hardware device, providing all related information on the subject matter,
14. the prior art cannot provide, in their claimed examples, a ways, means, and method for the passenger to independently receive passenger information, without the need of interrupting an airport, or airlines personnel, or looking on traditional TV monitors, as highlighted in FIG. 5 and FIG. 7 of the present invention, conveniently located throughout an airport, or any other type of environment,
15. the prior art only utilizes a factory pre-programmed transponder chip with 48 to 64 bit, hexadecimal form memory array, with laser programming of the chip by laser fusing of polysilicon string contains a 9 bits header, 40 bits of data, 14 parity bits, and one stop bit, which can only provide a 'reference means' of utilizing the data bits to convey the unique passengers code number, which is then directly associated with a passengers identity and itinerary that is located on a (CPU) central processing computer unit. The prior art cannot write onto the transponder chip such information as the passengers data and information, or accompanying photo, so that when the identification tag is scanned or read by an authorized party(ies), all related information is immediately received and known about the passenger, and/or its baggage, and does not require a (CPU) to facilitate this process,
16. nor does the prior art utilize a read/write and/or read/write/re-write transponder chip so that the entire data file can be written to the transponder chip, or as and when the passenger, and/or its baggage moves around an environment, such as and airport, or aviation facility, such location sensing readers can read, and re-write at least one type of new information, such as updated tracking, monitoring, and information gathered onto the localized transponder chip and related device,
17. the prior art is unable to include a current photo identification of the passenger(s), and if necessary an associated checked-in, and carry-on baggage, including weight, and other dimensions to their electronic identification tag, and/or inventive identification, or (CPU),
18. the prior art is entirely reliant upon its (CPU) for providing related and reference based stored data and information that is associated with each factory programmed identification tags code. The first thing that a skilled terrorist would do is to have all primary, secondary, and emergency power resources shut down in and around an airport, aviation, military, building, or other controlled environment. In such an event, the prior art would quickly and efficiently be rendered useless, and not be able to ID, track, monitor, locate, authorize, or make known whom is whom, whether the user/passenger is indeed who they claim to be, where their bags are located, if it is indeed their bags that they are carrying, who is existing the system, who has not yet existed the system, how many people are still in the system, where they are located, and so much more. The basic questions that any 'intelligence agent' upon arriving to such a situation must immediately access and collect to provide to its superiors in order to grasp the magnitude of the current situation, to implement some type of damage control, would be impossible to achieve with the prior art. On the other hand, the present invention can facilitate and immediately provide such forms of information to any authorized party(ies) from FIG. 2, and FIG. 3 portable hardware devices, including an entire real-time back up of all passengers and baggage information that is currently in the system, where they are located, and/or about to come into the system/airport (airplane arrivals) and more on continuously updating triple redundant back up drives, and removable media,
19. the prior art does not utilize a sticker device as its means of electronic identification tag,
20. the prior art does not utilize information terminals, as with the present invention as described in FIG. 5, and FIG. 7,
21. the prior art does not utilize at least one type of portable hardware device, as with the present invention as described in FIG. 2, and FIG. 3,
22. the prior art does not utilize any type of baggage claim terminals, as with the present invention as described in FIG. 7,
23. the prior art does not have a means of invalidating their electronic identification tag and/or inventive identification,
24. the prior art has no means of activating their electronic identification tag and/or inventive identification, it is in effect always a passive tag in active mode, the present invention can only be activated upon the user attaching the connection points as utilized in FIG. 1 number 104, or in FIG. 9 by attaching the sticker to any type of surface, such as the back of a persons hand, or on a piece of baggage, only then does the present invention become activated,
25. the prior art has no means of invalidation, if in the event their electronic identification tag and/or inventive identification were to come or fall off of a passenger, and/or baggage, 26. the prior art has no means of immediate notification, if in the event their electronic identification tag and/or inventive identification were to come or fall off of a passenger, and/or baggage, unless it sits at a specific location for a long period of time from a (CPU) software program,
27. the prior art has no means of confirmation to the passenger or user that its baggage was opened during the checked-in process when the passenger picks up the baggage at the baggage claim carousel area, the present invention can inform the passenger of such an event occurring while its bags were not in their possession. This can be a life saving feature and event, if the passenger is traveling to certain countries of the world where trafficking drugs is an offence by death, whether you put it there or not, the burden of proof is on you, not like in America where you are innocent until proven guilty,
28. the prior art has no means of knowing who opened the baggage, when, or where the baggage was opened, the present invention has this ability,
29. the prior art only utilizes a factory programmed 'unique code', and is unable to write passenger information directly onto the electronic identification tag, whereas the present invention can,
30. the prior art does not utilize any type of algorithm or series of algorithms, digital or non-digital, encryption processes—cryptic or de-cryptic in nature, compressed or de-compressed, analog, digital, modulated or de-modulated, whereas the present invention does,
31. the prior art does not utilize any type of equipment that might also utilize an integrated peer-to-peer methodology to update more than one wired and/or wireless, local and/or remote content storage and delivery system(s), as highlighted in FIG. 6 to the present invention, an embedded or non-embedded modulator/demodulator, multiplexer/demultiplexer, digital encoder/decoder, cryptic/non-cryptic means, data packet based software means, and/or compression/decompression system.
32. the present invention can be configured to utilize such techniques to update at least one type of content delivery devices (CDD's) in FIG. 6 that are disbursed in a respective environment, such that if a querying party seeks such types of data and information, that is typically stored at a single (CPU) or CMS location, such types of queried data and information can be sourced, and presented to the querying party much quicker and more efficiently from a localized CDD that is a short distance away from the querying party (in cases of portable hardware devices), or the actual querying hardware device (in cases of fixed terminals), rather than a single source (CPU) system, where heavy traffic congestion, data inputs and outputs, will generate massive bottlenecks, and last-mile network problems will commonly occur.
33. the present invention can even be designed and configured to update at least one type of remote device, such as a fixed terminal, or portable hardware device to its internal, external, and/or removable memory storage area.
34. the prior art is not able to provide any type of enhancements to any type of building security system, whereby objects are tagged and if moved from its current location, moved out of a respective room, moved out of a respective building, or alike the building security system can trigger an alarm system, can inform a CMS (central monitoring station), or at least one party or system of such incidence is occurring, by wired and/or wireless means, systems, and/or networks as well as creating and logging in such an event under a time, audit, and attendance systems software, or sending such notification to the owner, in the form of a phone call, or cellular phone call,
35. the prior art only utilizes a 'stored means' for storing the signature received by the detector of an electronic identification tag that provides a unique signature when illuminated by RF energy,
36. the prior art can't provide such identification information on its own, and can only provide such identification information as a unique signature or commonly referred to as code that is utilized as a reference to the actual data located on some remote (CPU), and not as the actual data profile information of the passenger, and/or baggage, of unique data and information, matching information, that may also include a photo of such,
37. the prior art requires a particular tag to 'move into the established cone of energy area', only then is the tag illuminated and may be identified by its unique signature. The present invention does not have such a requirement or limitation, but rather can read at least one type of bracelet, sticker, or alike at all times and anywhere in the airport environment,
38. the prior art does not enable pick up parties, and/or drop off parties to communicate with the passenger(s) while they are within the airport environment. The present invention allows such communications to be conveniently facilitated throughout an airport, or other type of environment, including at least one type of secured methodology, as provided in FIG. 7 to the present invention,
39. the prior art can only utilize its electronic identification tag and/or inventive identification as an index number that is associated with a data file that is attached to a particular passenger that is stored somewhere at a remote location,
40. the prior art only seeks to locate a particular baggage if in the event the passenger exists an airport environment, whereas the present invention knows in real-time if and when such separation of baggage and passenger occurs, where it occurs, providing automatic notification to the passenger directly by localized audible notification, as well as to other parties, such as the closest security personnel, airport personnel, airlines personnel, or other personnel to that particular location, including exit areas, boarding gates, and alike,
41. the prior art does not provide, like the present invention, at least one type of portable hardware device(s) FIG. 2 and FIG. 3 which can be utilized by at least one party, such as an airport security personnel, or airlines personnel to randomly walk around an airport checking the identities of passengers, and baggage, airport personnel, airlines personnel, including airport tenants—such as a Starbucks store, or bookstore, and its personnel, including materials and supplies being brought into such secured environment. A security personnel will know with a quick scan from its portable hardware device, a host of data and information, such as the entire profile of the worker, what the hours are to be for any worker that is working within the airport and/or aviation environment to know whether they still belong there or not, if a scheduled inventory delivery is scheduled for that day and time, and alike,
42. the prior art did not address or take into account, unlike the present invention, the great many retail shops, including (DFS) duty free shops, that are located inside of an airport facility, whereby these working personnel, merchandise, and alike must also be tagged, tracked, monitoring, authorized, and alike, 43. the prior art, unlike the present invention, does not provide (ETA) estimated time of arrival, or even (ETD) estimated time of departure information to passengers from at least one type of terminal as described in FIG. 5, and FIG. 7 of the present invention,
44. the prior art does not provide, unlike the present invention, such types of information terminals, where users simply walk up, and have their identify verified by wireless reading techniques from their bracelet FIG. 1, or sticker FIG. 9 of the present invention, to the coupled reader and information terminal hardware device, to provide a plurality of services and information to the user/passenger, including providing an accurate and up to date (ETA) for the passengers baggage to the identified baggage claim carousel, conveniently booking anything from a rental car, taxi, bus, hotel, and other services,
45. the prior art does not provide, unlike the present invention, that already knows which language to present at least one type of visual and/or audible information to each specific user, passenger, and/or user,
46. the prior art is not able to, unlike the present invention, to inform the passenger who is waiting at the baggage claim carousel 'exactly how much longer (time element) their baggage is indeed coming out of the baggage claim carousels conveyor belt', whereby such information can be provided by audible and/or visual means, whereby a reader scans the present inventions sticker in FIG. 9, or other device that is coupled to a specific checked-in baggage, reads, and calls out the persons name by audible means to at least one type of speaker or PA system, and/or alternatively the persons name will show up on at least one type of screen or light board currently on top of the baggage claim carousel, or any other means of achieving one in the same objectives. Anyone who has traveled a lot, hates to wait for its baggage to come out at the baggage claim carousel, and would like to at least know how many more minutes until the baggage starts to come out, so they can have peace of mind, and go to the bathroom, to the car rental area, make a phone call, change money, and alike,
47. the prior art is not able to provide message boards capabilities, unlike the present invention as highlighted in FIG. 5 and FIG. 7 of the present invention,
48. the prior art is not able to provide audible and/or visual information to a passenger, or other persons, such as upon exiting the airport, 'thank the passenger, by name, for utilizing the airport, have a nice day, and please come again', unlike the present invention, U.S. Pat. No. 6,119,096 Mann et al. Sep. 12, 2000: patent and product is principally a biometric system utilizing iris common scanning and recognition techniques that is tied to primary fixed position access control locations, such as check-in boarding system, boarding gate area, and baggage reconciliation areas. Even utilization of an optical turnstile to its system at these access control points, the system might be able to control passengers at primary access control points, however is unable to provide a host of person, baggage, or object tracking, monitoring, authentication, activation, invalidation, all types of information services to passengers, pick up parties, and more that the present invention describes hereto.

U.S. Pat. No. 5,914,671 Tuttle Jun. 22, 1999: patent and product does not offer, provide, or is capable of a plurality of functions, and features to its product design, system design, its portable wireless transponder device, hardware devices, information services to passengers, airport, airlines, or tenants personnel, including pick up parties, and a host of other attributes as reflected in the present invention.

U.S. Pat. No. 6,127,917 Tuttle Oct. 3, 2000: patent and product please see U.S. Pat. No. 5,914,671 Tuttle Jun. 22, 1999 aforementioned above.

U.S. Pat. No. 5,793,639 Yamazaki Aug. 11, 1998: patent and product is principally a baggage receiving and handling system that can match and tie associated passenger information by and between a passenger and its baggage that is principally utilized at the check-in counter, as well as the baggage claim carousel reconciliation area. The principle difference between the prior arts methodology for tracking and processing checked-in baggage is based on the utilization of a host or central computer that stores such results that is retrieved from airport, and/or airlines personnel at fixed terminal locations. The only mention of a portable means of identification is utilization of a recording medium such as IC card, the reading means reads the information stored in the recoding medium to input the information of the passenger. Then comparing means accordingly makes a comparison between the information read by the reading means and boarding information stored in the reservation information memory means. A great many of the features and functions as provided in the present invention is not provided in the prior art.

U.S. Pat. No. 6,108,636 Yap et al. Aug. 22, 2000: patent and product is principally a luggage handling and reconciliation system that has an integrated biometric data input device. The luggage identification features are utilized to reconcile luggage at an arrival airport utilizing biometrics for identification of the person, or proper owner of the baggage. The prior art can match passenger to checked-in baggage and baggage to passenger, however such information cannot easily be acquired unobtrusively and throughout an airport and airline environment, not can be activated, invalidated, or secured to the person, or object. Moreover, card based devices were utilized in the 9/11 incident, and can easily be given, taken, or utilized by another person, despite these cards being tied to a central database system. Moreover, the prior art is unable to provide a host of functions, features, monitoring of passengers, carry-on baggage, bait-and-switch tactics, piggybacking tactics, and a host of security, tracking, unique features described to the bracelet and/or sticker apparatus, passenger information services, and pick up party services to name a few.

SUMMARY OF THE INVENTION

The invention relates to improved methods and forms for automatically and non-unobtrusively to detect, without human interpretation, the identification of people(s), object(s), and other, with various methodologies utilized in relation to creating, storing, adding, connecting, modifying, sharing, inputting, recalling, authorizing, approving, tracking, generating, formatting, monitoring, activating, invalidating, accessing, locating, deleting, controlling, linking, collecting all types of data and information, and generating at least one type of identifiable communications information related to anyone or anything, and in and/or around any type of environment, such as an airport(s), airline(s), and/or other aviation location(s), theme park, amusement park, aquarium, cruise ships, tourist location, hospitals, buildings, government complex, malls, customs boards, sports events, parking, manufacturing, hotels, resorts, clubs, retail, elevators, utilities, jewelry stores, museums, libraries, as well as other types of location(s), among other environments.

BRIEF DESCRIPTION OF THE DRAWINGS

For a better understanding of the present invention and to show more clearly how it may be carried into effect, reference will now be made, by way of preferred example, to the accompanying drawings which show the preferred embodiment of the present invention and in which:

FIG. 10 is a block diagram consisting of a preferred methodology for use in a jewelry shop, or other environment illustrating at least one configurable design functioning in such an environment, and.

REFERENCE NUMERALS IN DRAWINGS

| | | | |
|---|---|---|---|
| 101 | airline ticket device(s) 101, 102, 103 | | |
| 104 | sealing, engaging, disengaging mechanism | | |
| 105 | visual validation capabilities | 106 | conductive material |
| 107 | microchip and/or microprocessor | 108 | antenna |
| 109 | power resources | | |
| 110, 111, 112, 113 | visual identification, information, advertising, logos, etc . . . | | |
| 201 | gate terminal device(s) | 202 | photo(s) |
| 203 | name(s) | 204 | Airline(s) |
| 205 | flight Number(s) and arrival destination city(ies) | 206 | departure Gate(s) |
| 207 | departure time(s) | 208 | externally tied |
| 209 | carry-on baggage(s) | 210 | clicking on the baggage icon |
| 211 | number of checked luggage | 212 | clicking on the luggage icon |
| 213 | multiple modes | 214 | visual information |
| 215 | quick links icons and text information | | |
| 216 | microphone | 217 | removable media |
| 218 | speaker | 219 | LED |
| 220 | gel pad | 221 | headphone |
| 222 | biometric scan | 223 | ON/OFF button |
| 300 | portable hardware device(s) | 301 | reader |
| 302 | antenna | 303 | microphone |
| 304 | headphone | 305 | (operation status) |
| 306 | photo | 307 | name |
| 308 | checked-in luggage | 309 | physical button(s) |
| 310 | ON/OFF button | 311 | speaker |
| 312 | stand apparatus | 313 | bottom portion of the device |
| 314 | media | 315 | baggage |
| 316 | departure time | 317 | departure gate |
| 318 | flight number | 319 | airline |
| 320 | time | 321 | biometric techniques |
| 322 | LED | | |

-continued

Figure 9:
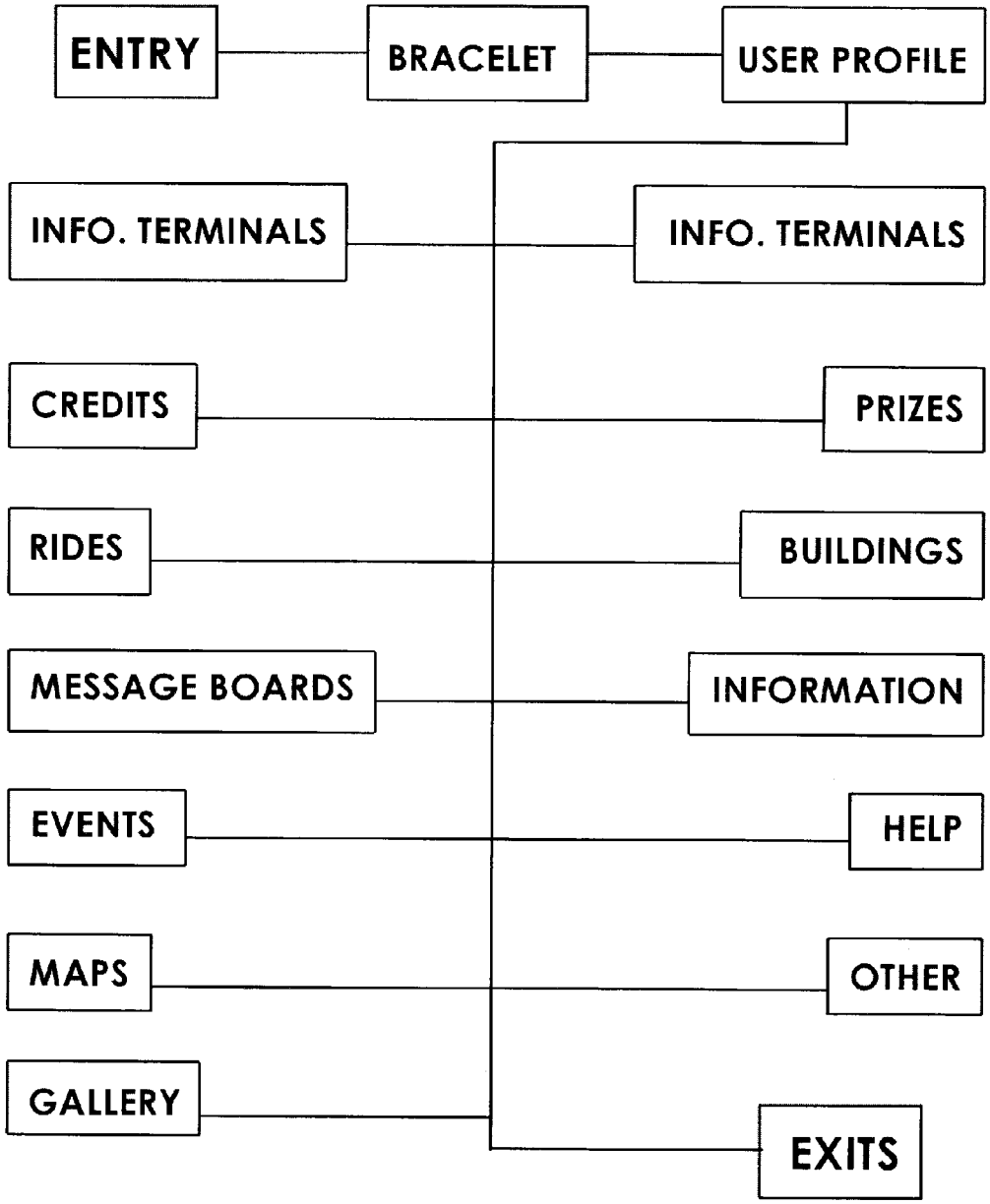
FIG. 9 is a block diagram consisting of a preferred methodology for a theme park, or amusement park, a tourist location, or other environment illustrating at least one configurable design functioning in such an environment.

| REFERENCE NUMERALS IN DRAWINGS | | | |
|---|---|---|---|
| 401 | handheld device(s) | 402a | antenna |
| 402b | reader | 403 | microphone |
| 404 | headphone | 405 | multiple modes |
| 406 | photo | 407 | name |
| 408 | checked luggage | 409 | navigation, category, sub-category button(s) |
| 410 | ON/OFF button | 411 | speaker |
| 412 | necklace | 413 | removable unit |
| 414 | removable media | 415 | carry-on baggage |
| 416 | departure time | 417 | departure gate |
| 418 | flight number | 419 | airline |
| 420 | time | 421 | biometric |
| 421 | LED or visual verification | | |
| 501 | terminal device(s) | 502 | removable media |
| 503 | visual verification | 504 | date / time |
| 505 | pick up information | 506 | checked luggage |
| 507 | microphone | 508 | airport |
| 509 | speakers | 510 | advertising area(s) |
| 511 | gel pad(s) | 512 | transportation services |
| 601 | communications/reader device(s) | 602 | wired |
| 603 | variable settings | 604 | settings |
| 605 | wireless | 606 | power resources |
| 701 | parking terminal device(s) | 702 | removable media |
| 703 | visual verification | 704 | date / time |
| 705 | luggage | 706 | flight and arrival information (ETA) |
| 707 | airport | 708 | speakers |
| 709 | advertising area(s) | 710 | gel pad(s) |
| 711 | vehicle is located | 712 | message center |
| 801 | adhesive based object | 802 | visual identification (a) |
| 803 | visual identification (b) | 804 | advertising area |
| 805 | visual verification techniques | 806 | conductive material |
| 807 | grid based conductive material | | |
| 808 | sensor, micro-sensor, or other types of sensing capabilities | | |
| 809 | power resources | 810 | pressure sensitive seal |
| 811 | microchip and/or microprocessor | 812 | antenna |
| FIG. 9 | line chart schematic | | |
| 1001 | hardware device | 1002 | safe |
| 1003 | showcase | 1004 | reader |
| 1005 | antenna | 1006 | merchandise |
| 1007 | bracelet worker wears | | |
| 1101 | primary alarm systems control panel | 1102 | reader |
| 1103 | object | 1104 | CMS |
| 1105 | external communications | 1106 | antenna |

DETAILED DESCRIPTION OF THE INVENTION

Many of the specific details of certain embodiments of the invention are set forth in the following description and in the accompanying illustrations to provide a thorough understanding of such embodiments. One skilled in the art will understand, however, that the present invention may be practiced without several of the details described in the following description. Moreover, in the description that follows, it is understood that the figures related to the various embodiments are not to be interpreted as conveying any specific or relative physical dimensions, and that specific or relative physical dimensions, if stated, are not to be considered limiting unless the claims expressly state otherwise. Further, illustrations of the various embodiments when presented by way of illustrative examples are intended only to further illustrate certain details of the various embodiments, and shall not be interpreted as limiting the scope of the invention or field in which this patent can be applied to.

Figures 1A, 1B, 1C:
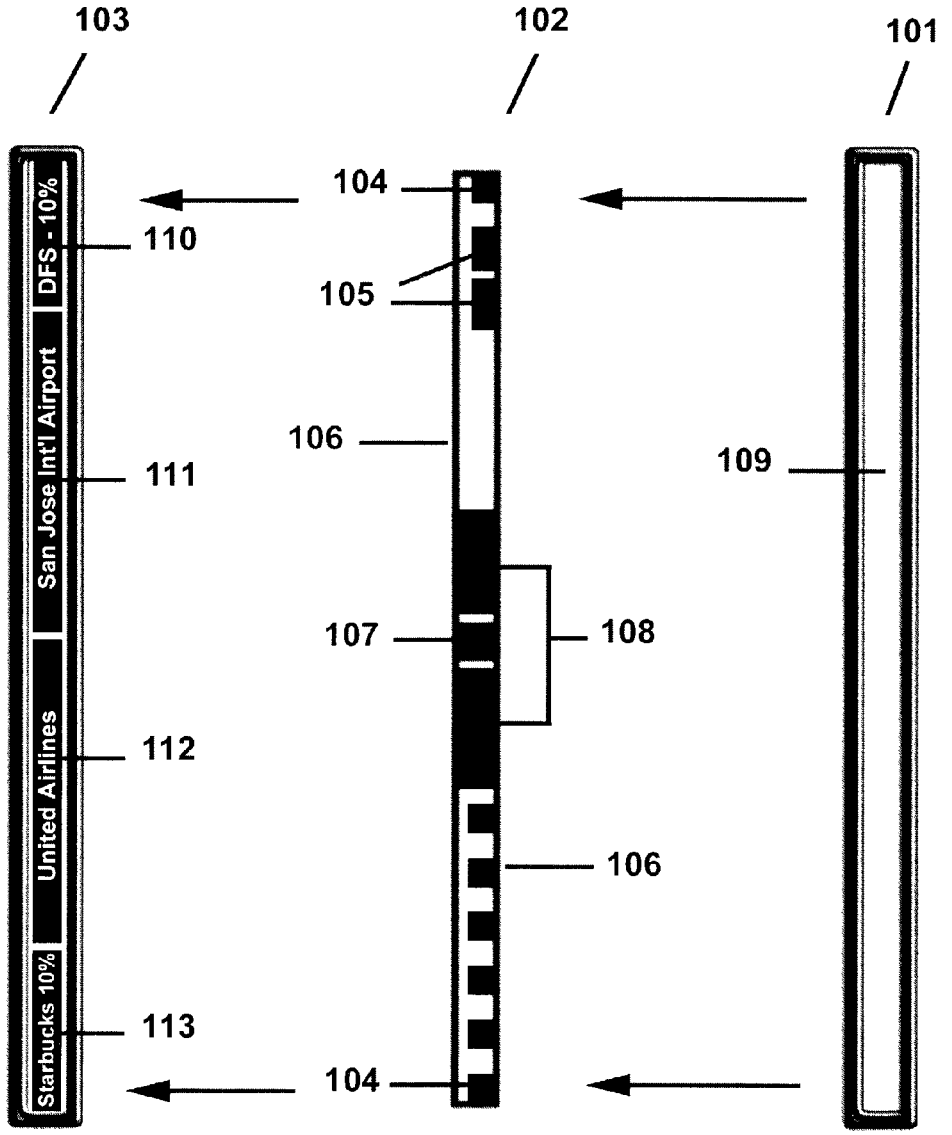
FIG. 1 is a general diagram showing a preferred new type of device, that could be utilized as any type of receipt, ticket, bracelet, or other, and in particular an airline ticket device(s), (or other device providing function and features similar in nature could look like), and its interaction with its environment, such as an airport, airplane, aviation environment, theme park, amusement park, and other environments listed hereto for achieving various types of objective(s)

FIG. 1 is a general diagram showing, (a preferred method), that could be utilized as at least one type of airline ticket, device(s) 101, 102, 103, (or other device providing similar in nature, and function, features could look like), such as a bracelet or other possible physical designs; such as a necklace, ring, band, clip-on, badge, sticker, clasp, receipt, ticket, card, or other, and its interaction with its environment in and around an airport, airplane, aviation environment, as well as any other type of environment that could be modified and designed for achieving at least a portion of these similar objective(s) whether in whole and/or in part.

At least one type of device(s) 101, 102, 103, is comprised of several items that can be substituted, modified, re-arranged, re-configured, and/or re-designed for providing, and/or achieving variations with similar results. Section (layer) 1 (C), purpose is to provide and show a preferred method for arranging the back portion of the device(s) 101, 102, 103—combined at one. The preferred material being flexible variations of plastics as its base, with a power resources 109 applied, attached, adhered to, and/or facsimile thereof. The device(s) 101, 102, 103 can include a power source, and/or can be designed without any power source (whether internal, external, and/or other variations). Section (layer) 2 (B), purpose of to provide a means and/or method for sealing, engaging, disengaging mechanism 104, engaging, activating, and/or like kind by closing the airline ticket device around a travelers wrist, (the preferred method), with flexible variations in length to accommodate all types of travelers sized wrists.

Figure 5:
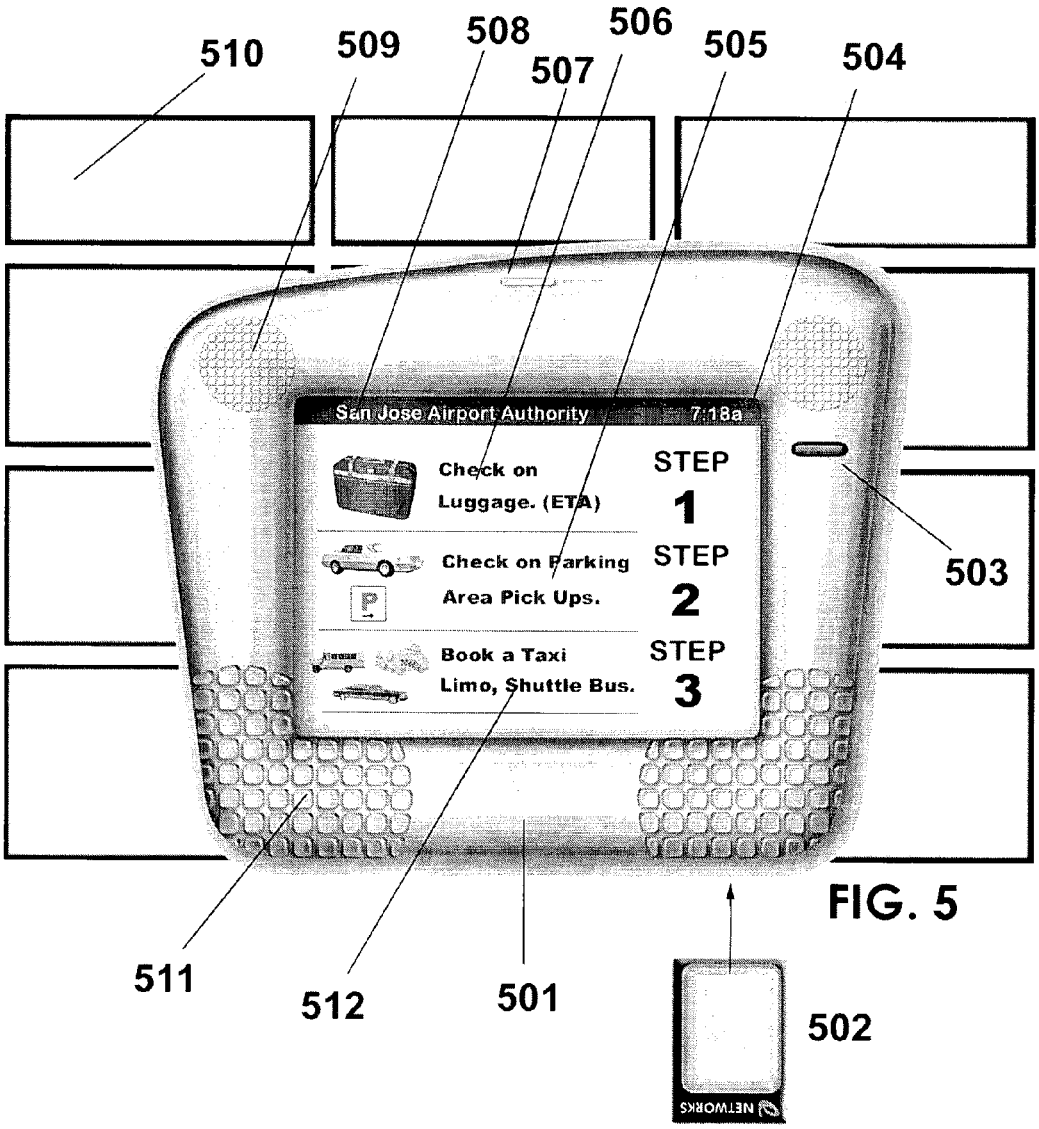
FIG. 5 is a general diagram showing a preferred type of terminal hardware device(s) and its preferred interaction within one particular environment, such as in and around an airport check-in counter, gate, screening area, airport, airplane, aviation environment, and/or any other environment for achieving its objective(s)
Figure 7:
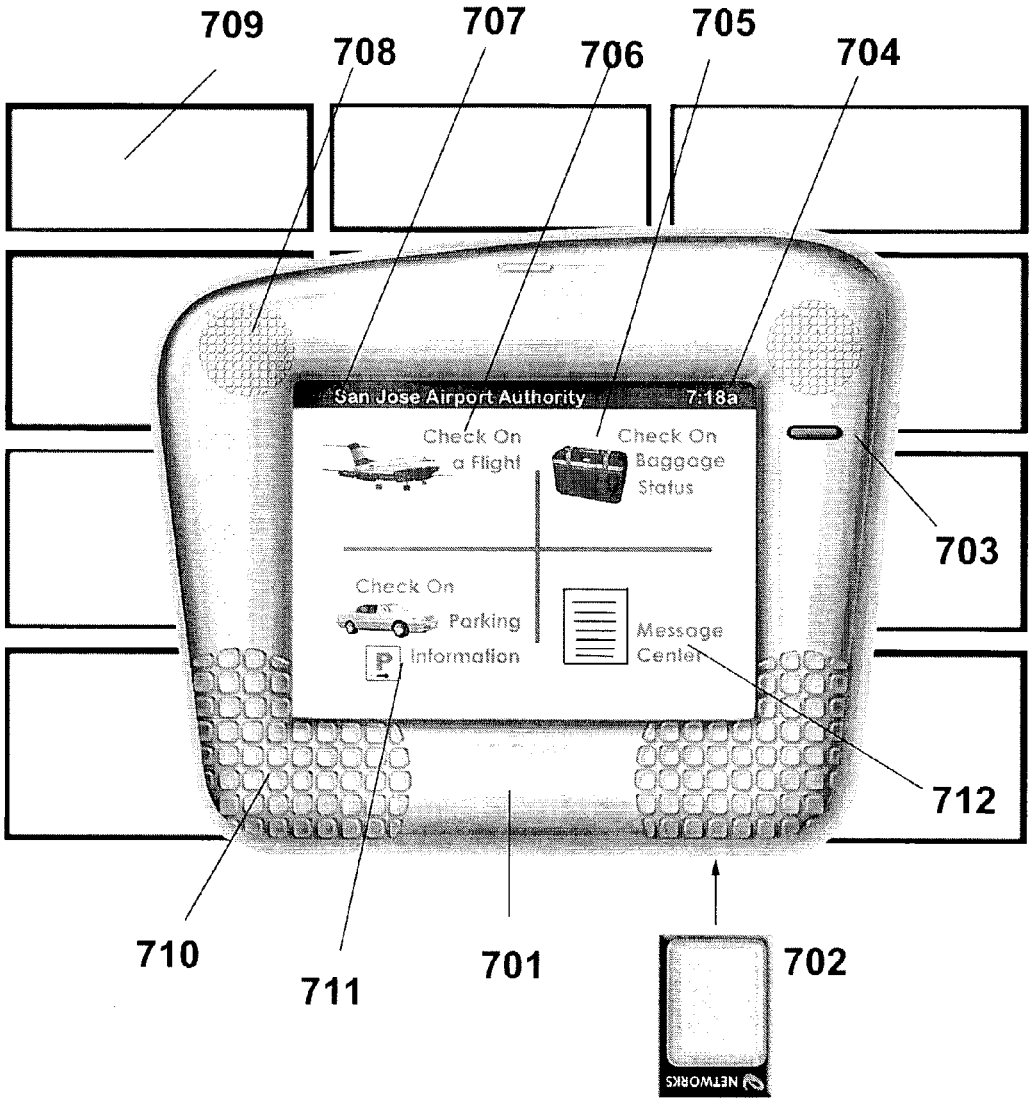
FIG. 7 is a general diagram showing a preferred type of terminal hardware device(s) and its preferred interaction with its environment in and around an airport, a parking garage, area(s), and/or lot(s), such as an airplane, airport, and/or aviation environment for achieving its objective(s)
Figure 8A:
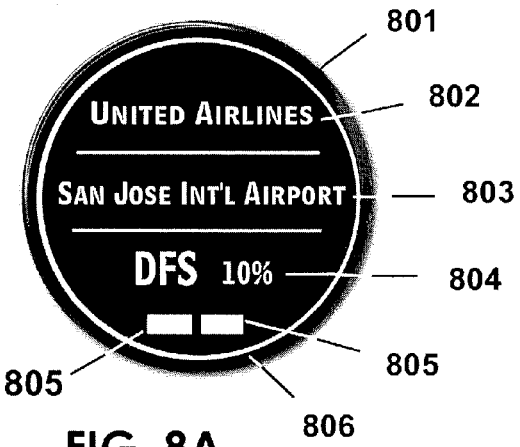
FIG. 8 is a general diagram showing a preferred sticker type of device, or object recognition, tracking, and monitoring style of device (or other device providing similar in nature, function, and features), and its interaction with its environment such as in and around an airport, airplane, and aviation environment, or other environments listed hereto or not for achieving various types of objective(s)
Figure 8B:
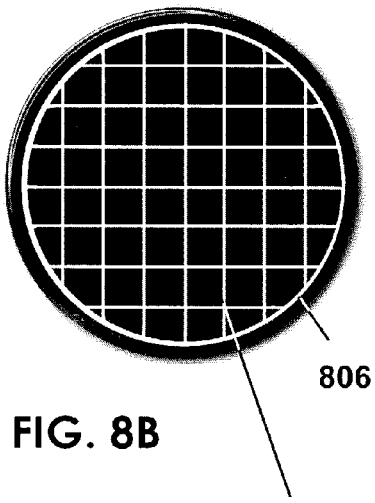
Figure 8C:
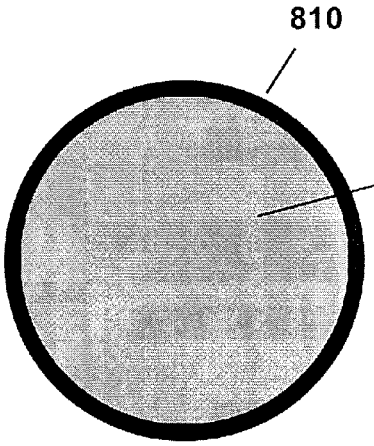
Figure 8D:
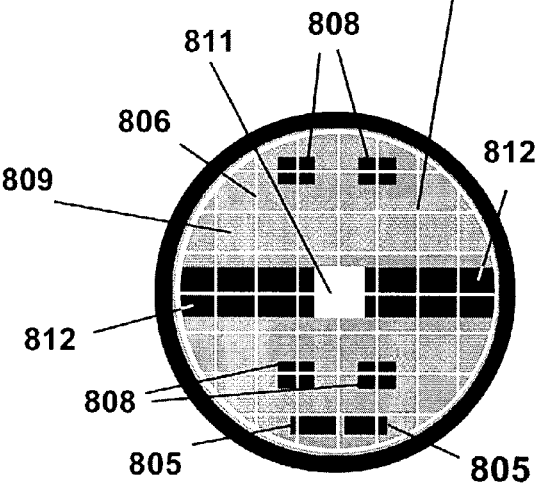

At least one type of device(s) 101, 102, 103 can include a red area, and green area visual validation capabilities 105, (the preferred method), for facilitating visual confirmation(s) to multiple events, tasks, and confirmations that can be applied to the device(s) 101, 102, 103 in unlimited situations, and environments, including but not limited to confirmation that the device(s) 101, 102, 103 is;

A) working or functioning properly, or accurate and proper data and information has been properly linked, added, completed, filed, and processed related to any particular person, luggage, or object, B) whether the passenger has gone through any security check points, C) whether the passenger has their own carry on baggage with them (or another travelers bag(s)), D) whether the passenger in the right Terminal at an airport, E) whether a passenger has been properly checked in at an airport, F) whether a passenger has the right checked-in luggage when leaving a baggage claim area, G) allows the passenger to check all types of information from terminals FIG. 5, and FIG. 7 in and around an airport, and/or airplane, including but not limited to;—

(i) estimated time for departure for their flight, (ii) estimated departure for delayed flights, (iii) which baggage claim carousel to get their checked in luggage from, including accessibility to authorized travelers, and/or inaccessibility to all non-travelers of that particular flight, or travelers who did not have any checked-in luggage to be collected at the destination of a particular flight, (iv) what is the estimated time of arrival for their baggage to arrive at the carousel, (v) check to see if the party picking them up has arrived at the parking area yet if so, providing parking floor, parking spot number, and map how to get there, in some cases providing the location of the pick up party if not waiting at the vehicle (such as an meet and greet area, retail establishment in and around the parking area), (vi) ordering a taxi, limousine, shuttle bus, and/or all other types of ground transportation, (vii) providing all types of value added services, and message center services, including voice, data, and other information services that can be sent out by the traveler(s) to other parties inside, and/or outside of the airport area.

At least one type of device(s) 101, 102, 103, can include a (preferred method is for power resources 109 being available), conductive material 106 that performs to create a complete cycle to; A) tie all other elements of the device(s) 101, 102, 103 together with (4, 5, 6, 7, 8, & 9) whereby if the traveler/passenger takes of the device(s) 101, 102, 103, prior to the conclusion of their travels, and exiting an airport at their final destination, then taking off the device(s) 101, 102, 103, the device(s) 101, 102, 103 can be designed to no longer function, provide invalidation signal, malfunctioning notification, inoperable status, and more, providing an activation means, and security means.

At least one type of power resources 109 can be utilized in addition to providing basic power requirements to the device(s) 101, 102, 103, to provide activation capabilities, whereas such power resources will not start to be drained or utilized until the device(s) 101, 102, 103 is activated. The preferred activation methodology to the preferred embodiment is upon activation points 104 are attached to each other by at least one means, such as a snap-on, adhesive, or other.

At least one type of power resources 109 can be utilized as a means to invalidate the device. The preferred activation methodology to the preferred embodiment of this invention is that the power resources have a limited 'time element', such as 12 hours, 24, hours, 48 hours, or alike. When power resources 109 run out, the device invalidates itself. This is particularly useful if a user wishes to exit a controlled environment with the device, and without invalidation by typical readers and antenna established at any and all exit points, by wrapping the device(s) 101, 102, 103 in aluminum foil. Whereby a user could prevent the device(s) 101, 102, 103 from being invalidated at an exit point, however, the device(s) 101, 102, 103 would be invalidated in a very short period of time after the user were to exist the system, as a back up to the primary, and database software system that normally detects such user when or if the device(s) 101, 102, 103 attempts to re-enter the system.

At least one type of device(s) 101, 102, 103 can be designed and configured to become invalidated upon the user removing such device(s) 101, 102, 103 from its wrist, person, object, or alike. The preferred invalidation methodology to the preferred embodiment is the closed ended loop of conductive material 106 is broken upon its removal from its primary contact point(s) 104, thus breaking the thin and fragile conductive material 106, thus invalidating the device.

Non-functioning device(s) 101, 102, 103 can be designed to trigger other parts of the system that identifies these persons, or objects at throughout an airport, or other environment including but not limited to;— (i) check in counters, (ii) security check points, (iii) gate locations, (vi) baggage claim area, and (v) any other location of an airport, and/or airline. In the case where no power is utilized in the design of the device(s) 101, 102, 103 the microchip and/or microprocessor 107 and antenna 108 can be designed to acknowledge such an event, and begin providing an invalid identification code that will be picked up through various types of scanning, reading, and/or recognition techniques. At least one type of CCTV, camera, or other recording mechanism can be directed by an integrated software management system to the invalidation location and start recording the specific area.

At least one type of device(s) 101, 102, 103 has a microchip and/or microprocessor 107 and antenna 108 to facilitate a multitude of functions, including (but not limited to) storing of a predetermined code, algorithm, or like kind that provides a unique identifiable reference for that particular and unique device(s) 101, 102, 103 from any other. The antenna 8 is utilized to enhance the distance in which the microchips predetermined code can be read. At least one type of microchip and/or microprocessor 107 and antenna 108 is utilized to identify a unique passenger, traveler, airport personnel, airlines personnel, and/or any other party in and/or around an airport, airplane by referencing such detailed information from a local and/or remote database, such as within and around an airport, or airplane environment.

At least one type of device(s) 101, 102, 103 can provide areas for visual identification 110, 111, 112, 113 (such as airport of departure, airlines traveling on, and even retail shop discounts and advertising applications) to help assist airports to generate additional income to pay for operational costs. Visual identification can be printed, screened, and/or put onto the device 101, 102, 103, in any other method, and/or combination of methods. If a preferred method is to be identified, screened, and/or reverse screened to the top piece of material 103 (A) will be facilitated prior to laminating, heating, compressing, and/or all other methods of completing the device(s) 101, 102, 103, as a functioning unit.

The device(s) 101, 102, 103, can alternatively be configured where the unique information stored on the microchip and/or microprocessor 107 and antenna 108 can be passenger information, including but not limited to YY/MM/DD/TT/Passenger name and other passenger information/Airport name/Airlines flying on/gate/seat information/departure and arrival times/number of checked-in luggage/number of carry on luggage/weight and other information/Airport destination/any stop over information/and much more. With this type of alternative method, reading or scanning device(s), such as handheld units, portable or fixed terminal devices, counter units, and all other types of hardware device(s) are able to immediately receive (passenger) information from the device(s) 101, 102, 103, itself, without the need for accessing, and/or sending, and/or receiving such information from a local and/or remote database location(s) that may be wired, and/or wireless based systems.

At least one type of device(s) 101, 102, 103, can alternatively be configured where unique passenger information can be added, and stored on the microchip and/or microprocessor 107 and antenna 108 itself, as and when a passenger, person, luggage, baggage, object of any type moves around an airport environment, airplane, and aviation areas unique data and information can be read, scanned, collected, retrieved, updated, by at least one type of external means.

Whereby such a designs basic information can be added to the microchip and/or microprocessor 107 and antenna 108 upon the passenger checking in at an airlines check in counter, an automated checked location(s), curb-side check in, gate check-in, or any other form of check in method(s) are utilized, whether human or machine interaction with passenger is required, or added and updated wherever the person, or object moves around and interacts with various types of reading, sensing, scanning devices, including read/write/rewrite techniques. At least one type of device can be constructed and construed other than an airline ticket device and can take the form, or shape, of any type of physical object. In cases of airline personnel, airport personnel, and security personnel, variations in design, functionality, shape, style, material, object orientation, and more can be individualized, personalized, and can even operate on different, and/or various types of frequencies, and/or frequency spectrums.

In such a case, a passenger, person, luggage, baggage, or object could start with at least one type of basic information on its device(s) 101, 102, 103, (including but not limited to) YY/MM/DD/TT/Passenger name and other passenger information/Airport name/Airlines flying on/gate/seat information/departure and arrival times/number of checked-in luggage/number of carry on luggage/weight and other information/Airport destination/any stop over information/and much more.

As and when at least one person, such as a passenger(s) travels throughout an airport, airplane, and aviation area(s), or other environments, additional information can be added, such as zone locations, location sensing, security check points, and other types of location sensing techniques that enables entered by the passenger(s).

With this methodology, reader, scanner, or sensing device(s), separate, and/or built into any type of handheld unit, portable terminal unit, terminal unit, fixed position unit, counter unit, and all other types of hardware device(s) are able to immediately receive, retrieve, collect, inquire, query, update (passenger) information from at least one type of device(s) 101, 102, 103, without the need for accessing, and/or sending, and/or receiving such information from a local and/or remote database location(s) that may be wired, and/or wireless based systems that operate on at least one type of frequency, and/or spectrum. This type of configuration also enables all types of communications device(s) such as FIG. 6 to keep track of passenger movements, and know where each and every passenger, checked-in luggage, and carry-on baggage is within and around an airport, airplane, and aviation area(s), and other environments.

At least one type of device(s) 101, 102, 103, can be utilized as a primary and/or secondary method and/or means of tracking and/or monitoring any person, passenger, checked luggage, carry-on baggage, and other objects within and around an airport, airplane, and aviation area(s), or any type of environment, and can link, attach, accompany, recall, retrieve, update, keep track, and more all types of data and information about the above stated objects, and persons. A multitude of technologies can be utilized to enhance the identification of any unique item, object, or person(s) as provided above.

Whereby such technologies can be utilized to affix any type of detection method(s) onto each checked-in luggage(s), and carry-on baggage(s) that identifies it from another item, and for external scanning, reading, detecting and related technologies to identify each separate item, thus knowing where each and every item is located at any given point in time, and further linking, adding, combining, adjusting, modifying, changing, updating, and/or alike all types of data and information back to from, or through one object or person, to at least one other object or person. In such as case, once at least one person, object, or party is identified by such a system, all other known persons, objects, and parties can quickly be identified, can current their locations, what they look like, where they are coming from, or going to, any other persons, objects, and parties with similar travel arrangements, nationalities, or other forms of assessing such information databases.

At least one type of device(s) 101, 102, 103 could be configured to allow at least one person, object, passenger(s) to send, receive, and/or interact with such devices as FIG. 5, and FIG. 7. By at least one person, object, or passenger simply being close in proximity to these types of terminals, devices, and other types of hardware devices and sensing devices, at least one person, object, or passenger can be identified, whereby unlimited types of data and information can be provided either automatically, or manually, by password combinations, cryptic techniques, algorithms, protocols, methodologies, and/or by manual selection process (including but not limited to touch screen, voice, inserting any and all types of devices that can be scanned, and/or read), or by biometric techniques, or by sensing, scanning, screening, reading techniques, that achieves any of these goals and/or objectives, and in any function, format, configuration, or process.

At least one type of device(s) 101, 102, 103, can be utilized as a reference means of identifying at least one type of data file from at least one other location. At least one type of device(s) 101, 102, 103, can be utilized whereby the entire data file on a person, object, or other is maintained, and updated from/to/within the airline ticket devices microchip(s) and/or microprocessor(s), so any such remote sensing, reading, or scanning devices automatically receive the entire data file upon execution of querying and receiving such data file information. This is achieved by use of read/write only, or read/write, re-write microchips and/or microprocessor(s).

The above is intended, along with the drawings, to illustrate the preferred embodiment of the invention within the airport, airlines, and aviation environment. Those skilled in the art will be able to devise numerous arrangements which, although not explicitly shown or described herein, embody the principles of the invention and are within their spirit and scope as defined by the above claims.

Figure 2:
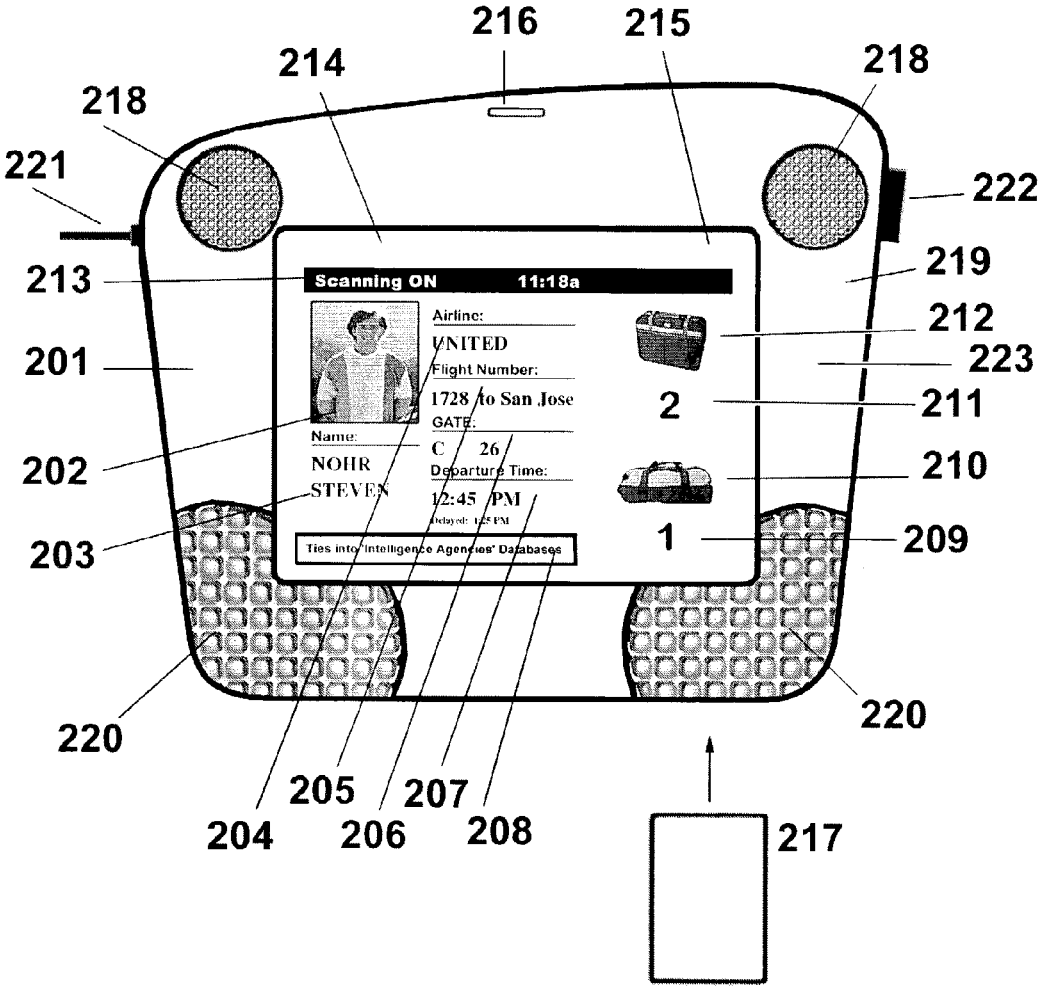
FIG. 2 is a general diagram showing a preferred new type of terminal hardware device(s) and its preferred interaction within one particular environment, such as an airport, check-in counter, electronic ticket automated check-in counter, gate, screening area, airport, airplane, aviation environment, and/or any other environment for achieving its objective(s)

FIG. 2 is a general diagram showing at least one type of terminal hardware device(s) 201, such as gate areas, that can be configured to operate on all type(s), style(s), and formats of software, firmware, middleware, and architecture automatically, or manually, detecting, or only by directing such a terminal hardware device(s) 201 to a specific passenger(s), or traveler(s), airline ticket device(s) FIG. 1, checked-in luggage, carry on baggage, and/or other items within an airport, and/or airplane environment at the time of boarding an airplane. Airline personnel would preferably utilize these terminal device(s) in screening passengers during check-in and boarding of an airplane.

A preferred method of use in the airline industry is for such persons', such as passengers, to be close in proximity to said one at a time. Upon the passenger(s) coming close in proximity to the terminal hardware device(s) 201, it will read the passenger(s) airline ticket device(s) FIG. 1, providing corresponding information to that particular person on the screen area of the device (204, 205, 206, 207, 208, 209, 210,211, 212,213). At least one type of terminal hardware device(s) 201 can confirm any and all information related to that particular passenger(s) prior to boarding an airplane. At least one type of terminal hardware device(s) 201 may incorporate any type of internal and/or external reader, scanner, sensing, with or without any type of antenna to enhance it performance.

At least one type of product and equipment can be designed and supplied with a microphone 216 that allows for voice communications, and/or voice-command operation, whereby a central computer downloads his/her unique voice print file (for verification) and only then will it allow him/her to access, control, and receive any related database information on the terminal hardware device(s) 201 for additional security validation. At least one type of voice scrolling, and voice communications can be built into terminal hardware device(s) 201 as well. At least one type of headphone 221 can be utilized to provide user voice information that is confidential, and not for any other party to hear.

At least one type of speaker 218 can be utilized to provide sound notification to the operator for various situations, and conditions that can be designed into the system at any time. At least one type of removable media 217 can equally be utilized as part of the terminal hardware device(s) 201 for meeting all types of requirements, including user information, confirmations, re-confirmations, time logs, audit back up logs, time attendance reporting, and additional security functions to name a few. At least one type of touch screen, and/or button design and configuration can be built into the system for accessing all types of information, including primary categories, sub-categories, and more. At least one type of physical ON/OFF button 223 can be utilized in any particular design, or a design without any physical buttons can also be utilized in any particular design, whereby any form of scanning, reading, or sensing techniques are deployed and utilized, whereby all authorization, confirmation, and the types of data, information is automatically made available based on the person, object, parties, and/or any form of biometrics, such as a biometric scan 222 feature.

At least one type of speaker 218 could be utilized to provide audio and sound features. At least one type of LED 219 can be utilized to provide visual information, or validation, such as power resources, silent alarms, emergency notifications, and more. At least one type of gel pad 220 can be utilized as part of or in addition to at least one type of hardware device to make it easier and more convenient for users to place their hands (palms) as touching and interacting with information on the screen, to protect the device from bring stretched, dropped and broken, prevent any type of device from having a slippery surface, among other things. At least one type of airport, and/or airlines name, logo, and visual information 214, and time, date can be provided at the top. At least one type of quick links icons and text information 215 can go here that allows the user to quickly contact at least one other user, to forward entire files that are one the user screen to at least one other party, to quickly receive data and information from at least one other user without interrupting the primary screen area, as well as configurations to provide text based information, such as SMS (short message service) at this location, to name a few.

At least one type of terminal hardware device(s) 201 can provide notification for multiple modes 213 such as whether the terminal hardware device(s) 201 'scanning is ON' to notify that the unit is ready for receiving/scanning an airline ticket device(s) FIG. 1, of a passenger(s), a checked-in luggage, a carry on baggage(s), and/or other items. Database information that is sent back to a gate terminal hardware device(s) 1 can include information such as a photo(s) 202 of the passenger, their name(s) 203, the Airline(s) 204, Flight Number(s) and arrival destination city(ies) 205, departure Gate(s) 206, departure time(s) 207, (whether the flight is on time, or delayed) that the passenger is traveling on, the number of checked luggage 211, as well as clicking on the luggage icon 212 to find out more detailed information on the location, and specifications of each luggage bag(s) in case they need to be located for security purposes, and carry-on baggage 209, as well as clicking on the baggage icon 210 to find out more detailed information on the location, and specifications of each baggage in case they need to be located for security purposes.

All types of information can be externally tied 208 to 'intelligence agencies', and can be provided to the airline personnel operating the terminal hardware device(s) 201 including instructions on what to do. At least one type of system configuration can also provide to at least one type of airlines, airport, security, or other personnel whether the passenger(s) have gone through and received authorization at any security check-points, or if they did not pass security inspections, or did not get screened at such location(s) passenger(s), as well as any and all carry-on baggage. If necessary, information on the activities (where the passenger(s) went in and around an airport), prior to boarding an airplane can be provided on the screen to the airline personnel. At least one type of terminal hardware device(s) 201 could be configured to operate on internal, and/or external power resources. At least one type of terminal hardware device(s) 201 could be configured to any type of fixed terminal, and/or removable from a stand, in cases where the device(s) requires mobility in completing all types of tasks quickly, and efficiently without compromising the security and protection of the system(s).

Whereby touching, voice command, and or any other type of method(s) can control at least one portion of said information screen, such that additional and more detailed said information can be provided to at least one type of terminal hardware device(s) 201 users at any time. Inversely, 'intelligence agencies', or other external parties are able to send, and receive data and information on criminals, or profiled people to all airport devices (FIG. 2, FIG. 3, FIG. 4) so that these parties have this information available to them in a matter of seconds, and linking all data and information between airport(s), airline(s), and other parties.

All variable settings, formats, frequencies, spectrums, distance, range, angle of dispersion, and fine tuning for adjustments of a specified terminal hardware device(s) 201 can be designed as hardware buttons (with the preferred methods to be facilitated) by software applications and user interface by voice, touch, and/or other methods. At least one type of terminal hardware device(s) 201 can equally be pre-programmed from a (CMS) central monitoring station or any other location with general, and/or unique settings and specifications to only allow its use by a specific user(s) for a specific year, month, day, time.

Whereby such types of information can quickly and easily be sent from a database location through a wired and/or wireless network to a specific terminal hardware device(s) 201, and/or all general terminal hardware device(s) 201, and tied into any type of camera, CCTV, or visual monitoring devices, or apparatuses. With multiple combinations and variations of security protocols, platforms, configurations, and methods for execution, handheld device(s) cannot be accessed by anyone unless under an authorized and secure environment.

Whereby at least one type of terminal hardware device(s) 201 can be configured to require for the operator to utilize at least one type of biometric techniques 222, voice-command operation 216, whereby a central computer downloads his/her unique voice print file (for verification) and only then will it allow him/her to access, control, the device, the inserting of authorized card, removable media, swipe card, smart card, or other forms of identification devices, as well as the user(s) required to have on their wrist, body, and/or person a specially modified airline ticket device(s) that identifies, and authorizes the user by scanning, and/or reading techniques. Any and all of these forms of identification, and/or many others as a single source, and/or in combinations of more than one type of technique can be utilized to perform the same function(s) of optimized security.

Further including at least one type of terminal device(s) 201 can utilize all types of user identification means whether cryptic/non-cryptic, compression/decompression, content related to analog, digital, or combination interfaces, various types digital modulation techniques to squeeze more bandwidth onto a single transmission, protocol translation processing, modulation/demodulation means, satellite transmission interfaces and wireless transmission interfaces, and related means necessary to initiate primary control points between where the data is stored, and each identified recipient terminal device(s) 201.

At least one type of terminal device(s) 201 may be designed with internal data storage capabilities to provide and facilitate any functions, as well as external storage capabilities beyond the device itself. An example is for the airline ground gate personnel to provide a removable media that holds various types of data and information from passengers, luggage, baggage, gate information, flight information, and alike. Whereby at least one type of removable media can be taken on the airplane upon its departure, and downloaded onto an airplanes hardware device(s) that logs this data onto a type of black box, and other means for quickly identifying passenger information, even to the extent of transmitting such information in cases of distress to external locations such as satellites to predetermined parties.

Whereby at least one type of terminal device(s) 201 can provide time and attendance on any and all users, persons, objects, or other, creating at least one type of log that can be referenced to everything from payroll and hours, unauthorized access control issues, and a host of other items. At least one type of user could include (but not be limited to) an airlines front side check-in luggage, baggage, and passenger personnel, check-in counter personnel, security check-point personnel, satellite area personnel, gate personnel, airline personnel on an airplane, baggage claim areas, and personnel, parking area personnel, and all other areas in and around an airport, and/or aviation sector.

The above is intended, along with the drawings, to illustrate the preferred embodiment of the invention within the airport, airlines, and aviation environment. Those skilled in the art will be able to devise numerous arrangements which, although not explicitly shown or described herein, embody the principles of the invention and are within their spirit and scope as defined by the above claims.

Figure 3:
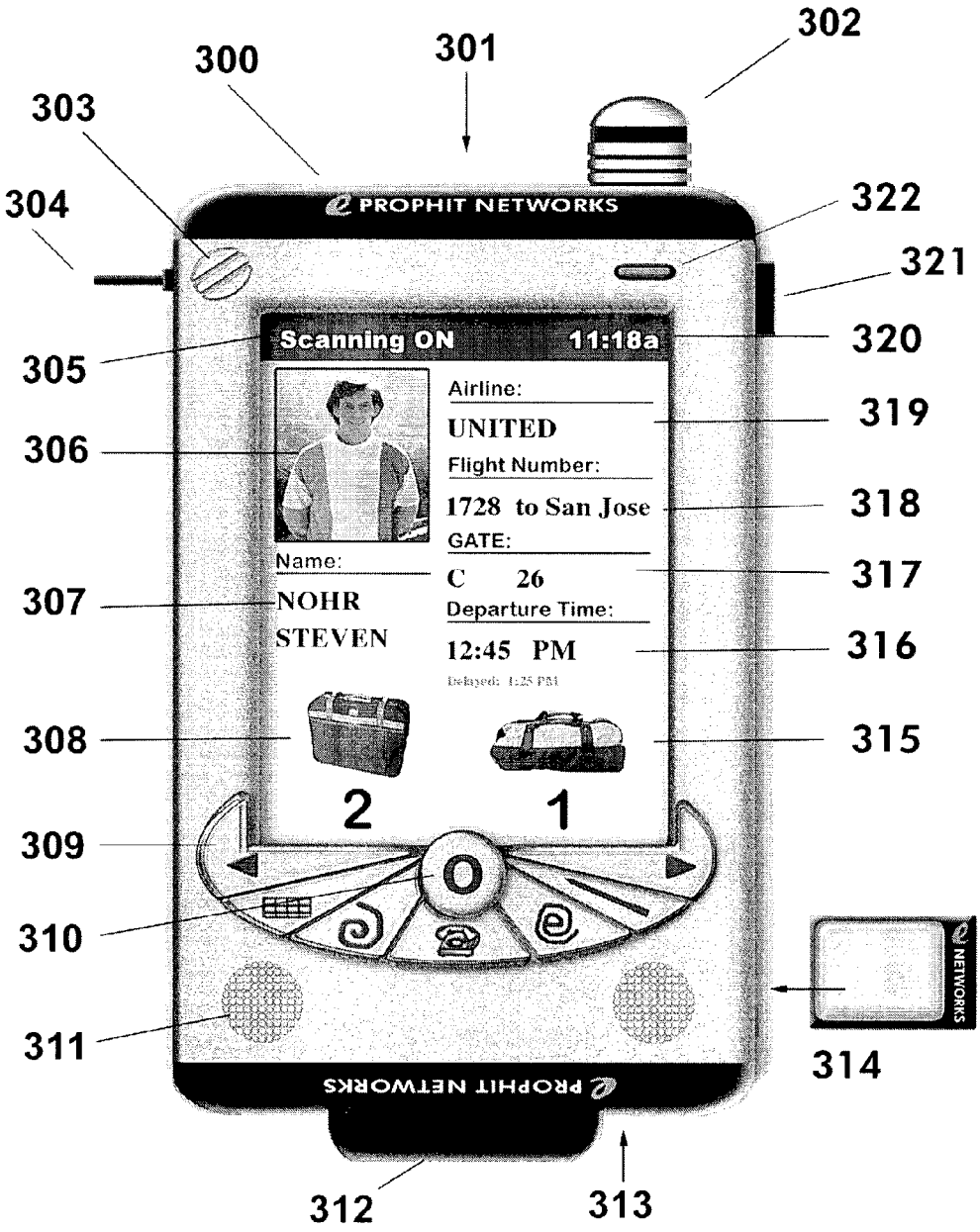
FIG. 3 is a general diagram showing a preferred new type of terminal hardware device(s) and its preferred interaction within one particular environment, such as in and around an airport check-in counter, gate, screening area, airport, airplane, aviation environment, and/or any other environment for achieving its objective(s)

FIG. 3 is a general diagram showing a fixed position for a removable portable hardware device(s) 300, that can be taken off of its stand apparatus 3012 for cases when an airline ticket counter personnel needs to reach out and check on the status of an airlines ticket device(s), and/or combination of carry on baggage that is over the counter, and/or in combination of checked-in luggage that is to heavy to pick up, or alike, where the preferred means of interacting with local and/or remote database information, preferably by wired means while in its stand apparatus 3012 to/from database(s) information, and wireless means when out of its stand apparatus 3012, through at least one communications device(s) FIG. 7.

Whereby at least one type of fixed position portable hardware device(s) 300 can be configured to operate on all type(s), style(s), and formats of operating system, software, firmware, middleware, and architecture automatically, or manually, or only by directing any type of fixed position portable hardware device(s) 300 in the direction of at least one passenger(s), or traveler(s), their checked-in luggage, carry on baggage, items purchased at any retail shop within an airport, and/or airplane environment, and/or other.

A preferred method for fixed position portable hardware device(s) 300 (set as default) allows at least one user (such as airport security personnel, airlines personnel, and/or other personnel) to point, aim, direct, or be close in proximity to at least on type of fixed position portable hardware device(s) 300 at a passenger(s), or traveler(s), their checked-in luggage, carry on baggage, whereby at least one type of reader 301, scanner, sensing, or other type of device or mechanism, with or without the use of at least one type of antenna 302 can receive at least one type of airline ticket device(s), adhesive based device, or other type of device that could include any type of unique code, identification, data, information, reference, or other that allows at least one type of local and/or remote, network, or provider database to recall and provide to at least one type of hardware device any and all types of data and information about at least one person, object, or party such as a passenger, traveler, luggage, baggage, purse, or other. At least one type of reader 301, scanner, sensing, or other type of device or mechanism can be designed as a removable and re-attachable unit providing unique and specialized configurations, frequency allocations, and communications protocols, platforms, spectrums, software applications, architectures, and alike to differentiate various types of airlines, and airport personnel who are operating such devices, so that no other airline, or party is able to gain access to another airlines, or parties (confidential database information).

At least one type of products and equipment can be designed and supplied with a microphone 303 that allows for voice-command operation, whereby a central computer downloads his/her unique voice print file (for verification) and only then will allow him/her to access, control, and receive any related database information on the fixed position portable hardware device(s) 300 for additional security validation.

At least one type of voice scrolling, and voice communications can be built into any type of fixed position portable hardware device(s) 300 as well. At least one type of headphone 304 can be incorporated into at least one type of design to provide user voice information that is confidential, and not for any other party to hear. At least one type of speaker 311 can provide sound notification to the operator for various situations, and conditions that can be designed into the system at any time.

At least one type of removable media 314 can equally be utilized as part of the fixed position portable hardware device(s) 300 for meeting all types of requirements, including user information, confirmations, re-confirmations, time logs, audit back up logs, time attendance reporting, and additional security functions to name a few. Various types of touch button designs and configurations can be built into the system for accessing all types of information, including primary categories, sub-categories, and more.

At least one type of ON/OFF button 310 can be provided, or can be eliminated, and only can be turned on from the use of biometric techniques 321. At least one physical button(s) 309 can be incorporated into the portable hardware device(s) 300, or no physical buttons can be incorporated into the design for increased security.

At least one type of speaker 311 can be incorporated into any design to provide sound features to the fixed position portable hardware device(s) 300. At least one type of LED 322 or visual notification or confirmation techniques can be utilized to provide visual information, such as power resources, silent alarms, emergency notifications, and more.

At least one type of fixed position portable hardware device(s) 300 can be designed to provide notification for multiple modes 5 such as whether the fixed position portable hardware device(s) 300 scanning ON, OFF, transferring data mode, querying FBI database, other user (operation status) 305 before aiming, pointing, being close in proximity it, and/or directing it to at least one type of object, person, or other such as a passenger(s), checked-in luggage, carry on baggage, and/or other items.

At least one type of database information can be sent back to at least one type of fixed position portable hardware device(s) 300 and can include information such as a photo 306 of the passenger, luggage, baggage, purse, or other object, their name 307, the Airline 319, Flight Number 318, departure Gate 317, departure time 316, (whether the flight is on time, or delayed) that the passenger is traveling on, the number of checked-in luggage 308, and carry on baggage 315 the passenger has identified during the check-in process with the respective airlines, and much more.

The bottom portion of the device 313 can be designed as a removable unit that stores anything from power resources, biometric sensing, voice-print recognition capabilities, and user identification information to name a few. At least one type of stand apparatus 312 design gives the user freedom and mobility to remove and use at least one type of fixed position portable hardware device(s) 300, at anytime, in completing all types of tasks quickly, and efficiently without compromising the security and protection of the system(s).

By touching, (voice command, and or any other type of method(s)) any portion of this information on the screen, additional and more detailed information can be provided to the fixed position portable hardware device(s) 300 users at any time. As an example, touching the checked-in luggage will bring up detailed information on the two sets of luggage, including weight, a photograph, and other information. Security personnel can touch the photo of a passenger can bring to have the database system check with external 'intelligence agencies' whether suspect passengers are wanted, or on these types of lists.

Inversely, 'intelligence agencies' are able to send data and information on criminals, or profiled people to all airport devices (FIG. 2, FIG. 3, FIG. 4) so that these parties have this information available to them in a matter of seconds, and linking all data and information between airport(s), airline(s), and other parties.

All variable settings, formats, frequencies, spectrums, distance, range, angle of dispersion, and fine tuning for adjustments for at least one type of fixed position portable hardware device(s) 300 can be designed as hardware buttons (with the preferred methods to be facilitated), by software application, user interface by voice, touch, and/or other methods. At least one type of fixed position portable hardware device(s) 300 can equally be pre-programmed from a (CMS) central monitoring station or any other location with general, and/or unique settings and specifications to only allow its use by a specific user(s) for a specific year, month, day, time.

At least one type of information can quickly and easily be sent from a database location through a wired and/or wireless network to any type of fixed position portable hardware device(s) 300, and/or other types of hardware devices. With multiple combinations and variations of security protocols, and methods for execution, at least one type of fixed position portable hardware device(s) 300 controlled access can be maintained by authorized and secure environment. Time 320 is also provided at the top corner of the screen.

At least one type of fixed position portable hardware device(s) 300 can utilize all types of user identification means whether cryptic/non-cryptic, compression/decompression related content using analog, digital, or analog to digital conversion interfaces, digital modulation techniques to squeeze more bandwidth onto a single transmission, protocol translation processing, modulation/demodulation means, satellite transmission interfaces and wireless transmission interfaces, and related means necessary to initiate primary control points between where the data is stored, and each identified recipient.

Figure 6:
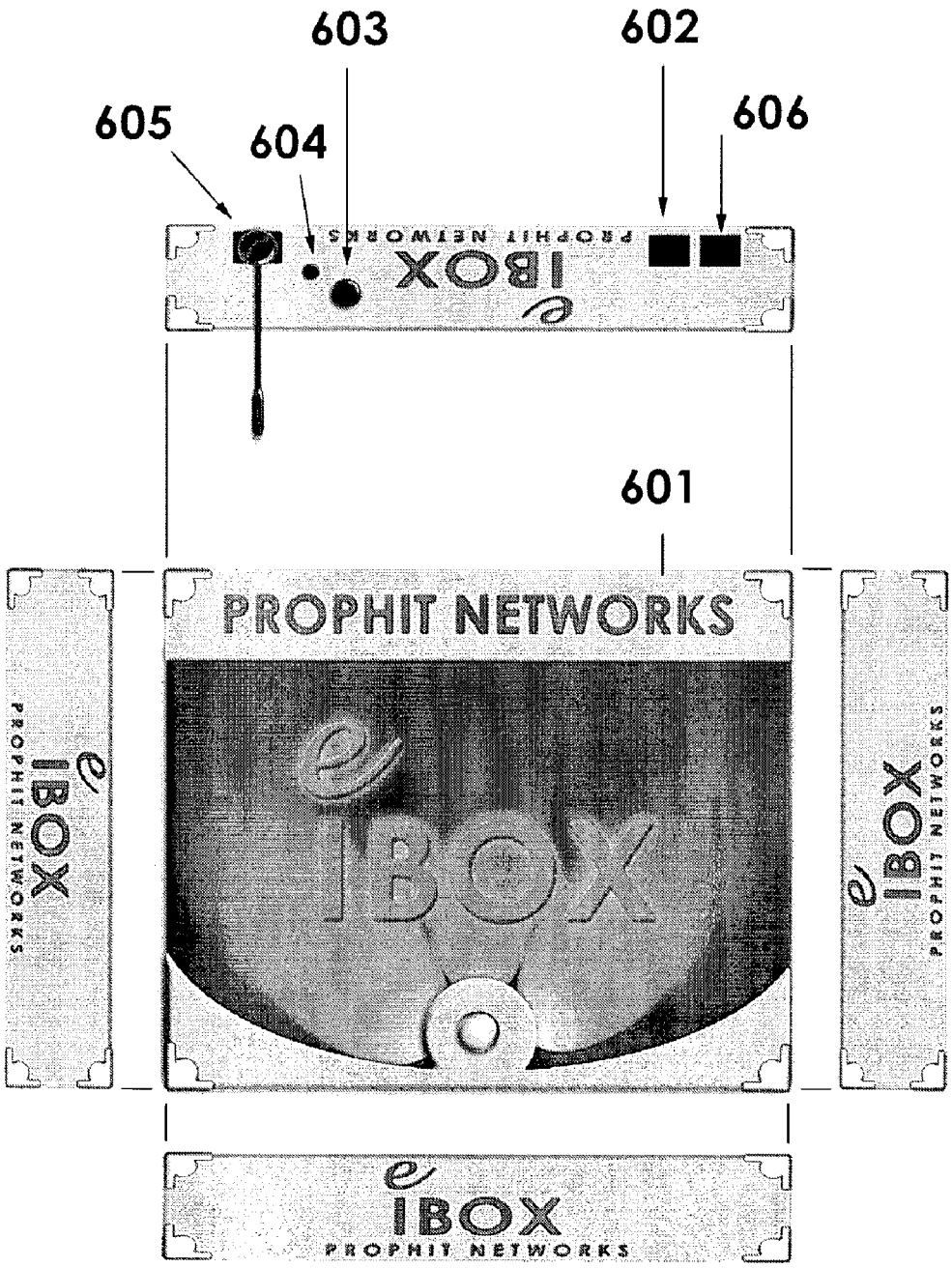
FIG. 6 is a general diagram showing a preferred type of communications device(s) and its preferred interaction within one particular environment which can be configured as a networked, and/or non-networked based system, wired, and/or wireless, single, and/or duel spectrum, such as in and around an airport, airplane, and/or aviation environment for achieving its objective(s)

In cases where (for any reason) a fixed position portable hardware device(s) 300 is not within range to receive information from, and/or through a communications device FIG. 6, any type of wired, wireless, or other types of networks, and platforms, at least one type of hardware device may be designed, and configured with internal data storage capabilities to allow a hardware device to facilitate its functions, and work. Another method(s) for facilitating the same is for the hardware device to be connected by wired means, and download the necessary information in a matter of seconds.

At least one type of peer-to-peer techniques can be established whereby all fixed, and portable terminal devices can continually update each other such that as and when a qualified querying party were to seek such types of information, the distance that such types of information needs to travel or occur, could be configured from internal, external, and/or removable means, or from a localized (CCD) content delivery device, such that there is not need for the querying party to wait for such types of data and information to be delivered typically from prior art from a (CPU) central computer processing center that is more than likely very far away from the querying party.

At least one type of hardware device can communicate, share, exchange, provide, send, and receive data and information directly between two different hardware devices without the need of any type of network to facilitate such requests. At least one type of hardware device can provide time and attendance on any and all users, creating a log that can be referenced with everything from payroll and hours, unauthorized access control issues, and a host of other items.

At least one type of system could be established that would enable at least one user, passenger, airport, airline, security personnel, or other party to carry, have, utilize, or alike any type of portable terminal device such as a cellular mobile phone, pager, personal digital assistant, or other type of device to access all types of data and information, through at least one type of wired and/or wireless environment, by at least one network, provider, and services.

At least one preferred user cam include (but not be limited to) airlines front side check-in luggage, baggage, and passenger personnel, check-in counter personnel, security checkpoint personnel, satellite area personnel, gate personnel, airline personnel on an airplane, baggage claim areas, and personnel, parking area personnel, and all other areas in and around an airport, and/or aviation sector, or other environments such as at least one type of theme park, amusement park, aquarium, tourist location, hospitals, buildings, government complex, malls, customs boards, sports events, parking, manufacturing, hotels, resorts, clubs, retail, elevators, utilities, museums, libraries, as well as other types of location(s), among other environments.

The above is intended, along with the drawings, to illustrate the preferred embodiment of the invention within the airport, airlines, and aviation environment. Those skilled in the art will be able to devise numerous arrangements which, although not explicitly shown or described herein, embody the principles of the invention and are within their spirit and scope as defined by the above claims.

Figure 4:
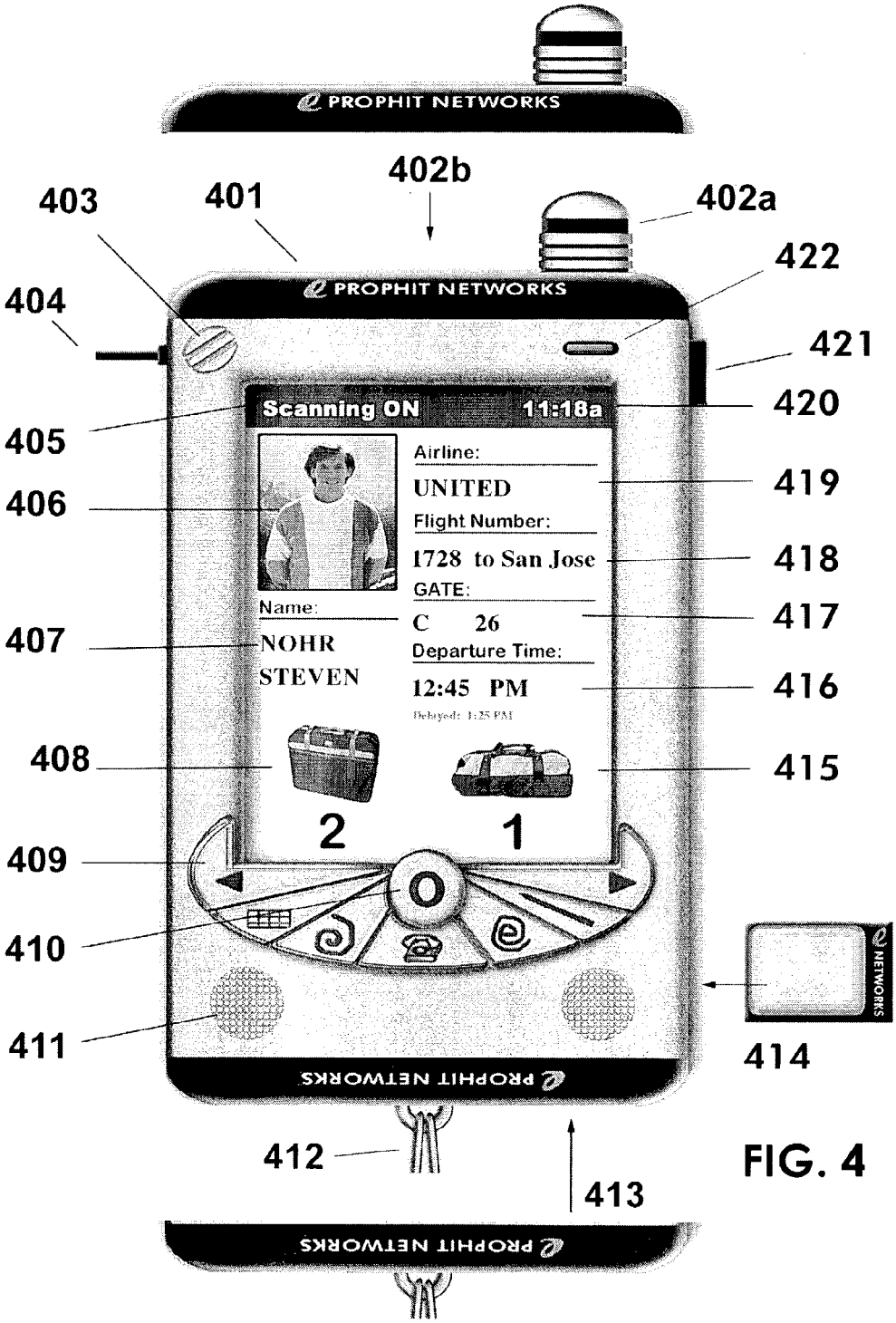
FIG. 4 is a general diagram showing a preferred type of handheld hardware device(s) and its preferred interaction within one particular environment, such as in and around an airport check-in counter, gate, screening area, airport, airplane, aviation environment, and/or any other environment for achieving its objective(s)

FIG. 4 is a general diagram showing at least one type of handheld device(s) 401 and preferred means of interacting with local and/or remote database information, preferably by wireless means, through at least one communications device(s) FIG. 7. At least one type of handheld device(s) 401 can be configured to operate on all type(s), style(s), and formats of software, firmware, middleware, and architecture automatically, or manually, or only by directing such a handheld device(s) 401 at a passenger(s), or traveler(s), their checked-in luggage, carry on baggage, and/or other items purchased at any retail shop within an airport, and/or airplane environment.

The preferred method for handheld device(s) 401 (set as default) allows the user (such as airport security personnel, airlines personnel, and/or other personnel) to point the handheld device(s) 401 at a passenger(s), or traveler(s), their checked-in luggage, carry on baggage, whereby at least one type of reader 402*b*, scanner, or sensing can be utilized, as well as at least one type of antenna 402*a* to send and receive data and information, such as from any type of airline ticket device(s) unique code, that allows the local and/or remote database to recall and provide to the handheld device(s) screen any and all information about the passenger, or traveler. At least one type of reader 402, scanner, or sensing can be utilized, as well as at least one type of antenna 402*a* can be designed as a removable and re-attachable unit providing unique configurations, frequency allocations, and communications to different airlines, and airport personnel who are operating such devices, so that no other airline party is able to gain access to another airlines (confidential database information).

Products and equipment can be designed and supplied with a microphone 403 that allows for voice-command operation, whereby a central computer downloads his/her unique voice print file (for verification) and only then will allow him/her to access, control, and receive any related database information on the handheld device(s) 401 for additional security validation. Voice scrolling, and voice communications can be built into handheld device(s) 401 as well.

At least one type of headphone 404 can provide user audio information that is confidential, and not for any other party to hear. At least one type of speaker 411 can provide sound notification to the operator for various situations, and conditions that can be designed into the system at any time. At least one type of removable media 414 can equally be utilized as part of any type of hardware device for meeting all types of requirements, including user information, confirmations, reconfirmations, time logs, audit back up logs, time attendance reporting, and additional security functions to name a few. Various types of voice recognition, and touch button designs and configurations can be built into the system for accessing all types of information, including primary categories, subcategories, and more. At least one type of button, such as ON/OFF button 410, or navigation, category, sub-category button(s) 409 is provided, or can be eliminated, and only can be turned on from the use any type of biometric 421 features.

At least one type of speaker 411 can be utilized to provide sound features at least one type of handheld device(s) 1. At least one type of LED or visual verification 422 can be utilized to provide information; such as power resources, silent alarms, emergency notifications, and more. At least one type of handheld device(s) 401 can provide notification for multiple modes 405 such as whether the handheld device(s) 401 scanning is ON before aiming, pointing, directing and/or coming close in proximity to any person or object, such as a passenger(s), checked-in luggage, carry on baggage, and/or other items.

At least one type of database can be configured and sent back to at least one handheld device(s) 401, and other hardware devices, and can include information such as a photo 406 of the passenger, luggage, baggage, purse, or other object, their name 407, the Airline 419, Flight Number 418, departure Gate 417, departure time 416, (whether the flight is on time, or delayed) that the passenger is traveling on, the number of checked luggage 408, and carry-on baggage 415 the passenger has identified during the check-in process with the respective airlines, and much more.

Whereby other portions of the device can be designed as a removable unit 413 that stores anything from power resources, user identification information, to name a few. At least one type of necklace 412 design allows any user free use of their hands, quickly and efficiently, without setting the handheld device(s) 401 down, at anytime compromising the security and protection of such a unit, and time 420 provided on the screen.

By touching any portion of this information on the screen, additional and more detailed information can be provided to the handheld device(s) 401 users at any time. Or in other configurations, voice navigation can equally be utilized, which also provides additional voice-print signature confirmation and approval processing while the device is use. As an example, touching the checked-in luggage will bring up detailed information on the two sets of luggage, including weight, and other information. Security personnel can touch the photo of a passenger can bring to have the database system check with external 'intelligence agencies' whether—suspect passengers are wanted, or on these types of lists.

Inversely, 'intelligence agencies' are able to send data and information on criminals, or profiled people to all airport devices (FIG. 2, FIG. 3, FIG. 4) so that these parties have this information available to them in a matter of seconds.

All types of variable settings, formats, frequencies, spectrums, distance, range, angle of dispersion, and fine tuning adjustments for any handheld device(s) 401 can be designed as hardware buttons (with the preferred methods to be facilitated), by software applications, by middleware, firmware, and protocol methodology, and/or by user interface by voice, touch, and/or other methods.

At least one type of handheld device(s) 401 can equally be pre-programmed and/or controlled from a (CMS) central monitoring station or any remote location with general, and/or unique settings and specifications to authorize, restrict, and provide use by at least one user, such as a specific user(s) for a specific year, month, day, time, location, and more. Information can quickly and easily be sent from a database location through a wired and/or wireless network to a specific handheld device 401, and/or all general handheld devices 401. With multiple combinations and variations of security protocols, and methods for execution, handheld device(s) 401 cannot be accessed by anyone unless under an authorization of a secured environment.

At least one type of handheld device(s) 401 can utilize all types of user identification means whether cryptic/non-cryptic, compression/decompression related content using analog, digital, or analog to digital conversion interfaces, digital modulation techniques to squeeze more bandwidth onto a single transmission, protocol translation processing, modulation/demodulation means, satellite transmission interfaces and wireless transmission interfaces, scanning, sensing, and/or reading techniques, and related means necessary to initiate primary control points between any type of data, information, and hardware device, or data storage location(s), and each identified recipient handheld device(s) 401.

In cases where (for any reason) a handheld device(s) 401 is not within range to receive any form of data and information from, and/or through a communications device FIG. 6, or other types of devices, at least one type of handheld device(s) 401 may be designed and configured with internal data storage capabilities that allows a handheld device(s) 401 to facilitate its functions, and work. Another method(s) for facilitating the same is for the handheld device(s) 401 to be connected by wired means, and/or wireless means to download the necessary information in a matter of seconds. At least one type of handheld device(s) 401 can provide time and attendance on any and all users, creating a log that can be referenced with everything from payroll and hours, unauthorized access control issues, and a host of other items.

The above is intended, along with the drawings, to illustrate the preferred embodiment of the invention within the airport, airlines, and aviation environment. Those skilled in the art will be able to devise numerous arrangements which, although not explicitly shown or described herein, embody the principles of the invention and are within their spirit and scope as defined by the above claims.

FIG. 5 is a general diagram showing at least one type of terminal device(s) 501 and preferred means of interacting with passenger(s), by providing all types of information services, whether it be a local and/or remote database information, preferably by wired means, but alternatively through wireless means, from/to at least one data storage device(s). At least one type of terminal device(s) 501 can be configured in any size, shape, scale, form, function, material, components, or design, and operate on all type(s), style(s), and formats of software, firmware, middleware, protocol, and architecture automatically, or manually, and/or only directing by such passenger(s), interaction(s), and/or systems approvals.

The basic preferred method of design could be designed with the primary function to provide to passenger(s) a means of receiving, and/or sending at least one type of data and information from these terminal device(s) 501, and/or other types of hardware devices, such as a portable terminal device (cellular mobile phone, pager, personal digital assistant, or other) wireless devices which wirelessly communicate with, by, through any type of wireless network, provider, or service.

Information can include anything from checking on the status of checked luggage 506 (ETA), checking on parking area and pick up information 505, which shows the passenger the location of the party that is picking them up, including but not limited to the location of the vehicle, parking area, parking floor, and parking spot number, a map on how to get there, the location of the picking up party, if other than the vehicle location, such as a meet and greet location, a retail shop location, and/or any other location in and around an airport, any message(s) that were left by the picking up party—such as sorry could not make it, tied up in traffic, so please take a taxi to the hotel, will meet you for dinner at 8 PM—end message. At least one type of configured, and designed system can enable passengers to send data, information, and/or voice message(s) to, by, threw any external network, provider, or service.

At least one type of passenger can book at taxi, limousine, shuttle bus, and/or other transportation services 512, including hotel reservations right on, or through at least one type of terminal device(s) 501.

At least one type of microphone 507 can be utilized for all types of voice interaction, at least one type of speaker 509 are utilized to provide any such sound and audio features, at least one type of LED, or visual verification 503 can be utilized to provide all types of visual communications, at least one type of gel pad(s) 511 could be incorporated into at least one type of hardware device design, to make it easier and convenient for at least one type of person, such as a passenger to place, and/or rest their hands, and/or other objects ON, by, near while interfacing with the terminal device(s) 1. At least one type of advertising area(s) 510, or visual information areas and location(s) can be provided in and around the terminal device(s) 501 for any purpose(s).

At least one type of terminal device(s) 501 can identify among other things, an Airport 508 name, and date/time 504 for added convenience to the passenger(s). At least one type of terminal device(s) 1 can include at least one type of removable media 502, scanning feature(s) that allows at least one type of person, hardware device, or other object, such as a user, passenger, or hardware device to review, collect, download, save, delete, all types of data, and information. Some such information can include their travel, airline, and airport information, information about the given city, tourist information, hotel information, map information, names, and numbers, and much more. At least one type of speaker 509 to provide to the user with at least one type of audible sound(s).

At least one type of terminal device(s) 501 can be located at least one airport, airplane, aviation location, parking area, or other places, for at least one user, passenger, or other to access all types of data, and information from a multitude of avenues, and services directly, and indirectly related to their travels.

At least one type of terminal device(s) 501 can be designed and configured taking into account capturing quantity limitations, piggybacking content information, recipient identification means whether cryptic/non-cryptic, compression/decompression related content using analog, digital, or analog to digital conversion interfaces, digital modulation techniques to squeeze more bandwidth onto a single transmission, protocol translation processing, modulation/demodulation means, satellite transmission interfaces and wireless transmission interfaces, and related means necessary to initiate primary control points between where the information is located, and the identified recipient of the requested information.

The above is intended, along with the drawings, to illustrate the preferred embodiment of the invention within the airport, airlines, and aviation environment. Those skilled in the art will be able to devise numerous arrangements which, although not explicitly shown or described herein, embody the principles of the invention and are within their spirit and scope as defined by the above claims.

FIG. 6 is a general diagram showing at least one type of communications/reader device(s) 601, that could be designed and configured to read, scan, sense, or other any and all types of external persons, objects, or other, such as at least one type of airline ticket device(s) FIG. 1, hardware device FIG. 2, FIG. 3, FIG. 4, FIG. 5, FIG. 7, adhesive based device FIG. 8, or anything else that is in and around an airport environment; such as a person, airport personnel, airlines personnel, security personnel, passenger, checked luggage(s), and carry-on baggage(s), as well as communicating with, and interacting to and from local and/or remote database centers, by wired 602, wireless 605, and/or combinations thereof in;

(a). collecting, compiling, formatting, storing, recalling, and providing all types of data and information on passengers movements throughout an entire aviation environment by identifiable zone(s) or locations, in monitoring their activities within, and around an airport, airplane, and aviation environment from any type of airline ticket devices(s) FIG. 1, (b). storing, formatting, recalling, and/or providing any type (s) of content, and information to all types of parties (authorized preferred) who have access to receive such information, in and around an airport by wired, wireless, and/or combinations thereof to all types of device(s) including; FIG. 2, FIG. 3, FIG. 4, FIG. 5, FIG. 7, as well as to airlines, airports, private sector(s), government agencies, on a remote basis. The preferred method is for all reader features, and all communications features to be built into one single unit. However, these key features can equally accomplish the same objectives as individually designed and separate hardware units.

At least one type of communications/reader device(s) 601 may be designed and configured with the capability to seek, query, test, confirm, acknowledge, and approve the location of at least one object, such as a checked, or carry-on luggage, a person, such as a passenger(s) and provide this data and information to all types of database storage center(s), as well as hardware device(s), whether in a specific airport, or outside of a specific airport location.

At least one type of variable settings 603 can be incorporated to enable adjustment of at least one type of specified footprint, coverage area, or zone(s) of a specific communications/reader device(s) 601, to scan, read, sense, seek, test, confirm, and commence forward with the transmission and/or receipt of all types of information. There is at least one type of setting 604 that allows for adjustable angle of dispersion to be facilitated manually, as well as software programming capabilities that calculate and adjust for these changing factors in warmer, cooler, and/or humid environments, and other needs. At least one type of power resources 606 can be provided either by external means, and/or internal power supply.

At least one type of communications can be facilitated by at least one type of wired means and/or methods, being the preferred method, with other methods including but not limited to a local or remote network server, computer system, telephone, Digital Subscriber Lines (DSL), copper or other line network, using a satellite uplink, and/or downlink, digital or analog wired, or wireless modem, LAN, WLAN, or RF signal transmitter, optical fiber interface or network, cable network(s), or bi-directionally amplified coaxial cable interface, any wireless cellular, paging, trunk, analog or digital platforms, or an interface to a D1 or T1 line, provided by a company with sufficient wired or wireless bandwidth to transmit and deliver the necessary data and information to the recipient.

Whereby transmitting equipment as part of at least one type of communications/reader device(s) 601, might also include an integrated content storage and delivery system(s), an embedded or non-embedded modulator/demodulator, multiplexer/demultiplexer, digital encoder/decoder, cryptic/non-cryptic means, data packet based software means, and/or compression/decompression system.

At least one type of communications/reader device(s) 601, can be designed and configured to seek, collect, store, format, and provide any type of data and information to, preferably, authorized parties of FIG. 2, FIG. 3, FIG. 4, FIG. 5, FIG. 7, as well as other types of devices.

Upon activation, at least one type of communications/reader device(s) 601 can be configured to commence with establishment and confirmation from any such device(s) (FIG. 1 to FIG. 8), or other types, and styles of devices, and objects to confirm the configure information to at least one type of recipient device(s), before transmission paths, configurations, and means can commence.

At least one type of recipient can physically move around an airport, airline, airplane, or other environment, and the recipient can be queried by various communications/reader device(s) 601, or other types of devices, such as sensors, scanners, readers, and at anytime, querying for any and all types of data, information, and communication on at least one person, object, or other in and around an airport, and/or airplane, passenger(s), airlines, airport, and/or other personnel, the recipient of said information has multiple options to elect, including but not limited to receive, save, terminate, delete, file, recall, sort, and log to name a few, whereby said transmission paths, configurations, and other protocols may change from communications/reader device(s) 601 to improve data and information flows.

At least one type of communications/reader device(s) 601 can be designed and configured to provide at least one type of data and information to at least one type of hardware device by automatic, manual, passive, active, or other methodology and delivery methods, and/or multiple screening, confirmations, and security protocols, within a hardware device(s), and/or in combination of manual selections, or inputs by a user(s).

This approach is the most effective, least expensive, most direct, most efficient, and most convenient method to implement because the entire inter-exchange control or direct communication between the communications/reader device(s) 601 and at least one type of recipient(s) hardware device(s) that can be provided within a specific zone, and/or region allocated to a unique communications device(s), rather than only coming from one such device to cover an entire area.

At least one type of communications/reader devices 601, can be incorporated with at least one type of reader, sensor, scanner, or other technique that could be utilized in the location, tracking, monitoring, and logging any and all information on all passengers (airport, and airlines personnel can be tracked by same means and methods), throughout entire airports, among other things. This data tracking information that is collected and stored on at least one type of local and/or remote database, or other locations can be accessed by any and all types and forms of authorized personnel, including automatically configuring, and formatting the information prior to sending in out to any such given party(ies).

At least one type of communications/reader device(s) 601, their apparatus and methods according to the present invention has been disclosed in detail in connection with the preferred embodiments, but these embodiments are disclosed by way of examples only and are not to limit the scope of the present invention, which is defined by the claims that follow.

The above is intended, along with the drawings, to illustrate the preferred embodiment of the invention within the airport, airlines, and aviation environment. Those skilled in the art will be able to devise numerous arrangements which, although not explicitly shown or described herein, embody the principles of the invention and are within their spirit and scope as defined by the above claims.

FIG. 7 is a general diagram showing at least one type of parking terminal device(s) 701 and preferred means of interacting with parties wishing to drop off, and/or pick up passenger(s), by providing all types of information services, whether it be a local and/or remote database information, preferably by wired means, but alternatively through wireless means, from/to at least one data storage device(s) to at least one parking terminal device(s) 701.

At least one type of parking terminal device(s) 701 can be configured in any size, shape, scale, form, function, material, substance, configuration, or design, and operate on all type(s), style(s), and formats of software, firmware, middleware, and architecture automatically, or manually, and/or only directing by such user(s), interaction(s), and/or systems approvals. At least one type of basic preferred method of design is to provide to user(s) a means of inputting, receiving, and/or sending at least one type of information from such a parking terminal device(s) 701.

Information can include anything from identifying the location of the pick up parties vehicle, where the pick up party will be waiting (such as a meet and greet, and/or retail location(s)), checking on the status of the passenger(s) flight and arrival information (ETA) 706, checking to see whether the passenger(s) have picked up their luggage 705 yet or not (providing ETA information to the pick up party how much longer they are going to have to wait), allows the pick up party to modify information where they, and/or the vehicle is located 711, which is provided to the passenger.

At least one type of message center 712 by at least one type of network, provider, or services allows users to leave a voice, and/or text message for the arriving passenger(s) when they go to check the status of their pick up party FIG. 5. At least one type of system can allow pick up parties to call in information that can be left for passengers (at various terminal device(s) location in and around an airport(s), and/or airplane(s).

At least one type of microphone (not shown) is utilized for all types of voice interaction, the speakers 708 are utilized to provide any such sound features, the LED or visual verification 703 can be utilized to provide all types of visual communications, at least one type of gel pad(s) 710 can be utilized to make it easy and convenient for the passenger place, and/or rest their hands, and/or other objects while interfacing with the parking terminal device(s) 701, among other things. At least one type of advertising area(s) 709, and location(s) are provided in and around the parking terminal device(s) 701 for any purpose(s).

At least one type of parking terminal device(s) 701 can identify the Airport 707 name, and date/time 704 for added convenience to user(s). At least one type of parking terminal device(s) 701 can include at least one type of removable media 702, scanning feature(s) that allows the user(s) (picking up parties) to review, collect, download, save, delete, all types of data, and information. This particular feature can be designed for user(s) in the parking area(s) any such types of parking ticket(s) items for facilitation and payment of parking fee amounts.

At least one type of parking terminal device(s) 701 can be located at entry, exit, and other points of parking area(s), whereby at least one type of parking terminal device(s) 701 can provide an identifiable parking ticket, and even a person, or object device (after the pick up party enters some basic information, preferably by touch screen), to be placed on the dash of the vehicle, whereby when the vehicle parks at any designated parking spot location, readers, scanners, and other types of sensing devices can be placed around a designated parking spot can automatically read, scan, sense, or other the parking ticket, person, object, and identify the pick up party, its parking location, and link the information to provide to the specified passenger(s) at airport terminals inside airport location(s) where to locate the pick up part(ies) waiting in the parking area(s).

At least one type of information entered by a pick up party prior to entering the parking area, and/or after entering a parking area by going to a parking terminal device(s) 701, will identify who the pick up party is intending to pick up, and provide this information to the passenger(s) at the airport terminal units. At least one type of pick up party(ies) are able to modify, update, and change such information at any time, from any parking terminal device(s) 701, including the location that the pick up party will be waiting, if other than at the identified location of the vehicle—such as an meet and greet area, and/or retail location such as a coffee shop in and around the parking area(s).

At least one type of pick up party can equally be provided by, at, or near by at least one type of parking terminal device(s) 701; such as a duel, or multiple and/or detachable parking ticket, a portion to be left on the dash of the vehicle to identify the location, and parking spot of the vehicle, and a portion that the pick up party can bring with them if they leave their vehicle to go to a meet and greet area, and/or retail shops area(s). At least one type of system can (automatically) identify the location of the vehicle, as well as the location of the pick up party, wherever they are located in and around a parking area(s), and automatically update and provide this information to the passenger(s) when inquiring such information (in an airplane, and/or airport area(s), such as gate areas, baggage claim areas, retail areas, and any other locations in an airport.

At least one type of parking terminal device(s) 701 can be designed and configured taking into account capturing quantity limitations, piggybacking content information, recipient identification means whether cryptic/non-cryptic, compression/decompression related content using analog, digital, or analog to digital conversion interfaces, digital modulation techniques to squeeze more bandwidth onto a single transmission, protocol translation processing, modulation/demodulation means, satellite transmission interfaces and wireless transmission interfaces, and related means necessary to initiate primary control points between where the information is located, and the identified recipient of the requested information.

FIG. 8 is a general diagram showing a preferred method for at least one type of device, such as adhesive based, with a preferred form factor of a 'sticker device' as a preferred embodiment to the present invention, (or other device providing similar in nature, and function, features could look like), and its interaction with its environment in and around an airport, airplane, aviation environment, or any other type of environment would achieve the same similar objective(s) whether in whole and/or in part.

At least one type of adhesive based object 801 could be comprised of at least one type of material, substance, comprised of any shape, size, color, function, configuration, and can be substituted, modified, exchanged, re-arranged, re-configured, and/or re-designed for providing, and/or achieving variations with similar results.

At least one type of adhesive based object 801 could can include a visual verification techniques 805, such as red area, and green area, (the preferred method), for facilitating visual confirmation(s) to multiple events, tasks, parties, people, personnel, hardware devices, systems networks, and confirmations that can be applied to at least one type of adhesive based object 801 in unlimited situations, and environments, including but not limited to confirmation that at least one type of adhesive based object 801;

(a). is activated, and functioning properly, (b). whether anyone or anything is allowed in any type of satellite area and/or allowed through any type of security check point, (c). whether a user has their own carry on baggage with them (or another travelers bag(s)), (d). whether the passenger in the right terminal at an airport, (e). whether a passenger, baggage, luggage, or other items have been properly checked in at an airport, (f). whether a passenger has the right checked-in luggage when leaving a baggage claim area, (g). to inform checked luggage handlers whether any given checked luggage item is properly being loaded onto the correct departing airline, unloaded to the proper baggage claim carousel area, whether and how many baggage has been loaded and unloaded onto baggage handing vehicles that operate between the airplane and terminals, whether any checked baggage has gone through proper security screening and detecting machinery and apparatus, (h). automatically provides to any passenger all types of data, and information from at least one type of hardware device, such as the terminals identified in FIG. 5, and FIG. 7 in and around an airport, and/or airplane, such as;—

(i) estimated time for departure for their flight, (ii) estimated departure for delayed flights, (iii) which baggage claim carousel to get their checked in luggage from, including accessibility to authorized travelers, and/or inaccessibility to all non-travelers of that particular flight, or travelers who did not have any checked-in luggage to be collected at the destination of a particular flight, (iv) what is the estimated time of arrival for their baggage to arrive at the carousel, (v) check to see if the party picking them up has arrived at the parking area yet if so, providing parking floor, parking spot number, and map how to get there, in some cases providing the location of the pick up party if not waiting at the vehicle (such as an meet and greet area, retail establishment in and around the parking area), (vi) ordering a taxi, limousine, shuttle bus, and/or all other types of ground transportation, (vii) providing all types of value added services, and message center services, including voice, data, and other information services that can be sent out by the traveler (s) to other parties inside, and/or outside of the airport area.

At least one type of adhesive based object 801 can be constructed to include at least one of the following items, such as power resources 809, at least one type of conductive material 806 which is designed to easily break it's connection cycle upon any party from removing any type of adhesive based object 801 from a person, and/or object.

At least one type of grid based conductive material 807 can tie all other elements of the adhesive based object 801 performs and creates a complete cycle for power resources, communications, inputs, outputs, software applications, microprocessors, sensing capabilities or other processes data and information as part of or in addition to any type of adhesive based object 801, as well as the conductive material 806.

At least one type of adhesive based object 801 can be constructed to no longer function, or purposely reflect, transmit, signal, or provide an invalid reading, notification, identification, or other. Non-functioning adhesive based object 801 can trigger other parts of the system that identifies these parties, objects, or other throughout an identified area, such as an airport, airplane, parking area, baggage handling area, tarmac, building areas, or other. Non-internal power based adhesive based object 801 design can be deployed to achieve one in the same effects, and events.

At least one type of adhesive based object 801 can be placed on an object, such as a baggage device on, over, or around the opening or zipper portion, or behind the closed zipper on the teeth portion, such that if in the event any party were to attempt to open the baggage, the preferred embodiment adhesive based object, such as in the form of a sticker, when removed, will break the small and thin grid based conductive material, which in effect invalidates the sticker device. Any party including baggage handlers, passengers, or inspectors can see that the baggage has been tampered with during the checked-in baggage process.

At least one type of microchip 811 and/or microprocessor can be designed to acknowledge any type of event, and begin providing any type of validation and/or invalid identification code and other related information. All types of data and information can be acquired through various types of scanning, reading, recognition, and other types of techniques.

At least one type of adhesive based object 801 can include any type of microchip 811 and/or microprocessor to facilitate a multitude of functions, including (but not limited to) storing of a predetermined code, algorithm, software application, operating system, command or command sets, sensor or sensing capabilities, or like kind and can provide a unique identifiable reference for each particular and unique adhesive based object 801 from another.

At least one type of antenna 812 can be utilized to enhance communications capabilities, among other things. At least one type of code, algorithm, software application, operating system, or other means can be utilized to identify at least one type of microchip 811 and/or microprocessor and or adhesive based object 801 which can identify at least one unique passenger, traveler, airport personnel, airlines personnel, luggage bag, or other object, and/or any other party in and/or around an airport, airplane and at least one user, recipient, network, provider, system, hardware device, software application, middleware, operating system, sensing techniques, or other technologies for referencing such detailed information from or to at least one type of local and/or remote data storage center in and around an airport, airplane, or any other environment.

At least one type of adhesive based object 801 can include any type of visual verification techniques 805, to confirm working order, malfunctions, defects, removal by any party from its originally placed or designated location (such as a person, a checked in luggage, carry-on baggage, or any other moving, and/or non-moving objects) in and around an airport environment, or other environments.

At least one type of adhesive based object 801 can include any type of visual identification (a) 802, such as the airlines traveling on, visual identification (b) departure airport name, or arrival airport name, to name a few examples, and/or advertising area 804 for retail shops or discounts at airport shops.

At least one type of visual identification 802 or 803 means, are in addition to the massive amount of information that is being collected discretely and without any person, or object knowing any type of data, information, tracking, and data collection is being done in real-time with any and all people, and objects that enter and/or exit any type of identified area.

At least one type of adhesive based object 801 can include at least one type of sensor, micro-sensor, or other types of sensing capabilities 808 that can sense the pulse of at least one person, traveler, airport personnel, airline personnel, or any other person. These sensing capabilities can also monitor body heat, sweat or perspiration of at least one person.

Other types of sensors can be added to at least one type of adhesive based object 801 that was specially designed for placement on airport, airlines, and aviations objects, and persons', such as checked or carry-on luggage that senses identifiable material that wishes to be identified by say an airport, airlines, FAA, TSA, or intelligence agencies. An advantage to this particular sensing example is that it would allow and/or enable a sensor to accompany a checked or carry-on luggage throughout its entire travels, which gives a sensor more time, in cases where slow particle seepage occurs, or may occur.

At least one type of sensing capability 808 can be designed and configured with specialized application software that processes such types of data and information, in this particular design, back through the grid based conductive material 807 to the microchip 811 or microprocessor, which then takes such data and information and processes it in accordance to software applications or other techniques, such as sending, remitting, transmitting, or providing such data and information through at least one type of antenna 812 that is then picked up, received, collected by external sensing, or reading devices.

At least one type of device can utilize localized power resources or non-localized power resources for achieving one in the same objectives. Other less desirable configurations and methodologies that are contact based utilizing at least one type of physical contact point can equally be utilized for achieving one in the same for transferring data back and forth, however does not provide wireless tracking capabilities.

At least one type of external sensing, or reading devices can then process such types of data and information at local and/or remote data centers, locations, and systems to name a few. If at least one type of antenna 812 is not utilized in any particular design, adhesive based object 801 can be designed and configured that would be read, scanned, or interpreted by external sensing, scanning, reading, or other technique devices for collection and processing such types of data and information.

At least one type of adhesive based object 801 can be designed and configured to provide the same functions, features, and capabilities as identified in FIG. 1 airline ticket device(s).

At least one type of pressure sensitive seal 810 that goes around at least one type of adhesive based object 801, which forms a solid seal on any type of surface, such as the back-side of a persons hand, and also ensures that if the adhesive based object 801 were to be prematurely taken off a person, object, or other, such an event would break at least one portion of the sensor, micro-sensor, or other types of sensing capabilities 808 causing the adhesive based object 801 with an invalidation signal to any external sensing mechanisms. Such an event can be picked up in any environment, whether stationary, or in motion, and receipt of such signal invalidation can trigger the support infrastructure systems network and specialized software to immediately notify at least one party, providing its exact location, as well as at least one portion, or the entire file on that particular person, object, or other in the process.

The above is intended, along with the drawings, to illustrate the preferred embodiment of the invention within the airport, airlines, and aviation environment, or other environment. Those skilled in the art will be able to devise numerous arrangements, which although not explicitly shown or described herein, embody the principles of the invention and are within their spirit and scope as defined by the above claims and apply such to any vertical market, or need.

FIG. 9 is a block diagram consisting of a preferred methodology for a theme park, or amusement park, a tourist location, or other environment illustrating at least one configurable design functioning in such an environment.

As with most theme parks, amusement parks, or tourist locations, visitors typically pay for admission and are given a receipt of such purchase, traditionally a paper printed ticket or receipt that allows the visitor entry, or a casino environment, where a visitor typically does not have to pay admission, nor are they given a receipt, ticket, or other utilized for entering an defined location, area, location, building, or other.

With the described techniques and methodologies, a visitor would go through an ENTRY of a theme park, amusement park, or tourist location, (whether payment is made or not, or whether a ticket or receipt is issued or not), the preferred embodiment is to issue a BRACELET to the visitor in the form of their receipt or ticket, (other forms, styles, shapes, and objects, such as stickers, necklace, pendent, or other design than a bracelet can be utilized to achieve at least one of the advantages identified hereto).

Upon issuance of a BRACELET, STICKER, or other, that can provide at least one type of service, feature, identification, profile, or other can be added, linked, or included at this time, including external items such as a photo of the visitor, name information, password, credits, discounts, and other for the visitor.

This USER PROFILE would typically be facilitated by a ticket sales person, or an automated terminal for the visitor by simply asking them a few questions. An alternative, and preferred methodology, is for the visitor to walk up to a touch screen user terminal to establish their own unique USER PROFILE themselves.

To do so, the visitor would walk up to an information terminal to key in their own unique information. The terminal (similar to FIG. 2, 5, or 7), having a coupled reader would be configured with a read range such that would read a BRACELET, STICKER, or other unique identification comprised within it microchip and/or microprocessor (shown in FIG. 1 item 107), or (shown in FIG. 8 item 811).

Figure 10:
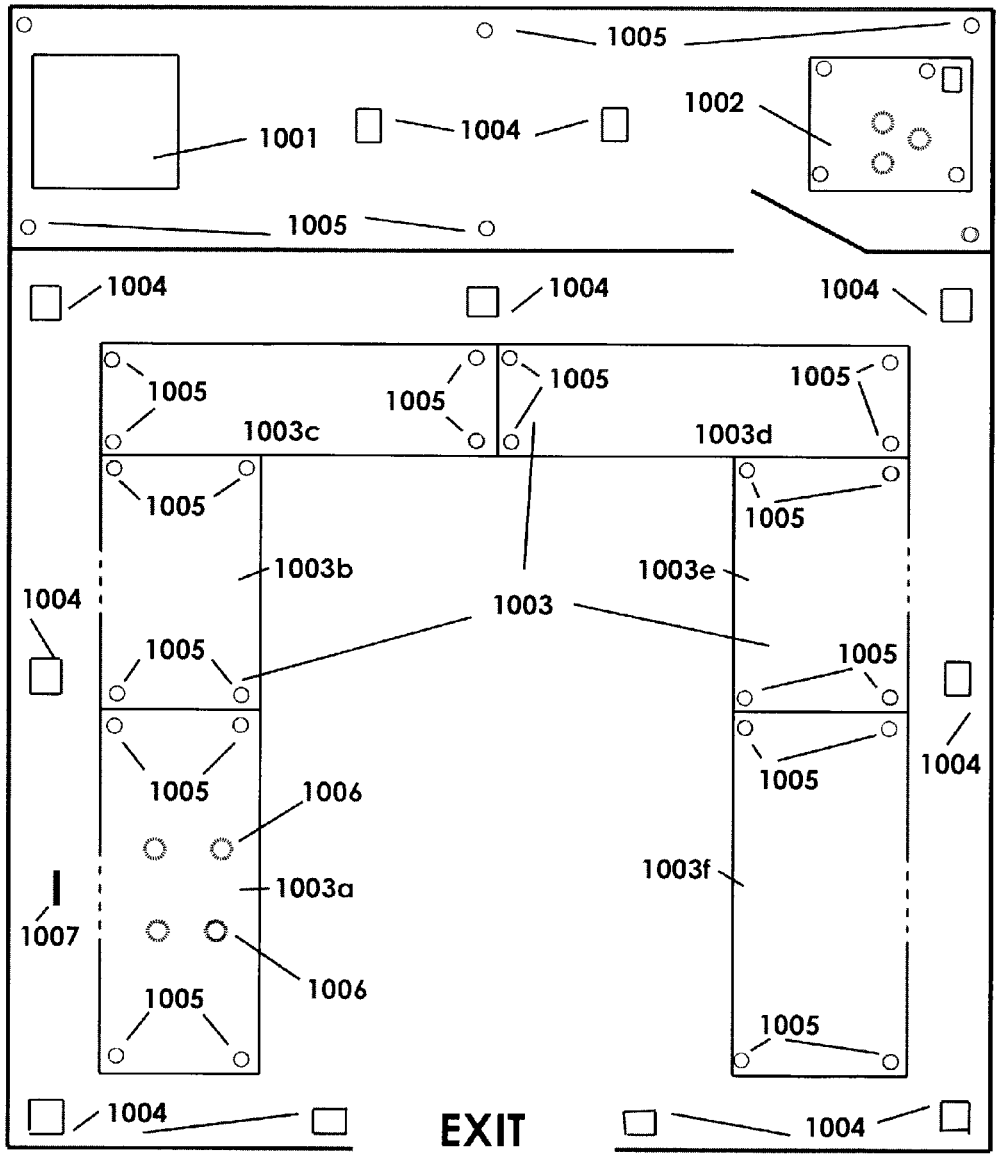

FIG. 10 is a block diagram consisting of a preferred methodology for a jewelry shop, or other environment illustrating at least one configurable design functioning in such an environment.

At least one type of jewelry shop can utilize at least one type of configurable reader 1004, as well as the use of at least one type of antenna 1005 to monitor, track, and provide a host of functions to at least one user.

Typically, a jewelry shop stores its merchandise, including rings, bracelets, watches, pendants, ear rings, loose stones, diamond papers with various merchandise inside, to name a few, in at least one safe 1002. The merchandise 1006 is typically taken out of the safe in the morning and placed in at least one type of showcase 1003 (1003*a, b, c, d, e, f*). The jewelry shop needs a way in which to facilitate inventory control inside of the safe 1102.

At least one type of jewelry shop needs to know and/or log as and when each piece of merchandise is taken out the safe, they need to know that it was put in at least one showcase, they need to know where it is located within at least one showcase 1003, who (which employee) took the merchandise out of the showcase 1003, when, from which showcase 1003, for how long, where the merchandise 1006 is located while outside of the showcase 1003, when it is placed back into the showcase 1003, where it is now located in the showcase 1003, if it was placed in a different showcase 1003*a,b,c,d,e,f*, if it was placed in a different location within the showcase 1003, who placed it back into the showcase 1003, when this occurred, when each piece of merchandise 1006 is sold, when each piece of merchandise is taken out of each showcase 1003, how long it takes for the piece of merchandise to be placed back into the safe 1002, or if it is even placed back in the safe 1002 at all, by whom, tracking all sold merchandise 1002 out of the premises, and more.

At least one type of reader 1004, and/or antenna 1005 can be placed inside and/or outside of the showcase(s), the safe 1002, as well as in and around a jewelry store facility, including the front showroom area, as well as the back office area.

At least one type of type of identifications tag 1007 can be worn by at least worker, such that would identify the worker upon interacting with a respective piece of merchandise 1006, with a safe 1002, with a showcase 1003.

At least one type of type of configuration can include a baseline system that only tracks such types of tags in the safe 1002, and showcases 1003. A more advanced system can track in the building facility, and a more advanced system can log all such types of data and activities into a central computer system 1001.

Whereby such computer system 1001 can receive such types of data and information in real-time, providing time, audit, attendance, inventory control, theft prevention, monitoring, tracking, and other useful information that can be established and configured in at least one type of OS, software, or other. Such computer system 1001 can also be configured with at least one type of camera that can input a photo of each piece of merchandise, as well as at least one field for entry of related information, specifications, and even time of sale, by which sales person 1007, and more. Such computer system 1001 can equally be configured to communicate with at least one external location. At least one type of system can include a siren (not shown) if audible notifications are required.

At least one type of computer system 1001 can, as an example, send data and information to the owners remote hardware device, such as mobile cellular phone, PDA, pager, or other based on information that the owner wishes to receive, such as which worker 1007 takes which item out of which showcase 1003, when and whether the merchandise 1006 is placed back into the showcase or sold, when each item is sold, and total dollar amounts, total dollar volume sold by each sales person/worker 1007, confirmation that all merchandise 1006 that was taken out of each showcase 1003 was placed back into the safe 1002 providing inventory control count, so that the workers 1007 can go home at the end of the day, and more.

The identification apparatus that is coupled to at least one type of merchandise 1006 (now shown) can equally detect if in the event a worker or customer tries to take such apparatus off of a piece of merchandise, or walk out of the jewelry shop without paying for the merchandise.

Figure 11:
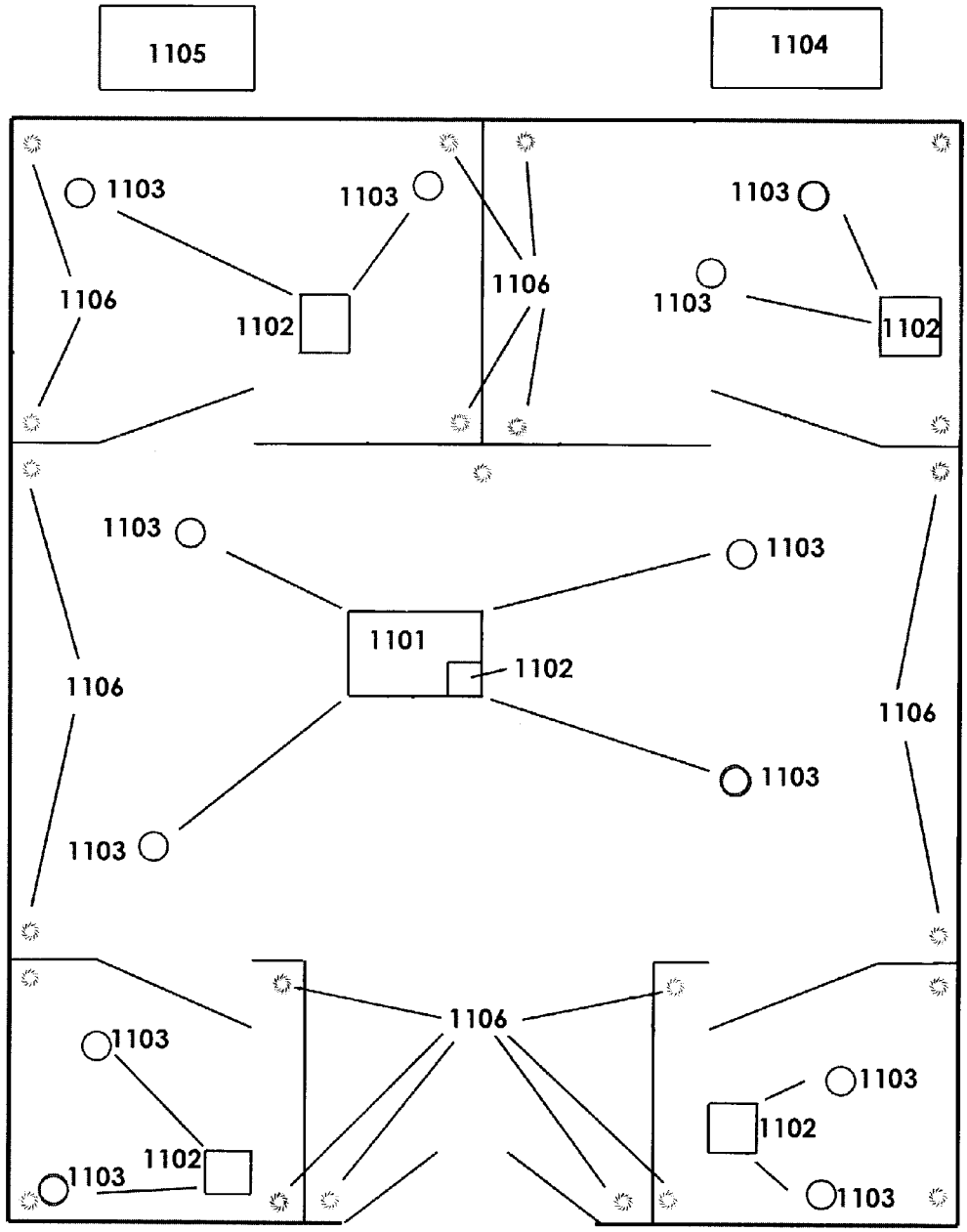
FIG. 11 is a block diagram consisting of a preferred methodology for use in a building security system, or other environment illustrating at least one configurable design functioning in such an environment.

FIG. 11 is a block diagram consisting of a preferred methodology for a building security environment, or other environment illustrating at least one configurable design functioning in such an environment.

At least one type of building security control panel unit 1101 is integrated and/or coupled with at least one reader device 1102, with the preferred embodiment utilizing a coupled ASIC chip reader to the building security control panel unit 1101. Such reader device(s) 1102 reads a plurality of identification tags (now shown) that are coupled to various objects 1103 that are in a quantifiable area, such as a building. In small areas, the coupled reader device can directly communicate with such types of identification tags (now shown) that are coupled to various objects 1103. In larger areas, at least one type of antenna 1106, and/or at least one additional reader 1102 disbursed to principally expand such coverage area(s).

In the preferred embodiment, additional reader devices 1102 can be placed to control a specific floor area, and/or unique room area. These reader devices that have been placed in a particular expanded area, can function as a stand alone device, can function to collect and process data and information back to at least one type of building security control panel unit 1101, and/or can function with at least one antenna 1106 to enhance is functionality.

At least one type of building security control panel unit 1101 can be tied to at least one type of (CMS) central monitoring station 1104 by wired and/or wireless means. At least one type of (CMS) station 1104 can be configured with at least one type of hardware device, software, and other related equipment. At least one type of (CMS) station 1104 can process at least one type of data, and/or information to at least one other party, such as communicating with a building owner 1105, such as to a cellular phone, pager, PDA, telephone, email, and/or other communications means.

As with most building security systems, a central control panel is utilized to tie various types of wired and/or wireless sensors, such as motion, smoke, heat, door, window, infrared, and alike, which is also comprised of a siren. Some more advanced systems are tied by wired and/or wireless means to a (CMS) central monitoring station.

These systems can detect a break in by an unauthorized party from these types of disbursed sensors. However, such systems are not able to detect movement of objects that have a form of identification tag, whereby if in the event the object, such as a vase or work or art moves from its fixed position, moves out of a quantifiable area, such as a room, or building area, such a building security system can detect such an event.

Key Advantages—Applied to an Airport Environment

1. A method(s) and means for providing a passenger(s) airline ticket(s) that is coupled with users profile, and whereas such data and information profile can be quickly and immediately be accessible, and/or received by various types of hardware device(s) without the need of a (CPU) central computer processing center in and around airports, airlines, aviation, and/or other environments.
2. A method(s) and means of monitoring constant movements, activities, and whereabouts for every passenger(s) that enters into an airport(s), airline(s), aviation, and/or other environment.
3. A method(s) and means that links, and/or interconnect checked-in luggage, and carry-on baggage through baggage matching systems, and linking them back to a passenger(s) and its airline ticket device(s) and/or device(s) similar in nature, and scope.

4. A method(s) and means for identifying, confirming, locating, monitoring, tracking, continually collecting, and updating at least one type of data and information, including authorizing passenger(s) in and around airports, airlines, aviation, and/or other environments.
5. A method(s) and means for providing data and information to passenger(s) relating to flight information, baggage claim information, pick up party information, and more from hardware device(s) terminals located throughout an airport environment. This information is quickly provided by a passenger(s) simply walking up to a hardware device(s) terminal located anywhere in an airport, airline, aviation, and/or other environment—whereby passenger(s) are automatically identified from their unique airline ticket device(s), which enables the systems to identify and provide unique passenger(s) information with/without interaction by the passenger(s).
6. A method(s) and means for tracking, monitoring, and identifying the exact location of a passenger(s) checked-in luggage, and/or carry-on baggage that enters an airport, airplane, aviation, and/or other environment at any time.
7. A method(s) and means for discretely checking and confirming the authenticity of passenger(s) identities without passenger(s) knowing, and/or requiring providing additional information. Discretely, unobtrusively and without human interpretation checking, monitoring, and tracking activities are facilitated throughout an entire airport, airplane, aviation, and/or other environment at all times, including but not limited to all security checkpoints, gate areas, and baggage claim areas.
8. A method(s) and means for providing to airport, airlines, aviation, security, and/or other personnel real-time data and passenger(s) information to all types of hardware device(s). Some such hardware device(s) include communications device(s), handheld hardware device(s), hardware terminal device(s), check-in counter hardware device(s), baggage claim carousel hardware device(s), and parking area hardware terminal device(s).
9. A method(s) and means for identifying the exact location of a passenger(s) at the time of boarding, when they are missing, and not have to utilize (P.A.) announcements that are broadcasted throughout an entire airport environment.
10. A method(s) and means for providing an announcement in the exact location of the passenger(s) informing them that they need to immediately go to a designated gate number, for immediate departure, rather than a random announcement that is made throughout an entire airport environment.
11. A method(s) and means for preventing 'bait and switch tactics' of passenger(s) carry-on luggage(s) items in and around an airport, airplane, aviation, and/or other environment.
12. A method(s) and means for identifying lost, stolen, and/or misplaced carry-on baggage within an airport, airline, aviation, and/or other environment, as well as a method and/or means of knowing exactly when, and where it occurs.
13. A method(s) and means for identifying and preventing one passenger(s) from stealing another passenger(s) carry-on baggage(s).
14. A method(s) and means for preventing 'piggybacking identity techniques' by one party gaining access into and/or through all type(s) of controlled access area by walking behind another who has proper access to enter through.
15. A method(s) and means for providing airport, airlines, aviation, security, and/or other personnel to utilize hardware device(s)—whether stationary, and/or mobile—to locate the exact position(s) of a passenger(s), if the passenger(s) does not respond to any type of announcement, and/or if for any reason a passenger(s) needs to be located.
16. A method(s) and means for providing airport, airlines, aviation, security, and/or other personnel to locate the whereabouts of a passenger(s) carry-on baggage(s).
17. A method(s) and means for knowing when/whether a passenger(s) leaves their carry-on baggage anywhere in an airport, airline, aviation, and/or other environment, and walks away from their carry-on baggage(s). Variable distance settings can be set, modified, adjusted in operational environment(s) depending upon a multitude of variables and inputs.
18. A method(s) and means for informing airport, airlines, aviation, security, and/or other personnel when a passenger(s) is separated from their carry-on baggage(s), and/or directly and immediately informing the passenger(s) if they are more than a certain specified distance from their carry-on baggage in such an environment, audible response can immediately be triggered.
19. A method(s) and means for providing boarding gate personnel to quickly identify each passenger(s), and corresponding carry-on baggage(s) when boarding an airplane, without the need for showing photo ID cards, and/or other information that has to be shown by passenger(s).
20. A method(s) and means for checking to see if a passenger(s) is carrying their own carry-on baggage(s) onto the airplane, or a baggage that is not theirs, but rather another passenger(s).
21. A method(s) and means for identifying each and every passenger(s), and carry-on baggage(s) that enters an airplane to confirm all are accounted for, without an airline personnel manually facilitating a head-count of each passenger(s), and carry-on baggage(s) one at a time, and/or counting passengers printed airline passenger tickets, and/or checking their printed airline ticket to see if any and all passenger(s) are sitting in their designated seat, if seat assignment is utilized by a particular airline(s), or even if seat assignments are not utilized.
22. A method(s) and means for utilizing hardware device(s) that can identify passenger(s) within an airport, airline, and/or aviation system as they move, and/or travel about, and keeping a data record on passenger(s) movements and activities, which can be accessed by any hardware device(s) that are operated by all types of airport, airline, aviation, security, and/or other personnel.
23. A method(s) and means for providing passenger(s), and carry-on baggage file logs that confirms all passenger(s), and corresponding carry-on and checked in luggage has been loaded into the airplane, whether in the passenger area, or in the under belly of the airplane, and providing a final confirmation list to this effect.
24. A method(s) and means for identifying the exact location of a unique passenger(s) checked-in luggage(s), and/or carry-on baggage(s) in and around an airport, airline, aviation, and/or other environment for various reasons including cases where a passenger(s) does not show up and board an airplane, and their checked-in luggage needs to be located quickly, and removed from the under belly of the airplane, so that the airplane can depart on schedule, and in particular knowing which metal container that may have been loaded into the underbelly of the airplane and which of the dozens of baggage is the correct one for immediate removal, without delaying the flights departure.
25. A method(s) and means for monitoring and keeping track of the movements, and activities of passenger(s), and/or carry-on baggage within an airplane during its travels.

26. A method(s) and means for interconnecting airports, where upon a passenger(s) landing, and entering into another airport, and/or airplane environment, similar systems can continue monitoring, tracking, and providing passenger(s) information to them until a passenger exists the system.
27. A method(s) and means for enabling passengers to quickly check the status of their checked-in luggage(s)—providing ETA information, and carousel location information, and message center information, and other information from various hardware device(s) terminals located throughout an airport, airplane, and/or aviation environment.
28. A method(s) and means for preventing a passenger(s) from walking up to a baggage claim carousel, and walking away with another persons, and/or passenger(s) checked-in luggage bag(s). A method and means of informing a passenger when its baggage starts to come out of the baggage claim carousel, such as audibly, and/or visually providing users name.
29. A method(s) and means for prohibiting non-passenger(s) from entering a baggage claim carousel area, and walking away with a passenger(s) checked-in luggage bag(s).
30. A method(s) and means for matching up a passenger(s) with their checked-in luggage(s), confirming it is indeed theirs, prior to leaving a respective baggage claim carousel area.
31. A method(s) and means for providing information to passenger(s) related to pick up party, and the parties vehicle location, and/or their physical location (such as meet and greet, retail tenant locations, or alike in the airport and/or parking area).
32. A method(s) and means for providing a pick up party with a means of identifying themselves to a passenger(s) they are picking up, leaving them information to be retrieved, and/or for the arriving passenger to identify and contact the pick up party while still on an airplane, and/or in an airport.
33. A method(s) and means for tracking a pick up parties vehicle upon entering a parking area, to a designated floor, and parking spot location, including driver(s) location if other than the vehicle (such as a meet and greet, and/or retail location), identifying, and providing location information to passenger(s) in the airport area, including map directions and other information how to get to the driver, and/or vehicle.
34. A method(s) and means for enabling passenger(s) to book ground transportation from an airplane, and/or airport environment, (including taxi, limousine, shuttle bus, and alike).
35. A method(s) and means for preventing non-passengers from entering an airport environment, and keeping non-travelers outside the airport, at parking areas or other areas to reduce security threats.
36. A method(s) and means for providing city, travel, and/or tourist information to passenger(s) from any type(s) of hardware device(s), to make their visit a more pleasant one.
37. A method(s) and means for interconnecting and sharing passenger(s) system information of all types by and between airports, airlines, and external entities (such as intelligence agencies) in a cohesive fashion.
38. A method(s) and means for providing airport, and airlines systems to be integrated into intelligence agencies database information providing and notifying immediate information on passenger(s) who are entering into the aviation systems and networks.
39. A method(s) and means for providing handheld hardware device(s) that can detect and identify passenger, airport, and/or airlines personnel's information by simply querying such information, by aiming, and/or pointing it at a particular party(ies), and/or a party(ies) physically moving close in proximity to stationary hardware device(s), and/or communications device(s) that scan party(ies) for identification and receiving, and/or pulling up related data and information.
40. A method(s) and means for passenger(s) to more quickly find out information about their flight(s) rather than from currently utilized TV monitors that are often confusing, and difficult to see, view, read, and locate information that the passenger is looking for. Hardware device(s) terminals within this documentation makes it so easy for passengers to receive such information, by simply walking up to a terminal, and that's it. Data and information can be provided in visual and/or audible means, automatically detecting which language to present such information, and more. Such terminals can equally be further operated by speech-recognition means, voice-print authentication techniques, and more.
41. A method(s) and means for providing singularly based information, broadcast based to multiple users, and/or can be piggybacked with additional information onto the primary content information via split spectrum, and/or duel spectrum techniques and methods.
42. A method(s) and means for providing passenger(s) information automatically from an active local, and/or regional location from at least one data delivery contact point, to at least one user(s) recipient data delivery contact point, whether analog and/or digital types of formats, via any type of wired, wireless system, and/or inversely combination thereof.
43. A method(s) and means to request specific type(s) of data and/or information thru an active local, regional location, and/or sole source non-networked location, from at least one data delivery contact point, to at least one user(s) recipient data delivery contact point, whether analog and/or digital types of formats, via any type of wired, wireless system, and/or inversely combination thereof.
44. A method(s) and means that allows for variation depending upon the way in which data and information on each passenger(s) has been made, formatted, saved, and/or set up, the preferred method of delivery system or network that the provider wishes to use, the speed, path, bandwidth allocation, protocol format selected to be used, timing in presentation of passenger(s) information, the type of content that is most preferred to provide such a service to user(s) of any hardware device(s), and various type(s) of authorization forms, and/or formats any party wishing to utilize in accessing such information.
45. A method(s) and means for providing by some method or means, which can detect and know which/when to transmit various type(s) of passenger(s) information, whether manually, and/or automatically being requested to be viewed, and enabling the proper intended content to be seen and/or viewed by any type of hardware device(s) to be identified so that the correct or proper passenger(s) content and information can be provided for viewing, among authorized users, before, during, and/or after any type(s) of access control processes, and/or procedures are facilitated.
46. At least one method and/or means of identification to ensure the specified passenger(s) information and content required by any type of hardware device(s) is delivered to the requesting, and authorized part(ies).
47. A method(s) and means for utilizing an airline ticket device(s) that enables a system to identify each and every unique passenger(s) anywhere in and around an airport, airline, aviation, and/or other environment, which also allows such a system (and all those who access such information) to be provided with any and all information on a passenger(s) utilizing such an airline ticket device(s), or device(s) that achieves a similar objective(s), for providing identification information on passenger(s) including photo identification, name, address, and other identification information, airline traveling on, flight number, gate of departure, time of departure, number of checked-in and carry-on baggage(s)—including their current precise location(s), and other passenger(s) information that can be added by any party, at any time.

48. Any type of intended transmission method, and or multiple methods can be utilized and set up by the system, and/or hardware device(s) operator for receipt of passenger(s) of all types of information and formats, including single, dual, and/or multiple spectrums.

49. A method(s) and means for allowing passenger(s) information to be selected and/or elected to set specific requirements, limitations, specifications, and additional information and/or content as part of and/or in addition to the primary ways, means, and methods for hardware device(s) operators to receive various types and forms of passenger(s) information, whether using passenger(s) airline ticket device(s) as the primary triggering mechanism, and/or other form(s) of accessing one in the same similar in nature information.

50. A method(s) and means for electing to identify each hardware device(s) operator(s) (sender and/or recipient) for approval prior to actively and/or passively transmitting, sending and/or receiving passenger(s) information by an automated response to a passenger(s) airline ticket device(s), direct and/or indirect communications from hardware device(s), and/or a querying party through other methods.

51. A method(s) and means for reconfirming the authenticity of a passenger(s) that are accessing hardware device(s) terminals, to ensure the privacy, and security of such information is maintained at all times. Such forms of information can be view only, can store such information temporarily in RAM/ROM such as a cache, and whereas the cache is deleted every so many minutes, or can be stored onto internal, external, and/or removable media.

52. A method(s) and means to limit how much, how long, and/or number of times passenger(s) information can be accessed and/or viewed by any related hardware device(s) operator(s).

53. A method(s) and means to limit passenger(s) information to be viewed only, and/or saved, forwarded, or allowing hardware device(s) operators to add information to a passenger(s) profile.

54. A method(s) and means for limiting by quantity, number, type, classification and/or hardware device(s) operator user(s) preferences that can limit, and/or control how much of the passenger(s) information can be accessed and/or viewed by such hardware device(s) user(s). Partial information may only be accessible to airport personnel, while other portions of passenger(s) information may be accessible by airlines personnel, and yet other portions and/or combinations of passenger(s) information may be accessible by airport security personnel, as well as all other types and/or categories of parties.

55. A method(s) and means for providing passenger(s) information to hardware device(s) that have the capabilities of checking the status (year, month, day, and/or time) that the passenger(s) and its possessions (luggage, and baggage) is allowed access, and to be in an airport, airlines, aviation, and/or other environment(s), whether from a passenger(s) airline ticket device(s), luggage bag identification device(s), and/or airport, airlines, aviation, and/or other environment database systems, networks, and device(s), and generating a log of such.

56. A method(s) and means for identifying passenger(s), and/or luggage/baggage who/that are not authorized, and/or allowed access to an airport, airline, aviation, and/or other environment.

57. A method(s) and means for electing to only allow specified hardware, software, accessories, and/or packet based and/or circuit based systems to access, view, and interact with all types of passenger(s) information.

58. A method(s) and means for monitoring the activities of any and all airlines, airport, and aviation personnel's, including time, audit, and attendance, monitoring, tracking, profiling, logging, and more until they have exited such an environment.

59. A method(s) and means for electing to allow only one device/network, or unlimited number of device(s)/networks to be utilized in accessing passenger(s) information, whether it be at the same time, and/or at different times.

60. A method(s) and means for utilizing any related type(s) of testing, and confirmation method(s) for ensuring all authorized, and/or related passenger(s) information and content has been sent out and indeed received by a hardware device(s) operator(s).

61. A method(s) and means for auditing and logging the activities of each hardware device(s) that accesses, receives, and/or interacts with any passenger(s) information, content, and/or other network information.

62. A method(s) and means for providing access control feature(s) to any hardware device(s), including but not limited to biometrics, user name and password information, scanning, detecting, and authentication techniques, voice-command and/or voice print recognition, varying frequency spectrum fields to name a few.

63. A method(s) and means for utilizing any related type(s) of peer-to-peer techniques and/or method(s) for automatically updating more than one hardware device(s), and/or content delivery device (communications) device(s) as and when any modifications, additions, and/or updates are made on any individual device(s) such that will be updated throughout all such hardware device(s), and/or communications device(s). In utilization of such a system, a (CPU) central computer-processing center is not required. Although there are multiple advantages to such a system enhancement, one of the primary advantages is to speed up the time in which passenger(s) information is provided to hardware device(s) user(s) triggered by various means and methods.

64. A method(s) and means for providing network information, whether only provided in a particular location of a particular hardware device(s), and/or communications device(s), and/or operator(s), and/or accessed by hardware device(s) user(s) from any location in and around an airport(s), airline(s), aviation, and/or other environment can be changed, modified, updated, scheduled directly on any particular hardware device(s), and/or communications device(s), and/or can be sent out from a primary storage location(s) to any particular a particular hardware device(s), and/or communications device(s), and/or all specified device(s), more than one. Any type of passenger(s) information can thus be received, modified, and/or updated at anytime by any type(s) of hardware device(s), and/or communications device(s).

65. A method(s) and means for configuring such a system to only transmit, provide and/or send out passenger(s) information if in the event there is a discrepancy noticed by the system, and/or upon triggered by a passenger(s) airline ticket device(s), and/or requested by an authorized, and/or unauthorized hardware device(s), either at a stationary location(s), and/or as the operator of a hardware device(s) travels around an airport(s), airline, aviation, and/or other environment(s).

66. A method(s) and means that enables communications connections by and between any system where passenger(s) information is located, if it is not already contained within a hardware device(s) to keep its connection by seamlessly transferring and maintaining such communications connection through another communications device(s) that will pick up and/or continue providing any and all information to the hardware device(s) operator, no matter how many times the identified hardware device(s) moves from area to area of an airport(s), airline(s), aviation, and/or other type of environment(s).

67. A method(s) and means for continually transmitting all related passenger(s) information all the times, whereby hardware device(s) operator(s) only receive specified content based on their proximity to such form and/or forms of information.

68. A method(s) and means of selecting single and/or multiple ways and methods of wired and/or wireless platform(s) for accessing, viewing, and interaction with any and all types of passenger(s) information to be provided to any type of configurable hardware device(s).

69. A method(s) and means for allowing hardware device(s) operator(s) to search, view, interact, send, receive, log, delete any and all type(s) of information, thru interaction of any form(s) of identification apparatus, non-networked, and/or networked platforms.

70. A method(s) and means that identifies passenger(s), passenger(s) property(ies), and/or passenger(s) information to ensure authenticity and the prevention of copying, modifying, and/or misinformation of such information by the operators of hardware device(s) of various type(s), design(s), and configuration(s).

71. A method(s) and means that allows passenger(s) to access, view, receive, save, download, share, exchange, modify any and all type(s) of information from various type(s) of hardware device(s) in and around an airport(s), airline(s), aviation, and/or other environment(s).

72. A method(s) and means that utilizes various forms of controlled access levels to identify, limit, allow, authorize, and control hardware device(s) operators to various locations of passenger(s) information, that can be set up based on various configuration(s), frequency spectrum(s), platform(s), and/or combination thereof.

73. A method(s) and means that allows hardware device(s) to have interchangeable frequency spectrum, platform(s), protocol(s), configuration(s) unit that is attached, and can be removed from any particular hardware device(s), and which limits, directs, allows accessibility to at least one information storage location(s), and/or accessibility to any and all information storage location(s) of information.

74. A method(s) and means that can be set up to handle various requests on the designated transmission field, and/or platform based on the hardware device(s) operators method of selection to connect and/or interact with the source of passenger(s) information, taking into account possible issues of bandwidth and transmission controls or protocols for either wired or wireless platforms, and depending upon the transmission capability, timeframe, speed, form(s) for viewing passenger(s) information, thus ensuring optimum transmission capabilities that the highest quality viewing of passenger(s) information is maintained at all times by the hardware device(s) operator(s).

75. A method(s) and means that allows a hardware device(s) operator to inform and direct another hardware device(s) operator to the same information that they have on their hardware device(s) as related to any passenger(s) information, and/or other information.

76. A method(s) and means that allows hardware device(s) operator(s) to access remote location information anytime, and can even schedule anything from sending, receiving, reviewing, updating, any information (whether passenger(s) related or not) that the operator(s) has elected to save and add onto a local and/or remote storage network location. Hardware device(s) operator(s) can select and send to themselves and/or any other hardware device(s) operator(s) any such information by scheduling the information in; (i) order, (ii) time, and (iii) location for the information to be provided.

77. A method(s) and means that allows hardware device(s) operator(s) to select and utilize more than one method for delivering information from its (source: wired and/or wireless) depending upon various circumstances that may exist in a specific environment, whereby one particular method is not working, and/or functioning very well, and operator elects to change to another method, in order to continue its communication and receiving any type(s) of information. Some can include changing frequency spectrum, plugging hardware device(s) to a wired platform, inserting removable media, or other accessory(ies) item(s) to name a few.

78. A method(s) and means that allows passenger(s) information to automatically be provided to hardware device(s) operator(s) by simply aiming, directing, pointing, and/or being close in proximity to an airline ticket device(s) that automatically interfaces with specified hardware, software, packet based, and/or circuit based delivery architecture, and/or requiring the hardware device(s) operator(s) to manually request for the delivery of any kind of passenger(s) information, and/or other information through various forms of means such as voice, type, touch, push, turn, or other methods that retrieves and provides the information from any local, and/or remote location(s). Such process(es) can include verification access control protocols, and/or procedure(s) of biometrics, user name, password, voice print recognition techniques, and/or access code(s) to allow information to be viewed.

79. A method(s) and means to allow hardware device(s) operator(s) to forward any and all type(s) of information, and passenger(s) information to a duly requested remote location(s), to other hardware device(s) operator(s), updating passenger(s) information, and/or information. All related information can be accessed by any type of hardware device(s) operator(s) at any point in time.

80. A method(s) and means to that allow hardware device(s), and communications device(s) software, middleware/firmware, and/or hardware identification process(es) to be utilized within the passenger(s) encoded/uncoded information platform(s). This ensures identification, and approval process(es) are maintained upon interacting with any type of communications device(s), and/or any other type(s) of data storage network location(s) through any type(s) of unique address, network(s), protocol(s), and/or variations thereof 81. A method(s) and means that enable hardware device(s) to be configured for personalized settings by an operator(s). These unique user(s) settings can be built into hardware device(s), retrieved from removable media, entered by the user, acquired from a local and/or remote hardware device, or other means.

82. A method(s) and means to provide control points that can be established for the direction of traffic in the most optimum fashion between passenger(s) information, hardware device(s), and airline ticket device(s) by and to the operator(s). Re-direction of traffic can be facilitated at primary control access points on wired or wireless platform(s) of communications device(s), and information data storage network(s) device(s) level(s).

83. Notification means, methods, and auditing techniques may be deployed to provide confirmation to hardware device(s) operators, as well as a systems storage network(s) for the purpose of tracking all types of information and content, and/or hardware device(s) containing such information, whether or not provided through a wired and/or wireless network(s).

84. A method(s) and means that enable hardware device(s) with automatic sleep mode that conserves energy, power consumption—while not loosing the place where the hardware device(s) was last doing.

85. A method(s) and means that requires hardware device(s) operator(s) to place their finger(s) and/or thumb on a biometric sensor(s) on a continual, and/or random basis for verification(s) to maintain operation of such hardware device(s).

86. A method(s) and means that requires hardware device(s) to scan the operator(s) identification device(s)—similar in design to FIG. 1 and/or FIG. 8—to authenticate operators ability to continue utilizing such hardware device(s). Authentication process can be located within the hardware device(s) itself, and/or externally from local/remote storage network location(s), or communication(s) device(s).

87. A method(s) and means that allows hardware device(s) to notify the operator(s) of any numerable events when occurring via (vibration, audio, visual, and other techniques).

88. A method(s) and means that provides hardware device(s) with wake mode allowing for scheduling events, upgrades, downloads, updates, confirming user audit information, and alike from OS (operating system), browser(s), software updates, modifications, as well as downloading data and information that any person wants to have available outside of the hardware device(s), downloading large files that take time—so that when a unique and/or general hardware device(s) operator(s) next utilize the device(s) the new information will be there. When the work is completed, the hardware device(s) go back into sleep mode until the device(s) is activated.

89. A method(s) and means that comprises of flexible transmission controls of distance, speed, range, method(s) of recognition, engagement, acceptance and approval processes, commencement of transmission passenger(s) information to queried hardware device(s), and/or communications device(s) through the best and optimum means wherein flexible transmission controls can determine frequency band, route, type of device(s) seeking to access passenger(s) and/or network information, as well as the size, scale, time, optimum method(s) for successfully completing any task, request, and/or requirement.

90. A method(s) and means that provides transmission time, speed, route, or protocol format requirements, any compression or encryption techniques, or code modulation requirements in delivering passenger(s) information, and/or other information to the querying hardware device(s), communication(s) device(s), or by means of accessing a wired or wireless network to facilitate these requests.

91. A method(s) and means for automatically providing passenger(s) information, and/or other information in the initial contact and connection or interaction by and between an identification apparatus, and/or passenger(s) property to all types of hardware device(s), whether the information itself can be transmitted directly to the hardware device(s), and/or having to go through at least one communication(s) device(s), and/or date storage network(s) system(s), whereby information of any type(s) can be provided in full, in combination with other forms of information, and/or a series of information added to the primary information being provided.

92. A method(s) and means that provides a reference code, number, algorithm or series of algorithms, digital or non-digital, RF or non-RF, encryption processes—cryptic or de-cryptic in nature, compressed or de-compressed, analog, digital, or conversions to opposite, modulated or demodulated, that ultimately provides a path, routing, or destination where passenger(s) information, and/or any other type(s) of information can ultimately be retrieved, and viewed by any hardware device(s) operator(s), individually, and/or simultaneously.

93. A method(s) and means for automatic translation conversion protocol and techniques based on pre-selected settings on hardware device(s), communications device(s), and/or data storage network(s) location(s), (settings on device can be set up to receive any data in English, German, French, Spanish, Japanese, Chinese, or alike), or inversely, these translation conversion protocol can be set up and facilitated only upon manual selection by the hardware device(s) operator(s), and/or from the data storage network(s) set up electing authorization for preferred format(s) by touch, voice, or other means.

94. A method(s) and means that allows data storage network(s), and/or hardware device(s), and/or communication(s) device(s) to save information of all types internally, externally, or removable memory device(s), by saving, accessing, deleting, exchanging, retrieving, and interacting with a wired or wireless remote network to facilitate these requests.

94. Products and equipment that require voice-command. When an operator utilizes any (i) vehicle having access to the airports tarmac, (ii) securing check point equipment, (iii) weapons explosives equipment, (iv) ticket counter terminal equipment, (v) handheld devices, (vi) arrival and departure gate equipment, and terminals—they must 'first and foremost' insert his/her identification, a central computer downloads his/her 'unique voice print file' (for verification) and only then will allow him/her to control the equipment.

95. At least one method and means of activating a device, such as in the form of a bracelet as provided in FIG. 1, or in sticker form as provided in FIG. 8 of this present invention.

96. At least one method and means of invalidating a device, such as in the form of a bracelet as provided in FIG. 1, or in sticker form as provided in FIG. 8 of this present invention.

97. At least one method and means of invalidating a device, such as in the form of a bracelet as provided in FIG. 1, or in sticker form as provided in FIG. 8 of this present invention, based on utilization of its power resources, providing a definitive time element.

The object of the invention is to solve one or more of the drawbacks in existing systems, technologies, and networks as related to access, and delivery of virtual content as discussed above, and to also provide other improvements to the art.

Operation Related to an Airport Environment

These preferred method(s) utilize new methodologies, and techniques the creation a system, configuration, platform, structure, or alike that could be applied to an airport, airplane, and aviation environment, such as a security systems, equipment, and networks in relation to such new types of tickets or receipts, such as an airline ticket device(s), and various types of hardware device(s), portable terminal device(s), systems network(s), configuration(s), platform(s), and protocol(s) (and/or other device(s) providing similar in nature, functions, and features), as its means in interacting with, in, and around an environment, such as an airport, airplane, and/or aviation environment.

At least one type of ticket, such as an airline ticket, or other device can be designed and utilized to contain, provide, and/or direct various hardware device(s), systems, and networks unlimited types of information that is being generated, and/or has been generated data and information on any person that enters such an environment. When a visitor, user, and/or passenger(s) enters an environment, such an airport, an airline ticket device(s) is provided by various means and/or methods as determined by an airline(s), airport(s), aviation regulations, and/or system(s) configuration(s).

There are numerable identification configuration methods, and technologies however for the preferred embodiment radio frequency tags are utilized for identifying, tracking, monitoring, reporting, and alike each passenger(s) checked-in luggage bags, carry-on baggage, and/or other objects that will be entering into an airport(s), airline(s), aviation, and/or other environment(s) so that communications device(s) are able to track, monitor, collect, and provide data and information on each unique passenger to a multitude of hardware devices, fixed or portable terminal devices that can be configured to with local and/or remote communications capabilities.

At least one type of airline ticket, or device(s) can provide to at least one type of hardware device(s) of various designs, configurations, platforms, protocols, methodologies, to provide data and information; such as passenger photo identification(s), name(s), address, telephone, age, social security number, drivers license information, airlines the passenger will be traveling on, the flight number(s), and destination city(ies)—or flight itinerary, departure gate, departure time, whether on time, or delayed, passenger air travel history, frequent flier information, the number of luggage bags checked-in, including matching all luggage to each individual, or group of passengers, the number of carry on baggage, including matching such baggage to the passenger by various means and/or methods, traveling alone and/or with another passenger, allowing the ability for at least one local party access to such information, as well as access by remote parties such as intelligence agencies or other type(s) of databases much more.

Although there are numerable ways, means, and methods for achieving on in the same, the preferred method utilized for the creation of a passenger(s) photo identification is on the actual day of the passenger(s) traveling, and preferably facilitated at check-in counter location(s), whether it be an automated machine (such as e-ticketing), or a traditional live airline ticket counter personnel facilitating the check-in process, from any type of camera or other apparatus that can take a picture of the passenger(s), any type of biometric identification, or other means during the check-in process (with and/or without the passengers knowledge). This image, finger print, eye scan, or other means is then automatically converted and saved as any type of file (such as jpeg, gif, or other) and attached to that particular passenger(s) profile information, preferably stored at database location(s) that can be accessed, referenced, recalled, adding information to, on a respective passenger(s) as they are engaged and within an airport environment, and can be forwarded to remote parties at the same time. With such a methodology being put into place, the entire airline(s), airport(s), aviation, and other systems have an up to date and current photo for each passenger(s), airline personnel, airport personnel, or other party that wishes or seeks to enter any type of airport environment. Any type of system can then know what each person looks like on that particular day, what clothes they are wearing, the color of these clothes, eyes, facial feature, make up, hair style, hair color, with or with out glasses, facial hair, and much more. This will allow any and all hardware device(s) operators at identified and various locations throughout such an environment to readily identify, confirm, and/or deny the authenticity of any passenger(s) that has entered the system.

As a passenger(s) moves around an environment, at least one type of airline ticket, or device(s) allows various types of communications device(s) to track and monitor the movements, and activities, and whereabouts of all persons, and all objects (such as a purse, carry-on baggage, or alike) at all times. Data and information is continuously being collected, generated, stored, and communicated to all type(s) of hardware device(s), local, and remote locations. Additional information on each passenger(s) can be discretely collected, and provided to various type(s) of hardware device(s), whether operated by a human, or not.

Samples of such hardware device(s) configurations can include check in counter location(s), curbside check in location(s), roaming security personnel, security check point(s) location(s), arrival/departure gate(s) location(s), retail tenant location(s), airplane(s) location(s), checked in luggage systems location(s), controlled access point(s) location(s), baggage claim(s) location(s), parking area location(s), and much more.

When any type(s) of hardware device(s) comes in range of any luggage bag, purse, or other object, or any passenger, any and all types of identification information can be provided, and/or updated including—passenger photo identification(s), name(s), address, telephone, age, social security number, drivers license information, airlines the passenger will be traveling on, the flight number(s), and destination city(ies)—or flight itinerary, departure gate, departure time, whether on time, or delayed, the number of luggage bags checked-in—and its exact location(s), the number of carry on baggage—and its exact location(s), traveling alone and/or with another passenger—allowing the ability to access the other parties information, access to intelligence agencies and/or other type(s) of databases, passenger air travel history, frequent flier information, and much more. Airport, airlines, security, and/or other personnel utilize some type(s) of configurable hardware device(s). When a passenger leaves a check-in counter, they will be monitored at all times throughout an airport, airlines, aviation, and/or other environment(s), and are being tracked by various forms of communications device(s).

These hardware device(s) can be designed and configured to provide to the user(s) notification what mode they are in (Scan mode) scanning a passenger(s), or (not in scan mode), and is currently in another mode, such as collecting, and retrieving data and information on a passenger(s), and/or multiple other modes.

All types of handheld, fixed or portable terminal devices, or any type of hardware device can be utilized to provide to all types of personnel (including security, airline, airport, and other alike) information on any passenger(s) at any time, and in any location, by interacting with a passenger(s) airline ticket device(s). Information is provided to the handheld hardware device(s) operator under numerable configurations, formats, and/or methods, whether information is local, and/or remote by configuration.

The preferred method is for information to be provided from a local database storage location. A sample cycle is for at least one type of hardware device(s) operator to direct their device(s) at any passenger. The airline ticket device(s) for that particular passenger will provide the necessary identification, whether providing the information directly to at least one hardware device, and/or a means of identifying unique passenger information that is stored internally within at least one type of hardware device(s), and/or information that is stored externally from at least one remote database storage location.

At least one type of airline ticket device's unique identification provided to at least one type of hardware device(s) is received and sent out by at least one type of hardware device(s) to at least one type of local communications device, which could be designed and configured to hold and retain all information and/or can then interact with at least one other type of remote database storage location(s), whereby the necessary unique passenger information can be collected, identified, retrieved, and presented to at least one user, or hardware apparatus.

Confirmation for authorization can be performed by at least one type of technique and technology; some can include:

(i) at least one type of biometrics (finger print scan, iris scan, and/or other forms), where the preferred method requires the user(s) of the handheld hardware device(s) to have their thumb placed on the biometric reader pad on the side of the handheld hardware device(s) for authorization and use of such device(s), turning ON such a device(s), keeping the device(s) active, allowing the user to utilize the device(s) by screening the user(s) at least once, and/or at all times in order to keep the device(s) active.

(ii) voice-command that checks his/her (the operator of the handheld hardware device(s) unique voice print file for verification, only then will allow him/her to control the handheld hardware device(s), (iii) user(s) of all types of hardware device(s) to have a uniquely modified airline ticket device(s), whereby the handheld hardware device(s) checks and confirms the identify of the user(s) to see whether they have the necessary permission(s) to utilize the device(s) or not. Since the (preferred) specially modified airline ticket style device(s) is located on the wrist of the operator, scanning distance can be configured at a very short distance, and will not interfere with passenger(s) reading, information, and alike.

(iv) user(s) may also be required to input security code, and/or password information, which can remain the same, and/or can change at any random, or pre-determined order through voice, touch, and/or any other method(s).

All this data and information on user(s) of hardware device(s) could be configured to compile, collect, format, and provided to local, and/or remote database storage location(s), providing access control systems information, multiple function capabilities, audit activities, cost-effective management capabilities, report time and attendance capabilities, incorporation into monitoring equipment and process systems, such as CCTV, cameras, motion detecting systems, heat sensing systems, infrared sensing, scanning systems, reading systems, to name a few that can confirm, and record these activities anywhere in and around an airport, airplane, aviation, and/or other environment(s). All types of hardware device(s), whether they be handheld or not, can also be incorporated into these types of external monitoring systems that identify at all times the location of any given user(s), and can track, record, inform, and generate data files on any activities by user(s) of any such hardware device(s) that trigger automated systems, and/or manually by central operating station personnel who receive information to this effect.

All hardware device(s) can provide a full range of identification technologies through an open system operating system, software, and/or architecture, linking digital video identification photos directly to employee files on airline(s), airport(s), security, and other computer networks, and can operate on wired, and/or wireless formats of all type(s), and configuration(s).

All hardware devices can have the capability that would allow the user to query the system to locate the exact whereabouts of any person, object, or alike that has entered such secured system, and can link such hardware device through the network to provide pinpoint accuracy related to location, as well as enabling the hardware device to tie into any and all types of CCTV, and camera devices that can visually show the operator, in real-time, the area and surroundings of the person, object, or alike. This can become very useful in cases of tracking and apprehending a person that has been identified as a threat, and hardware device users want to visually confirm the identified party has not removed the trackable airline ticket device from their person.

As a passenger(s) enters a particular security checkpoint, various types of automated communications hardware device(s), (besides manually operated handheld hardware device(s)), utilized by security check point personnel are able to scan passenger(s), airline ticket device(s), carry-on baggage, among other things, and discretely receive, and update all types of data and information on that particular passenger(s).

At least one type of hardware device can be configured to identify, and inform whether the passenger is who they identify themselves to be, whether they have properly checked in an airline(s) yet or not, whether they are entering the correct satellite area of the airport when locating their respective departure gate, whether the passenger still has their airline ticket device(s) or has removed it, identifying the number of carry-on baggage items that are with them, and if not, where the carry-on baggage is located in and around the airport, airline, aviation, and/or other environment, to name a few. All information is communicated by and through all type(s) of communication device(s), and/or hardware device(s), so that at least one type of data file can continually be generated on each passenger(s) while they are in and around an airport, airline, aviation, and/or other environment. Database information can be shared by and between any and all type(s) of airports, airlines, aviation, intelligence agencies, and/or other authorized parties that are local, and/or at least one remote location(s).

If a passenger by chance were to forget and leave their carry on baggage (honestly by mistake) anywhere in an airport, airlines, aviation, and/or other environments by walking more than a configurable setting of space or distance, at least one type of communications device(s) can be configured to identify and inform anyone of such an event, including airport security, airlines, airport personnel, and/or the person directly by any type(s) of interaction—particularly a voice notification on a local P.A. system, and/or speaker system, so that the information does not have to be announced throughout an entire airport area (as it is currently done).

When a passenger(s) prepares to board an airplane, airline, airport, and/or security personnel at a gate are able to quickly identify, and confirm the authenticity of each specific passenger more quickly and efficiently than current systems, methods, and procedures through the use of a any numerable configurable hardware device(s), such as a terminal gate hardware device(s), and/or gate handheld hardware device(s).

At least one type of configurable device can provide any and all information about a particular passenger(s) as identified during the check-in process, as well as any and all information that has been compiled and collected between the check-in area, and the boarding gate area—in and around an airport, airline, aviation, and/or other environment.

As stated in prior reference methods, hardware device(s) user(s) know what passenger(s) look like (photo), their name, address, social security, drivers license information, airline name the passenger(s) is flying on, flight number, destination city, board gate number, departure time, on time, or delayed departure(s), number of checked-in luggage bag(s), number of carry-on bag(s), referencing the identification item placed on the passenger(s) checked-in, and carry-on luggage/baggage to ensure they are with the proper owner (passenger(s)), to name a few. If a passenger(s) does not have their carry-on baggage, and/or another passenger(s) carry-on bag(s) that is not theirs, that was identified and claimed during the check-in process, gate personnel are immediately informed—including the whereabouts of the carry-on baggage, and eliminates carry-on baggage from being left at the departing airport after the identified party has flown out.

When a passenger(s) enters an airplane, communications device(s) can identify any such predetermined seating arrangements for each passenger from its airline ticket, or preferably its device. It can determine and provide an automated head count, confirm all passengers carry-on baggage is loaded and within the airplane that is ready for departure, as well as confirming that all passenger(s) checked-in luggage has properly been loaded into the under belly of the airplane and are all accounted for, and providing final passenger flight logs and records, for the airport, airlines, pilot(s), and/or its crew, as well as the departing airline gate personnel and communications systems prior to departure. This information can be forwarded to the arriving airport, as well as external locations such as intelligence agencies.

If for any reason, a passenger(s) has not boarded an airplane at the designated time, the communications systems can identify whether passenger(s) is still in the airport, their whereabouts, and can provide notification that they are to immediately proceed to the designated gate for final boarding and departure from a local (PA) voice announcement within the specified location of the passenger(s) area, rather than random announcements that are currently made throughout an entire airport area, because current systems do not know exactly where the passenger(s) is located. If the passenger(s) is still in the airport area, and does not respond to voice notification(s), cameras can be utilized to visually see if the person at the location that has been identified by the persons, or objects airline ticket, or device. Once the person, or object is visually confirmed at the identified location, airline personnel, security personnel, or other parties can utilize their handheld hardware device(s) to physically go to the location where the passenger, or object has been identified at, and physically get them or it. One alternate method of notification to a passenger(s) can be incorporated into the airline ticket device(s), via audible, visual, and/or other means that is built into the device(s) itself.

In such cases where a passenger(s) is no longer within an airport area, the communications system(s) are able to quickly identify whether and where the passenger(s) carry-on baggage located within the airport, as well as the identification and location of the passengers checked-in luggage—throughout the baggage conveyor system, and/or if already loaded into the under belly of the airplane, which of the metal containers it is located at and/or within, thus reducing time to locate and remove such luggage, so that the airplane can quickly depart on schedule, and without delays.

At least one type of system can collect passenger information and share it with other airports, airlines, aviation, and/or other parties so that upon passenger(s) arrivals to another city/airport—whether it be a destination city, and/or a hub, with additional flights are required to complete a respective leg for the passenger(s) flight, the communications device(s), systems, and network(s) are able to identify, track, monitor, update, and continue to keep track of the passenger(s) until they walk out from the final airport of destination, and departs from the system(s).

Upon a passenger(s) departing the final airport destination environment, the passenger(s) airline ticket device(s) become invalid by various means, and methods. If this type of passenger(s) tries to re-enter an airport at a later point in time, the airline ticket device(s) will have already been terminated, disallowing the passenger(s) from gaining access to, and freely moving in and around an airport environment, without communications device(s) identifying them, and notifying local security personnel. At least one type of passenger(s) would equally not be able to enter, and/or pass through any such security check points that are located at all entry points to satellite gate areas. At least one type of passenger(s) would equally not be able to board an airplane at a gate area, because their expired airline ticket device(s) does not have the necessary authorization, approvals, and information that will allow them to gain access and pass gate terminal device(s), and access points.

Upon a passenger(s) arriving to their final destination city/airport, passenger(s) will be directed to customs, and/or baggage claim areas. At least one type of airline ticket device(s) can inform the passenger(s) which baggage claim carousel their checked-in luggage will be coming to, and identifies each unique passenger(s) to be allowed to enter a designated baggage claim carousel area. If a passenger(s) was not on a particular flight, and/or did not have any checked-in luggage of that particular flight, they would not be able to enter the baggage claim carousel area.

Upon a passenger(s) entering the baggage claim carousel area, passenger(s) are only allowed to exist such a location with their specific, and identified checked-in number of luggage, from collaboration between the identification item that was attached to the checked-in luggage item(s), and corresponding or cross referencing such identifiable information with the passenger(s) airline ticket device(s), through communications device(s) identifying the passenger(s) from their unique airline ticket device(s), and confirming the checked-in luggage to that particular passenger (matching them together) from the luggage bags identification. This identification can be configured in the use of numerable methodologies, and technologies including but not limited to bar code, RFID tag, and/or other identification technologies can be utilized in achieving one in the same objectives.

If at least one user, such as a passenger(s) accidentally takes the wrong checked-in luggage, and/or carry-on baggage, the system will not allow the passenger(s) to leave the baggage claim carousel area, and can inform all types of other parties including but not limited to airlines, airport, and security personnel. The system can provide audio and visual notification to any and all passengers for approved and unapproved authorization at all exist points.

While passenger(s) are at a designated baggage claim area, they can walk up to at least one type of terminal hardware device(s) to receive, and/or send information with the overall system. At least one type of passenger(s) may engage, and/or activate with the baggage claim terminal hardware device(s) is by simply walking up to such a device(s).

At least one type of system can inform at least one type of person, such as a passenger, (ETA) information how much longer they have to wait until the checked-in luggage will arrive (say in 12 minutes at carousel number 243) so they can relax and do other things like book a hotel, taxi, rental car, bus, contact a pick up party and more.

At least one type of system can inform at least one type of person, such as a passenger by calling out the name audibly, and/or name displayed on at least one type of visual display, or screen at the time when baggage comes out of the baggage claim carousel.

At least one type of terminal hardware device(s) that can automatically communicate with at least one type of person, hardware device, network, system; such as a passenger(s) airline ticket device(s) immediately identifying who they are, what language they require, and providing types of information accordingly.

Information services can be designed and configured with unlimited types of information services, including but not limited to:

(i) checking on the status of the passenger(s) checked-in luggage, providing (ETA) estimated time of arrival information so the passenger(s) knows how much longer it is going to take until their checked-in luggage bag arrives from the airplane to the identified carousel baggage claim area, (ii) (ii) passenger(s) can check on the status of the party(ies) who are picking them up from the airport. By a passenger(s) selecting the parking area and pick ups category, information is made available to the passenger(s) the location of the vehicle that the pick up party is at (i.e. 3$^{rd}$ floor, parking spot number 281), and providing map capabilities, where passenger(s) are able to receive a visual, audio, and/or print out information on that directs the passenger(s) on how to get to the pick up parties vehicle located at the parking area of an airport. Other options for passenger(s) can be utilized with any numerable types of removable media to insert into the baggage claim terminal hardware device(s) while interacting with such a device(s), downloading this information, then inserting removable media into any type(s) of hardware device(s) and taking any and all type(s) of information that was provided from a terminal hardware device(s) in and around an airport, airline, aviation, and/or other locations with them, to reference at a later point in time, and/or assist them in getting to their destination.

(iii) at least one user, such as a passenger(s) can book a taxi, limousine, shuttle bus, and/or other services (such as booking a hotel, vehicle rental, entertainment, and/or tourist tickets, to name a few) and providing map capabilities, where passenger(s) are able to receive a visual, audio, and/or print out information on that directs the passenger(s) on how to get to the their destination, including the same removable media capabilities as stated in (ii) above.

(iv) at least one user, such as a passenger(s) can utilize value added services, such as a message center that allows them to send text, audio, and/or types of communications to anyone within, and outside of an airport environment—such as letting parties know they have arrived safely from departure cities, letting parties know they have arrived safely at arrival cities and they are on their way to see them, checking into an office, back at home, email, and other forms of communication services.

(v) at least one type of information, and services can be integrated into any terminal device(s) that are located throughout an airport, airline, aviation, and/or other environment(s). By the time passenger(s) arrive to the taxi, limousine, shuttle bus, vehicle rental and/or other location(s), these service providers will be ready to immediately serve them.

Any and all interaction with any such information can be provided by any configurable method, whether by automatic formats, voice, touch screen, print, location of airline ticket device(s), and/or other forms and form factors for achieving the same objective(s).

At least one type of parking area hardware device(s) terminal(s) that can be utilized, among other things, by at least one party that way want to pick up/drop off passenger(s) from an airport, or other environment. There are numerable configurations for achieving similar objectives, with the preferred method to be as follows. Upon a pick up party arriving at a parking area of an airport, they pull their vehicle up to at least one type of hardware device(s) terminal(s), and either enters nothing on such a device(s) now, but simply takes a specially modified airline ticket type of device(s), or is given at least one question, and/or series of questions that quickly allows the airport system to identify which passenger(s) that the pick up party is seeking to pick up.

The preferred questions would include:

(i) the name of the passenger(s) that they are picking up, (ii) the airline the passenger(s) is flying on, (iii) the flight number/arrival time that the passenger(s) is flying on.

At least one type of method for the pick up party to key in this information on a hardware device(s) terminal(s) could be by touch screen, or voice recognition, although numerable methods can be utilized in achieving a similar objective(s). Then the pick up party is given a specially modified airline ticket type of device(s) from the machine. At least one type of pick up party could be instructed to place the ticket, receipt or other on the dashboard of the vehicle, and proceed forward and select a parking spot. At least one type of reader, antenna, and communications hardware device(s) can be located throughout a parking area, and are able to track, and/or locate each particular vehicle within the parking are environment.

As soon as the vehicle drives into a parking spot location, communications hardware device(s) read the unique identification number of that particular parking ticket, and know that exact parking location for that particular vehicle.

At least one type of communications hardware device(s) take this information and combine it with the previous information provided (above) by the pick up party, and stores it to be provided to the passenger(s) when they walk up to any hardware device(s) terminal that is located anywhere within an airport, airplane, aviation, and/or other environment. At least one type of area in which pick up party information is accessed by a passenger(s) would be from the baggage claim area hardware device(s) terminals, although any type of terminal hardware device(s) within an airport environment can be utilized by passenger(s) at any time. Passenger(s) are able to receive information on the location of the pick up party(ies) vehicle, as well as map information on how to get there from where they are currently located.

If pick up party does not wish to wait at the vehicle that is parked at a given parking spot location, they are able to go to retail tenant shop location(s) as part of the parking area, to get a cup of coffee, and/or other services while they are waiting.

There are numerable methods for tracking the location of a pick up party, with two preferred methods identified hereto. The first is for the pick up party to take their parking ticket with them to a meet and greet, and/or retail services location(s).

At least one type of communications device(s) can be tracked for location of the pick up party from the parking ticket. At least one other preferred methodology is for the pick up party to leave the parking ticket on the dashboard of the vehicle, and for them to simply walk over to these meet and greet, and/or retail services location(s) where hardware device(s) terminals are located there for the pick up party to enter their vehicle parking spot location information into the system, and/or other identifiable information.

Then when at least one passenger(s) wishes to retrieve such information from the system, the passenger(s) will know where the pick up parties vehicle is parked, as well as knowing that the pick up party is waiting at the meet and greet area, and/or inside a retail establishment within the parking area, or airport, such as a bookstore, or Starbucks coffee shop, and how to get to such location(s). At least one type of system can also be configured to allow passenger(s) to notify the pick up party that they are coming, when they are accessing a hardware terminal device(s). If one has ever waited for an arriving party at an airport, not even knowing if they ever were able to get on the flight, or how long they have to wait till the arriving party comes out, especially when the airline has lost your luggage, this can be very frustrating for the pick up party.

In cases where parking area configurations only have pick up parties take a parking ticket at the entry point, pick up parties could then go up to such hardware device(s) terminals that would preferably be located in the parking area, at meet and greet, and/or retail services location(s) where pick up parties would enter information (as stated above) that would identify the passenger(s) they intend picking up, and allowing passenger(s) to receive any and all of their pick up parties information.

At least one type of hardware device(s) terminals with various designs, and configuration(s) can be conveniently located throughout an airport environment, providing all types of passenger(s) accessibility and information resources and value added services. At least one passenger(s) need only to walk up to such terminal device(s) for contactless identification of a respective passenger to take place. At least one type of terminal hardware device(s) can be configured to provide all types of data and information to passenger(s), including automatically displaying messages and other information with the passenger doing any thing to receive such types of information. In this way, a majority of passenger(s) questions are answered from these automated terminal hardware device(s), thus reducing labor costs for airports, airlines, rental tenants, security personnel, and much more.

At least one type of communications hardware device(s) can eliminate 'bait and switch' tactics of carry-on baggage at security checkpoints by ensuring that only the passenger(s) who owns and is identified as the authorized owner can carry and have an identified carry-on baggage. At least one type of communications hardware device(s) are utilized to eliminate 'piggybacking' techniques where an unauthorized party follows behind an authorized party through controlled access points and gain access to areas of an airport they are not allowed to be at.

At least one type(s) of system(s), and equipment as stated hereto, can be designed, modified, integrated, configured, and utilized in any type and/or types of transportation environment(s), customs environments, other environments listed hereto, as well as those environments not described hereto.

At least one type of path, bandwidth allocation, protocol format, and other transmission means such as wired transmission (such as over a phone line, cable line, laser, photonic, copper or fiber means, power lines, or alike), or wireless transmission (such as over a cellular, paging, trunk radio, laser, (RBS) radio base station network(s), satellite network), whether it be analog or digital, whether it be cryptic, non-cryptic, whether it be spread spectrum, split spectrum or duel spectrum, whether it be in HF, VHF, UHF, AM, FM, IR, lightwave, RF, or any other type of frequency or spectrum can be utilized by the aforementioned system(s) and equipment.

Key Advantages—Applied to a Theme Park, Amusement Park, Tourist Location, Casino, or Other Environment When at least one visitors USER PROFILE is made, generated, or utilized from pre-configured options, on an INFORMATION TERMINAL or not, the visitor is able to create and/or utilize a profile that can include, but not be limited to various types of selections, such as:

(a). language(s), (b). check list (of places to see while at the theme park), (c). name (whether real or fake) to be used later to identify the visitor while in the theme park, (d). a photo of the visitor, and/or more than one visitor, and/or object such as a purse, (e). photo memories (if selects yes, various cameras that are placed throughout the theme park will take photos of the visitor as the visitor moves around the theme park, (f). memory disk (saves a profile of a the places that the visitor sees, with or without photos in item, (g). passwords can be created for authentication and security purposes.

(h). authorized communicators—allows the visitor to select other people who are with them to be authorized to communicate and leave messages for each other, such a parents, friends, and alike.

(i). discounts and offerings, (j). participation in any type of drawings, (k). participation in any type of PRIZES, (l). creation of play money for the visitor. The visitor, as an example is a family. The parent can buy a certain dollar amount of spending money that each child is allowed to spend for the day. All at least one users, such as a child, has to do is go and have fun, and its credits or dollars are identified, calculated, and deducted as the child runs around and enjoys themselves on rides, food, souvenirs, and anything else that they would normally need money for. In such a case, when they want to spend money, the payment is deducted from their BRACELETS account, so the child does not have to carry around any money with them, nor does the parent have to worry about another bigger kid to steal the child's bracelet and use up the money attached to the bracelet, because the if the bracelet is ever detached from the child's wrist, the bracelet becomes invalid, and if the child does not key in their password for authentication, even though another person were to try to steal the money from the device, if the child doesn't key in their own password, no authorization will be given for such a purpose.

(m). accumulation on visitor CREDITS, allows the external systems equipment and network to calculate and regulate for the visitor all CREDITS that they build up while there, whether it be based on dollar amounts spent, points for winning things, or other.

(n) so that when the visitor exits or leaves the theme park, they can pick up a memory disk to take back with them of their visit to the theme park, which includes everything from places and rides the visitor took, as well as advertising, discounts, promotions on merchandise, such as movies, club memberships to online sites, and more.

(o). knowing how many hours a visitor spent on the floor or at the tables of a gambling establishment, how much they spent, where they were, value of measuring comps, to name a few.

Once at least one type of device, such as a BRACELET or STICKER, is issued to the visitor by any numerable means, the visitor places the BRACELET on its wrist. By connecting two points together (shown in FIG. 1 item 104) this activates the BRACELET so that the BRACELET can become active and recognized by the various types of readers, and antennas (not shown) that are placed in and around a theme park, amusement park, a tourist location, or other location for a multitude of purposes.

In the same way, a STICKER can be utilized in the same fashion upon affixing, or attaching it to any surface, such as the backside of a persons' hand, or clothing.

If for any reason the visitor were to take the BRACELET off while in the theme park, the BRACELET will immediately become invalidated. Invalidation will be received by various types of readers, antenna, and other equipment that tracks, monitors, and maintains files on each person, object, or alike, and the (CMS) personnel will know which BRACELET along with associated visitor profile is now inactive, and where the invalidated BRACELET and user is located. Without any validated BRACELET, the visitor would not be able to engage in any types of rides, buildings, or events, and must be re-issued a new one if a mistake, or in cases of security, security personnel can identify and track from various types of cameras located throughout the theme park what really happened, and respond accordingly.

In the same way, if a person were to remote the STICKER the from the backside of its hand, or clothing, the process would in effect separate portions of the conductive material and invalidate the STICKER device.

At least one type of INFORMATION TERMINAL can provide a host of information related to any of the RIDES or BUILDINGS at the theme park, as well as MAP and directions where you currently are located as well as how to get there, including a print out MAP if required by the visitor.

At least one type of MESSAGE BOARD can be utilized for visitors, workers, or other who come to a theme park in a group to be able to disburse and go their own way, but later meet up at another location, or to tell one visitor where the other visitor has gone to (such as between parent and child). Any and all such information is only accessible by a visitor with a BRACELET or STICKER, who then walks up to a INFORMATION TERMINAL, whereby the terminal automatically reads the visitors BRACELETS identification comprised within the RF identification microchip, and asked the visitor to key in their password.

The system also allows a visitor to send images, photos, text, and more to friends outside of the theme park, such as a family goes to the theme park, and the child enters friends emails that she wants all her photos and memory disk information to also be sent to her (five best friends) back in Germany, or Japan.

There are numerable methodologies for achieving such a feature. One such avenue is to send these emails in real-time as and when a photo of the child visitor is taken say at each ride she takes at different times when she does it. Another such way is for the entire profile memory information to be sent out in one email.

Another avenue is for the child visitor to send text and/or images by automated means as and when the child visitor goes to each ride to her friend's cellular phone, pagers, or other wired and/or wireless means, who is not at the facility, such as any part of the world. In such a case, instead of being sent to the Childs friends email which is traditionally accessed by a desktop computer, laptop, or alike, such types of information is sent to the recipients cellular phone, which would more readily be viewed by at least one recipient.

At least one type of INFORMATION section can provide at least one type of information that the visitor may want to find out about, whether related directly to the theme park and rides that they are at, or other information about the services, products, and alike that the theme park group is involved in.

At least one type of EVENTS provides the visitor with an up to date list of EVENTS that happening or about to happen, the time it occurs, the place it will take place, map information how to get there, and more. This allows the visitor to plan out their day, by planning to be a various places at certain times, and to be able to get a print out of the visitors planned itinerary, as well as maintaining a hard copy on the network.

At least one type of HELP principally provides 911 or emergency types of services to the visitors, workers, employees, or other parties that are in the theme park. If there is a problem, all a visitor has to do is walk up to an INFORMATION TERMINAL key in their password, and touch the HELP icon. A (CMS) central monitoring station personnel will receive such a signal, and these personnel can immediately key in a camera that is coupled to that particular INFORMATION TERMINAL and can immediately see what is truly happening. The (CMS) personnel can also talk to the visitor who is standing at a particular INFORMATION TERMINAL for voice communications to confirm the emergency, so that the (CMS) personnel can quickly respond to any emergency.

At least one type of INFORMATION TERMINAL can also be designed and configured with removable talking devices, similar to a phone or walkie talkie, that can be released by the (CMS) personnel pushing a button at the (CMS) location, and whereby the visitor can take the talking device with them to where the emergency is located. This talking device can also be configured with a GPS receiver, or other means, such as triangulation, to follow and know exactly the visitors position.

At least one type of GALLERY allows the visitor to go around during their visit to the theme park, and buy all types of merchandise, but do not have to carry it around with them. At the end of the day, when the visitor wishes to EXIT the theme park, all the visitor has to do is walk up to an INFORMATION TERMINAL anywhere in the theme park, and key in that they wish to EXIT, and which EXIT they are planning to exit from, at what time, and all their gifts, souvenirs, and purchases are collected for them and given to them at the EXIT. Then the visitor does not have to carry their prizes or purchases with them around the theme park while there, that typically make the visitor have a more difficult time carrying these items with them on rides, or while walking around and wearing them out quicker than they normally would.

At least one type of OTHER section can include anything that the theme park, amusement park, tourist location, or other environment wishes to include.

At least one type of EXITS when a visitor exits the theme park, the visitors BRACELET or STICKER is read to confirm who the person is, whether they are allowed to exit the theme park without another visitor (such as a parent, or friend), check to see whether they forget to pick up any prizes, or purchases that they made while there, and a host of other items. The system also terminates the visitors BRACELET or STICKER, and logs them out of the system, so the same BRACELET or STICKER becomes invalidated and cannot be used to re-enter the theme park at any time in the future.

There are a great many advantages for a theme park, amusement park, casino, tourist location, or other environment to utilize such a system. Some of these advantages include:

(a). a means of time, audit, and attendance, (b). a means of tracking visitors, (this features can be valuable in the gambling industry, knowing how many hours a visitor is at the casino floor playing, in order to get its comps), (c). a means of traffic flow (disbursing visitors from long line rides to less congested rides), (d). a means of audible information (such as welcoming a visitor from its name, or play name to a ride, or location at the theme park, providing them information, providing how long of a wait it will be in line, suggestions of other shorter line rides and directions how to get there, information about a ride, thanking the visitor for taking the ride at the exit, and a host of additional information), (e). a means of theme park can track visitor traffic flows, determining where the high traffic areas are located, and which areas are low traffic, allowing a means of knowing which locations or rides needs to be improved upon or replaced, (f). a means of tracking of all employees, staffs, and workers, from time, audit and attendance, to creation of a data record where the worker when for its entire work day. This information can assist the theme park to improve worker efficiencies, and tracking to see if any clean up crew personnel really did all their job, as well as how long it took to complete each job at each location, (g). a means of merchandise can be tagged, whereby the system can track all of these items from entry into the theme park, to the proper booth or shelf, to the proper sale of the merchandise, to whom or which visitor, and more such as to ensure the merchandise is not stolen by a visitor or worker, (h). a means of inventory control for all types of merchandise, as well as food services, (i). a means of knowing where a visitor is seating at a food court, where food has to be delivered to the visitor, if for some reason the food was not ready at the time of purchase. Currently, plastic stands with numbers on them are handed out, which does not really help the food services staff to know exactly where the visitor is located, (j). a means of improved security, (k). a means of discount programs, (l). a means of credits programs, (m). a means of prizes programs, (n). a means for visitors to communicate by leaving text or voice messages in any language for other visitors, (o). a means of providing maps and location information, (p). a means of providing information on all types of rides, and buildings, (q). a means of providing timetables for events, (r). a means of sending data and information to at least one party outside of the theme park, whether in real-time, or not, whether in whole or in part, whether to an email address, cellular phone or other means, methods, or platforms, (s). a means of providing at least one type of information associated with a particular location, event, item, object, ride, or alike via text, audible, and/or visual means, (t). a theme park, or amusement park operator can collect at least one type of information, data, and alike which can be utilized for at least one purpose, such as improving crowd control, automated data collection of visitors, their habits, time spent where, for identification of high traffic areas, while identifying low traffic areas, so that the theme park, or amusement park can continually improve upon its services, rides, and attractions it provides to its visitors. From this type of data collection, data profiles can be configured based upon at least one type of software program configuration that can take such types of data inputs and associated information and format it into various reports.

(u). Improved time, audit, and attendance collection and reporting can be facilitated by the theme park, or amusement park, usually with its thousands of staffs working throughout a facility. A device, such as a bracelet, can be issued to all workers and staffs upon going to work, whereby a software program can track the location, activities, and movements of each and every worker. A specially configured software program that compares a data profile where the worker is to be located, for how long, and compare workers efficiencies can analyze data and information, (v). spending habits, and other forms of profiling.

The above is intended, along with the drawings, to illustrate the preferred embodiment of the invention. Those skilled in the art will be able to devise numerous arrangements, which, although not explicitly shown or described herein, embody the principles of the invention, and are within their spirit and scope as defined by the claims, and descriptions hereto.

Operation Related to a Theme Park, and/or Amusement Park

The purpose of this description is to provide at least one means, design, configuration, and methodology in utilization of the present invention in at least one type of theme park, or amusement park, tourist location, or other environment illustrating at least one configurable design functioning in such an environment.

As with most theme parks, amusement parks, and/or tourist locations, visitors typically pay for admission, whether at a live teller counter, or an automated dispensing machine which achieves one in the same for dispensing a ticket, receipt, or proof of payment for entry, and whereby visitors are typically given a receipt of such purchase, traditionally a paper printed ticket or receipt that allows the visitor entry.

With the present inventions techniques and methodologies, a visitor would go through at least one type of ENTRY of a theme park, amusement park, tourist location, or other environment, (whether payment is made or not, or whether a ticket or receipt is issued or not), the preferred embodiment is to issue a BRACELET (shown in FIG. 1, or STICKER shown in FIG. 8) to the visitor in the form of their receipt or ticket, (other forms, styles, shapes, and objects, such as stickers, necklace, pendent, or other design than a bracelet can be utilized to achieve at least one of the advantages identified hereto).

The preferred embodiment and methodology to the present invention is to issue an object, such as a BRACELET or STICKER for example purposes, that is utilized to provide and/or perform at least one type of service, feature, identification, profile, or other features, services, and alike to at least one party, such as a visitor, theme park owner, operator, advertiser, sub-tenant, and more, can be added, linked, provided, and/or included at this time, or at a later point in time, by the visitor themselves, or can be configured and established by the ticket counter teller, or dispensing machine, including external items such as a photo of the visitor, name information, password, credits, discounts, and other for the visitor.

The preferred embodiment and methodology to the present invention is to establish at least one type of USER PROFILE that would typically be facilitated by a ticket sales person, or an automated terminal for the visitor by simply asking them a few questions. An alternative, and secondary preferred methodology, is for the visitor to walk up to at least one type of user terminal to establish their own unique USER PROFILE themselves. To do so, the visitor would typically walk up to an information terminal to key in its own unique information. The terminal (similar to FIG. 2, 5, or 7), having a coupled reader would be configured with a read range (say up to 12 inch read range) such that would read the BRACELET or STICKER unique identification comprised within it microchip and/or microprocessor (shown in FIG. 1 item 107), or utilized as a reference means to information stored internally, locally, and/or remotely.

The preferred embodiment and methodology to the present invention for at least one type of system and related equipment can include one or all of the following items:

1. At least one type of unique identification device, principally utilized for monitoring, tracking, identification, providing of information, services, to at least one user, as well as the ability for at least one amusement park, or theme park operator, or alike to collect, and provide all types of information, data retrieval, modifications, services, time, audit, and attendance, crowd control, traffic statistical information, popularity of at least one type of ride, item, or area, as well as providing all types of communications capabilities by and between at least one party, or object to another party, object, alike.
2. At least one type of reader, scanner, and/or antenna to collect and/or provide at least one type of function, such as data collection, or presentation, identification, and alike. At least one type of reader and/or scanner device to be established in at least one location, and preferably in a plurality of locations in and around a theme park, amusement park, tourist location, or other environment,
3. At least one type of electronic hardware device, such as fixed INFORMATION TERMINALS, and/or portable hardware devices, which are conveniently located in at least one location for access and use by at least one party, such as a visitor, or accompanying at least one party, such as a visitor for at least one use and/or purpose that can provide at least one type of information,
4. At least one type of audible means, such as a speaker, or PA that can provide at least one type of audible information to at least one party, such as a visitor, which are conveniently located in at least one location to provide at least one type of information, such as upon a reader, scanner, and/or antenna identifying at least one type of device, such as a bracelet, at least one type of electronic device can identify, and read such type(s) of identification information, whereby if such visitor information is within the received data, at least one type of software program can immediately be programmed to respond by audibly speaking out the users name, or assumed name, in this particular example welcoming the visitor by name to at least one location, such as a ride, and providing at least one other type of information, such as how long of a wait in line the visitor has if is chooses to stay in line.

Other information can include options to disburse the visitor to a ride not far away that has a shorter line, to name a few. Such a system can identify the visitor on a ride, as well as upon existing the ride, thanking them for taking the ride and to have a nice day, or where to go from there to find another ride to take that has the shortest line, as an example.
5. At least one type of CCTV could be integrated into the system for providing at least one feature, such as, a software program that upon receiving an invalidation signal from a device, such as a bracelet, which is detected by at least one type of reader, scanner, and/or antenna and processed by at least one means and methodology to a local and or remote electronic device, such as a content delivery device, or a CMS central monitoring station, the software program instructs the CCTV to start recording that exact location.
6. At least one type of hardware device that can be utilized as a stand alone unit, can be updated by peer-to-peer technology, or can communicate with a (CMS) central monitoring stations centralized equipment for receipt and issuance of data, information, commands and requests of all types.

What is claimed is:

1. An identification and communication system for objects and users, comprising:

a plurality of radio identification devices;

means for attaching the radio identification devices to the objects and to the users;

at least one device for receiving and transmitting data via at least one antenna regarding the objects and the users to which the radio identification apparatus is attached, the at least one device coupled to at least one type of computer hardware device adapted to provide identifying, monitoring, storing, and processing functions for the data, whether non-networked, networked, or peer-to-peer among at least two additional computer hardware devices; and a plurality of display terminals adapted to identify a user in physical proximity to the respective display terminal and to selectively access the stored data in the at least one device at the request of the user and upon verification of user authorization to access requested stored data and to provide the requested stored data to the user on the display, the stored data comprising user location, object location, anticipated object location, and travel services.

2. The system of claim 1 wherein the means for attaching comprises one from among a bracelet and a sticker apparatus.

3. The system of claim 1, comprising a user interface for providing and creating a user profile and for providing data to the at least one device regarding one from among time, audit, and attendance, crowd control, management efficiencies, user inter-communications, interaction, identification, monitoring, processing, acknowledging, inputting, outputting, inventory control, and tracking worker activities, and for providing all types of audible and visual data and information, the user interface including a security component adapted to enable access to user data only by an authorized user.

4. A system for use with objects to identify and track objects and users of the objects and to provide information to users, comprising:

a plurality of a radio frequency identification tags adapted to store and retrieve unique user information;

a mechanism of attaching each tag to a respective object and to attach a tag to a user and adapted to activate the tags when attached to the object and to the user and to deactivate the tag when detached from the object and detached from the user;

a tracking system for reading data from each tag and generating data regarding the location of each tag;

a computer system for storing the location data of each read tag and for storing information for and about each user and communicating the information upon request by a user; and a device with a display terminal coupled to the computer system for reading data from each user tag when in radio frequency communication range with the user tag and to display the location data and user requested information upon verification of the requesting user's authorization.

5. The apparatus of claim 4 wherein the user requested information in the computer system that comprises travel related information that comprises airline scheduling, ticketing, and departure and arrival information.

6. The apparatus of claim 4 wherein the system comprises an airport terminal and a plurality of tag readers throughout the terminal as well as at security checkpoints in the terminal.

7. The apparatus of claim 4 wherein at least the user tag comprises means for providing at least one form of encryption.

8. The apparatus of claim 4 wherein the attaching mechanism comprises an activation circuit that activates the respective tag when the attaching mechanism becomes attached to the object or the user and deactivates the respective tag when detached from the object or the user.

9. The apparatus of claim 4 comprising a user authentication circuit adapted to authenticate a user with at least one from among a full facial image of a user, voice identification of a user, and luggage image identification.

10. The apparatus of claim 4 comprising a circuit adapted to invalidate the unique user information in the tag.

11. The apparatus of claim 4 wherein the attaching mechanism comprises a conductive material that activates the tag when the attaching mechanism becomes attached to the object.

12. The apparatus of claim 11 wherein the conductive material comprises electrical contacts.

13. The apparatus of claim 11 wherein the conductive material is utilized as a means of providing intercommunication between components of the tag.

14. The identifications apparatus of claim 11 wherein the attachment mechanism comprises a circuit adapted to communicate acknowledgement in activation and deactivation of the tag.

15. The apparatus of claim 11 wherein the attachment mechanism comprises a source of power for the tag.

16. The apparatus of claim 15 wherein the attachment mechanism comprises a timer circuit that is adapted to define a life time for use in expiration of the tag.

17. The apparatus of claim 11 wherein the display terminal comprises a display screen to display visual information and illumination of different areas of the display screen.

18. The apparatus of claim 17 wherein illumination of a different area of the display screen is based on one or more of proximity, geographic location, external event, reception of a radio frequency signal, inactivation, user choice, or time.

19. The apparatus of claim 11 wherein the attachment mechanism displays visual information that can include advertisement, promotion, discounts, sales, and events.

* * * * *